US005688630A

United States Patent [19]

Yamada et al.

[11] Patent Number: 5,688,630

[45] Date of Patent: Nov. 18, 1997

[54] SILVER HALIDE PHOTOGRAPHIC MATERIAL

[75] Inventors: Kohzaburoh Yamada; Hiroshi Takeuchi; Takashi Hoshimiya; Toshihide Ezoe; Shigeo Hirano; Minoru Sakai, all of Kanagawa, Japan

[73] Assignee: Fuji Photo Film Co., Ltd., Kanagawa, Japan

[21] Appl. No.: 558,856

[22] Filed: Nov. 16, 1995

[30] Foreign Application Priority Data

| | | | |
|---|---|---|---|
| Nov. 16, 1994 | [JP] | Japan | 6-305702 |
| Feb. 2, 1995 | [JP] | Japan | 7-035861 |
| Feb. 16, 1995 | [JP] | Japan | 7-050372 |

[51] Int. Cl.[6] ..... G03C 1/06

[52] U.S. Cl. ..... 430/264; 430/410

[58] Field of Search ..... 430/264, 410

[56] References Cited

U.S. PATENT DOCUMENTS

| | | | |
|---|---|---|---|
| 5,006,444 | 4/1991 | Okada et al. | 430/264 |
| 5,124,230 | 6/1992 | Okamura et al. | 430/264 |
| 5,220,022 | 6/1993 | Resnick et al. | 544/160 |
| 5,252,426 | 10/1993 | Chan | 430/264 |

FOREIGN PATENT DOCUMENTS

| | | | |
|---|---|---|---|
| A20393720 | 10/1990 | European Pat. Off. | G03C 1/06 |
| A20614113 | 9/1994 | European Pat. Off. | G03C 1/06 |
| A30614113 | 9/1994 | European Pat. Off. | G03C 1/06 |
| 63-32538 | 2/1988 | Japan | G03C 1/06 |
| 6-148828 | 5/1994 | Japan | G03C 5/29 |
| 6-180477 | 6/1994 | Japan | G06C 1/06 |
| 6-194774 | 7/1994 | Japan | G03C 1/06 |

*Primary Examiner*—Mark F. Huff

*Attorney, Agent, or Firm*—Sughrue,Mion,Zinn,Macpeak & Seas, PLLC

[57] ABSTRACT

A silver halide photographic material comprising a hydrazine compound is described, wherein the hydrazine compound is selected from (a) a hydrazide compound having an acyl group substituted with an anionic group and with an electron-attracting group and (b) a hydrazide compound having an acyl group substituted with an electron-attracting group and with a nonionic group which forms an intramolecular hydrogen bond with a hydrogen atom in hydrazide compound.

7 Claims, No Drawings

SILVER HALIDE PHOTOGRAPHIC MATERIAL

FIELD OF THE INVENTION

The present invention relates to a negative or direct-positive silver halide photographic material containing a hydrazine compound having a specific structure.

BACKGROUND OF THE INVENTION

In the field of graphic arts, an image-forming system showing an ultrahigh-contrast photographic performances (in particular γ is 10 or higher) is necessary to satisfactorily reproduce a dotted continuous-tone image or a line image. There had been a desire for an image-forming system which can give an ultrahigh-contrast photographic image through development with a processing solution having satisfactory storage stability. Proposed as such technique was a system comprising processing a surface latent image type silver halide photographic material containing a specific acylhydrazine compound with a developing solution containing 0.15 mol/l or more sulfite preservative and having a pH of 11.0 to 12.3 to form an ultrahigh-contrast negative image having a γ (gamma) value exceeding 10, as described in U.S. Pat. Nos. 4,166,742, 4,168,977, 4,221,857, 4,224,401, 4,243,739, 4,272,606, and 4,311,781. In contrast to conventional systems for forming an ultrahigh-contrast image in which systems the usable silver halide is limited to a silver chlorobromide having a high silver chloride content, the above-described new image-forming system is characterized in that even a silver iodobromide and a silver chloroiodobromide can be used. Another feature of that image-forming system is that the lith developer used therein has relatively good storage stability because it can contain a large amount of a sulfite preservative unlike conventional lith developers which can contain a sulfite preservative only in an exceedingly small amount. It should however be noted that developing solutions having a pH of 11 or higher are unstable and susceptible to aerial oxidation and hence do not withstand long-term storage or prolonged use. An attempt has been made to develop a silver halide photographic material containing a hydrazine compound with a developing solution having a lower pH to form a high-contrast image. In JP-A-1-179939 (the term "JP-A" as used herein means an "unexamined published Japanese patent application") and JP-A-1-179940 is described a processing method in which a photographic material containing both a nucleating development accelerator having a group capable of being adsorbed onto a silver halide emulsion grain and a nucleating agent having such an adsorbable group is developed with a developing solution having a pH of 11 or lower. However, the above-described prior art techniques have a drawback of insufficient development stability because the emulsion employed therein is a silver bromide or silver iodobromide emulsion and, hence, photographic performances vary considerably with the progress of development or with fluctuations of the composition of the processing solution.

In U.S. Pat. Nos. 4,998,604, 4,994,365, and 4,975,354 are disclosed a hydrazine compound having repeating units of ethylene oxide and a hydrazine compound having a pyridinium group. However, Examples given in these references show that these invented techniques are insufficient in contrast and it is difficult with any of these techniques to obtain both high contrast and a necessary $D_{max}$ value under development conditions suitable for practical use. In addition, the nucleating high-contrast photographic materials containing a hydrazine derivative have a drawback that photographic performances fluctuate in a wide range with fluctuations in the pH of the developing solution. A developing solution undergoes considerable fluctuations in pH; for example, aerial oxidation of the developing solution or concentration thereof by water evaporation increases the pH, while absorption of carbon dioxide from the air reduces the pH. Consequently, attempts are being made to diminish the dependence of photographic performances on the pH of a developing solution.

By the way, photographic materials for dot-to-dot working handled in an illuminated room are generally in wide use as a photographic material for platemaking. The photographic materials for use in this field are required to have high letter image quality necessary for reproducing even Ming-style characters having a small line width. It has hence been desired to develop a nucleating agent having higher activity. This desire is strong especially in daylight photographic materials having a low sensitivity for handling in an illuminated room, because the nucleating agent in this kind of photographic materials is less effective in attaining higher contrast.

To meet such a purpose, highly active hydrazine-compound nucleating agents have been developed as disclosed in, e.g., JP-A-6-148828, JP-A-6-180477, and JP-A-6-194774.

Among those are nucleating agents having an acyl group containing an alkyl group substituted with at least one electron-attracting group. This kind of nucleating agents are superior in that ultrahigh-contrast photographic performances are obtainable even with a developing solution having a pH of 11 or lower and that fluctuations in photographic performance due to developing-solution exhaustion are little. However, some of these nucleating agents are susceptible to oxidation and need to be improved in storage stability.

On the other hand, a technique of subjecting an internal latent image type silver halide photographic emulsion to surface development in the presence of a nucleating agent to obtain a direct positive image is known. This technique and the photographic emulsion or photographic material used therein are described in, e.g., U.S. Pat. Nos. 2,456,953, 2,497,875, 2,497,876, 2,588,982, 2,592,250, 2,675,318, 3,227,552, and 3,317,322, British Patents 1,011,062, 1,151,363, 1,269,640, and 2,011,391, JP-B-43-29405 (the term "JP-B" as used herein means an "examined Japanese patent publication"), JP-B-49-38164, JP-A- 53-16623, JP-A-53-137133, JP-A-54-37732, JP-A-54-40629, JP-A-54-74536, JP-A-54-74729, JP-A-55-52055, and JP-A-55-90940.

In the above-described technique for obtaining a direct positive image, the nucleating agent may be added to a developing solution. In most cases, however, the nucleating agent is incorporated into a photographic emulsion layer or another appropriate layer of the photographic material.

The best known nucleating agents for use in direct-positive silver halide photographic materials are hydrazine compounds, examples of which are given in *Research Disclosure*, No. 23510 (November 1953), p. 15162 (Vol. 151, November 1976), and No. 17626 (Vol. 176, December 1978). Hydrazine-compound nucleating agents generally have a large difference between maximum density ($D_{max}$) and minimum density ($D_{min}$) and are the most advantageous in discrimination. However, these nucleating agents have a drawback of the necessity of high-pH (11 or higher) processing, and an improvement in this respect has been desired.

SUMMARY OF THE INVENTION

Accordingly, an object of the present invention is to provide a silver halide photographic material containing a highly active hydrazine nucleating agent.

Another object of the invention is to provide a silver halide photographic material with which ultrahigh-contrast photographic performances with a γ value higher than 10 can be obtained using a stable developing solution.

A further object of the invention is to provide a silver halide photographic material for platemaking use which has high stability to processing and excellent storage stability.

A still further object of the invention is to provide a direct-positive photographic material which shows a sufficient reversal working effect even with a low-pH processing solution and in a small addition amount.

These and other objects of the present invention have been accomplished with a silver halide photographic material comprising a hydrazine compound, wherein the hydrazine compound is selected from (a) a hydrazide compound having an acyl group substituted with an anionic group and with an electron-attracting group and (b) a hydrazide compound having an acyl group substituted with an electron-attracting group and with a nonionic group which forms an intramolecular hydrogen bond with a hydrogen atom in hydrazide compound.

Preferably, the silver halide photographic material described above comprises a support having thereon at least one light-sensitive silver halide emulsion layer, wherein the hydrazide compound is contained in at least one layer of the silver halide emulsion layer and a non-light-sensitive layer (s) adjacent thereto.

More preferably, the hydrazide compound is preferably represented by the following formula (1):

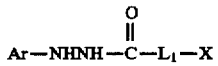

$$Ar-NHNH-\overset{\overset{\displaystyle O}{\|}}{C}-L_1-X \qquad (1)$$

wherein Ar represents an aromatic group; $L_1$ represents a divalent connecting group having an electron-attracting group; and X represents an anionic group or a nonionic group which forms an intramolecular bond with a hydrogen atom in the hydrazide compound.

DETAILED DESCRIPTION OF THE INVENTION

The compound for use in the present invention is explained below in detail.

In the present invention, the anionic group represented by X include a carboxylic acid group, sulfonic acid group, sulfinic acid group, phosphoric acid group, phosphonic acid group, and salts thereof. The electron-attracting group is an electron-attracting substituent excluding those anionic groups, and it specifically means a substituent having a positive Hammett's substituent constant ($\sigma_m$).

Preferably, the anionic group of the compound for use in this invention is a carboxylic acid group, sulfonic acid group, or salts thereof, and preferably a carboxylic acid group or salts thereof.

The nonionic group represented by X, which forms an intramolecular hydrogen bond with a hydrazine hydrogen atom, is a group in which a lone pair forms a hydrogen bond with a hydrazine atom in a five- to eight-membered ring, and is a group containing at least one of an oxygen atom, a nitrogen atom, a sulfur atom and a phosphorus atom, provided that the nonionic group is not an alkoxy group. Examples of the nonionic group include a hydroxyl group, N-hydroxycarbamoyl group, amino group, alkylthio group, carbonyl group, carbamoyl group, alkoxycarbonyl group, urethane group, ureido group, acyloxy group, acylamino group, hydrazido group, and β-sulfonylhydrazine group. Of these groups, a hydroxyl group, N-hydroxycarbamoyl group, carbonyl group, carbamoyl group, and alkoxycarbonyl group are desirable, with a hydroxyl group, N-hydroxycarbamoyl group, and carbamoyl group being preferred.

In formula (1), Ar represents an aromatic group, aryl group or heterocyclic group, which each may be substituted. The aryl group has from 6 to 24 carbon atoms, preferably from 6 to 12 carbon atoms, and examples thereof include phenyl, naphthyl, p-alkoxyphenyl, p-sulfonamidophenyl, p-ureidophenyl, and p-amidophenyl. The heterocyclic group is a five- or six-membered, saturated or unsaturated heterocyclic group having from 1 to 5 carbon atoms and containing one or more heteroatoms of one or more elements selected from oxygen, nitrogen, and sulfur. Examples of the heterocyclic group include 2-furyl, 2-thienyl, and 4-pyridyl.

The group represented by Ar in formula (1) is preferably an aryl group (e.g., phenyl, naphthyl), more preferably a phenyl group substituted with one or more substituents. Examples of the substituents are enumerated below.

The substituents in the present invention represent a halogen atom or a substituent bonded to the ring or main chain through a carbon, oxygen, nitrogen, or sulfur atom. Examples of the substituent bonded through a carbon atom include an alkyl group, alkenyl group, alkynyl group, aryl group, carbamoyl group, alkoxycarbonyl group, aryloxycarbonyl group, acyl group, carboxyl group, cyano group, and heterocyclic group. Examples of the substituent bonded through an oxygen atom include a hydroxyl group, alkoxy group, aryloxy group, heterocyclicoxy group, acyloxy group, carbamoyloxy group, and sulfonyloxy group. Examples of the substituent bonded through a nitrogen atom include an acylamino group, amino group, alkylamino group, arylamino group, heterocyclicamino group, ureido group, sulfamoylamino group, alkoxycarbonylamino group, aryloxycarbonylamino group, sulfonamido group, imido group, and heterocyclic group. Examples of the substituent bonded through a sulfur atom include an alkylthio group, arylthio group, heterocycle-thio group, sulfamoyl group, alkoxysulfonyl group, aryloxysulfonyl group, sulfonyl group, sulfo group, and sulfinyl group. These groups each may be substituted with any of these substituents.

Preferable substituents in the present invention are explained in greater detail. Examples of the halogen atom include a fluorine atom, chlorine atom, and bromine atom. The alkyl group is a linear, branched, or cyclic alkyl group having from 1 to 16, preferably from 1 to 10, carbon atoms, and examples thereof include methyl, ethyl, isopropyl, t-butyl, benzyl, and cyclopentyl. The alkenyl group has from 2 to 16 carbon atoms, and examples thereof include vinyl, 1-propenyl, 1-hexenyl, and styryl. The alkynyl group has from 2 to 16 carbon atoms, and examples thereof include ethynyl, 1-butynyl, 1-dodecenyl, and phenylethynyl. The aryl group has from 6 to 24 carbon atoms, and examples thereof include phenyl, naphthyl, and p-methoxyphenyl.

The carbamoyl group has from 1 to 18 carbon atoms, and examples thereof include carbamoyl, N-ethylcarbamoyl, N-octylcarbamoyl, and N-phenylcarbamoyl. The alkoxycarbonyl group has from 2 to 18 carbon atoms, and examples thereof include methoxycarbonyl and benzyloxycarbonyl. The aryloxycarbonyl group has from 7 to 18 carbon atoms, and examples thereof include phenoxycarbonyl. The acyl group has from 1 to 18 carbon atoms, and examples thereof include acetyl and benzoyl. The heterocyclic group bonded through a carbon atom on the ring is a five- or six-membered, saturated or unsaturated heterocyclic group having from 1 to 5 carbon atoms and containing one or more heteroatoms of one or more elements selected from oxygen, nitrogen, and sulfur. Examples of the heterocyclic group include 2-furyl, 2-thienyl, 2-pyridyl, and 2-imidazolyl.

The alkoxy group has from 1 to 16, preferably from 1 to 10, carbon atoms, and examples thereof include methoxy, 2-methoxyethoxy, and 2-methanesulfonylethoxy. The aryloxy group has from 6 to 24 carbon atoms, and examples thereof include phenoxy, p-methoxyphenoxy, and m-(3-hydroxypropionamido)phenoxy. The heterocycle-oxy group is one in which the heterocycle is a five- or six-membered, saturated or unsaturated heterocycle having from 1 to 5 carbon atoms and containing one or more heteroatoms of one or more elements selected from oxygen, nitrogen, and sulfur, and examples thereof include 1-phenyltetrazolyl-5-oxy, 2-tetrahydropyranyloxy, and 2-pyridyloxy. The acyloxy group has from 1 to 16, preferably from 1 to 10, carbon atoms, and examples thereof include acetoxy, benzoyloxy, and 4-hydroxybutanoyloxy. The carbamoyloxy group has from 1 to 16, preferably from 1 to 10, carbon atoms, and examples thereof include N,N-dimethylcarbamoyloxy, N-hexylcarbamoyloxy, and N-phenylcarbamoyloxy. The sulfonyloxy group has from 1 to 16 carbon atoms, and examples thereof include methanesulfonyloxy and benzenesulfonyloxy.

The acylamino group has from 1 to 16, preferably from 1 to 10, carbon atoms, and examples thereof include acetamido and p-chlorobenzoylamido. The alkylamino group has from 1 to 16, preferably from 1 to 10, carbon atoms, and examples thereof include N,N-dimethylamino and N-(2-hydroxyethyl)amino. The arylamino group has from 6 to 24 carbon atoms, and examples thereof include anilino and N-methylanilino. The heterocyclicamino group is one in which the heterocycle is a five- or six-membered, saturated or unsaturated heterocycle having from 1 to 5 carbon atoms and containing one or more heteroatoms of one or more elements selected from oxygen, nitrogen, and sulfur, and examples thereof include 2-oxazolylamino, 2-tetrahydropyranylamino, and 4-pyridylamino. The ureido group has from 1 to 16, preferably from 1 to 10, carbon atoms, and examples thereof include ureido, methylureido, N,N-diethylureido, and 2-methanesulfonamidoethylureido.

The sulfamoylamino group has from 0 to 16, preferably from 0 to 10, carbon atoms, and examples thereof include methylsulfamoylamino and 2-methoxyethylsulfamoylamino. The alkoxycarbonylamino group has from 2 to 16, preferably from 2 to 10, carbon atoms, and examples thereof include methoxycarbonylamino. The aryloxycarbonylamino group has from 7 to 24 carbon atoms, and examples thereof include phenoxycarbonylamino and 2,6-dimethoxyphenoxycarbonylamino. The sulfonamido group has from 1 to 16, preferably from 1 to 10, carbon atoms, and examples thereof include methanesulfonamido and p-toluenesulfonamido. The imido group has from 4 to 16 carbon atoms, and examples thereof include N-succinimido and N-phthalimido. The heterocyclic group bonded through a nitrogen atom of the ring is a five- to six-membered heterocyclic group in which the ring consists of one or more nitrogen atoms and one or more atoms of at least one element selected from carbon, oxygen, and sulfur, and examples thereof include pyrrolidino, morpholino, and imidazolino.

The alkylthio group has from 1 to 16, preferably from 1 to 10, carbon atoms, and examples thereof include methylthio and 2-phenoxyethylthio. The arylthio group has from 6 to 24 carbon atoms, and examples thereof include phenylthio and 2-carboxyphenylthio. The heterocyclicthio group is one in which the heterocycle is a five- or six-membered, saturated or unsaturated heterocycle having from 1 to 5 carbon atoms and containing one or more heteroatoms of one or more elements selected from oxygen, nitrogen, and sulfur, and examples thereof include 2-benzothiazolylthio and 2-pyridylthio.

The sulfamoyl group has from 0 to 16, preferably from 0 to 10, carbon atoms, and examples thereof include sulfamoyl, methylsulfamoyl, and phenylsulfamoyl. The alkoxysulfonyl group has from 1 to 16, preferably from 1 to 10, carbon atoms, and examples thereof include methoxysulfonyl. The aryloxysulfonyl group has from 6 to 24, preferably from 6 to 12, carbon atoms, and examples thereof include phenoxysulfonyl. The sulfonyl group has from 1 to 16, preferably from 1 to 10, carbon atoms, and examples thereof include methanesulfonyl and benzenesulfonyl. The sulfinyl group has from 1 to 16, preferably from 1 to 10, carbon atoms, and examples thereof include methanesulfinyl and benzenesulfinyl.

Preferable substituents in the present invention are a halogen atom, alkyl group, aryl group, carbamoyl group, alkoxycarbonyl group, aryloxycarbonyl group, acyl group, cyano group, alkoxy group, aryloxy group, carbamoyloxy group, acylamino group, ureido group, sulfamonylamino group, alkoxycarbonylamino group, sulfonamido group, sulfamoyl group, and sulfonyl group. More preferred are an alkyl group, aryl group, carbamoyl group, alkoxy group, acylamino group, ureido group, sulfonamido group, and sulfamoyl group. Particularly preferred are an acylamino group, ureido group, and sulfonamido group.

The substituent of Ar in formula (1) may contain, incorporated therein, either a ballast group in ordinary use in immobile photographic additives, e.g., couplers, or a polymer. The ballast group is a group which has 8 or more carbon atoms and less influences photographic performances. The ballast group can be selected from, e.g., an alkyl group, alkoxy group, phenyl group, alkylphenyl group, phenoxy group, and alkylphenoxy group. Examples of the polymer include those described in JP-A-1-100530.

The group represented by Ar in formula (1) may have, as a substituent, a group which accelerates adsorption onto silver halide grains.

Preferred examples of the group accelerating adsorption onto silver halide grains include a thioamido group, mercapto group, and five- or six-membered nitrogenous heterocyclic group.

The adsorption-accelerating thioamido group may be a divalent group represented by the following formula:

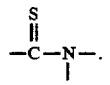

This group may be a part of a ring structure, or may preferably be an acyclic thioamido group. Useful adsorption-accelerating thioamido groups can be selected, for example, from the thioamido groups disclosed in U.S. Pat. Nos. 4,030,925, 4,031,127, 4,080,207, 4,245,037, 4,255,511, 4,266,013, and 4,276,364 and *Research Disclosure*, Vol. 151, No. 15162 (November 1976) and Vol. 176, No. 17626 (December 1978). Especially preferred thioamido groups are those represented by formula (A):

$$R^{61}-E-\overset{\overset{\displaystyle S}{\|}}{C}-E'- \quad (A)$$

wherein one of E and E' represents —N($R^{62}$)— and the other represents —O—, —S—, or —N($R^{62}$)—; $R^{62}$ represents a hydrogen atom, an aliphatic group, or an aromatic group, or is bonded to E or E' to form a five- or six-membered heterocycle; $R^{61}$ represents a hydrogen atom, an aliphatic group, or an aromatic group.

Examples of the thioamide represented by formula (A) include thiourea, thiourethane, and dithiocarbamates. In the case where E or E' is bonded to $R^{62}$ to form a ring, examples of the structure represented by formula (A) include the acid nuclei of merocyanine dyes. Specific examples thereof include 4-thiazoline-2-thione, thiazolidine-2-thione, 4-oxazoline-2-thione, oxazolidine-2-thione, 2-pyrazoline-5-thione, 4-imidazoline-2-thione, 2-thiohydantoin, rhodanine, isorhodanine, 2-thio-2,4-oxazolidinedione, thiobarbituric acid, tetrazoline-5-thione, 1,2,4-triazoline-3-thione, 1,3,4-thiadiazoline-2-thione, 1,3,4-oxadiazoline-2-thione, benzimidazoline-2-thione, benzoxazoline-2-thione, and benzthiazoline-2-thione. These may be further substituted.

The adsorption-accelerating mercapto group may be an aliphatic mercapto group, an aromatic mercapto group, or a heterocyclicmercapto group (in the case where the heterocycle contains a nitrogen atom adjacent to the SH-bonded carbon atom, this heterocycle has been described as a ring-forming thioamido group, which is a tautomer thereof). Examples of the aliphatic mercapto group include mercaptoalkyl groups (e.g., mercaptoethyl and mercaptopropyl), mercaptoalkenyl groups (e.g., mercaptopropenyl), and mercaptoalkynyl groups (e.g., mercaptobutynyl). Examples of the aromatic mercapto group include mercaptophenyl and mercaptonaphthyl. Examples of the heterocyclicmercapto group include 4-mercaptopyridyl, 5-mercaptoquinolinyl, and 6-mercaptobenzthiazolyl, in addition to the groups enumerated hereinabove with regard to the ring-forming thioamido group.

The five- or six-membered nitrogenous heterocyclic group which accelerates adsorption may be a five- or six-membered group in which the heterocycle is constituted by nitrogen atoms and one or more atoms of oxygen, sulfur and carbon. Preferable examples thereof include benzotriazole, triazole, tetrazole, indazole, benzimidazole, imidazole, benzothiazole, thiazole, benzoxazole, oxazole, thiadiazole, oxadiazole, and triazine. These may have one or more appropriate substituents. Preferred are benzotriazole, triazole, tetrazole, and indazole. Benzotriazoleis particularly preferred.

Preferred examples of the nitrogenous heterocyclic group include benzotriazol-5-yl, 6-chlorobenzotriazol-5-yl, benzotriazole-5-carbonyl, 5-phenyl-1,3,4-triazol-2-yl, 4-(5-methyl-1,3,4-triazol-2-yl)benzoyl, 1H-tetrazol-5-yl and 3-cyanoindazol.

$L_1$ represents a divalent connecting group, and examples thereof include an alkylene group, an alkenylene group, an arylene group, a divalent heterocyclic group, and a group comprising two or more of such divalent groups connected to each other by, e.g., —O—, —S—, —NH—, —CO—, —$SO_2$—, or by a combination of two or more thereof. $L_1$ may be substituted with any of the groups enumerated hereinabove as substituents of Ar. Examples of alkylene group include methylene, ethylene, trimethylene, propylene, 2-buten-1,4-yl, and o-xylylene. Examples of the alkenylene group include vinylene. Examples of the arylene group include o-phenylene. Examples of the divalent heterocyclic group include furan-1,2-diyl. $L_1$ is desirably an alkylene group, alkenylene group, or arylene group, and preferably an alkylene group or phenylene group. The most preferable group represented by $L_1$ is an alkylene group having 2 or 3 carbon atoms.

The electron-attracting group possessed by $L_1$ has a Hammett's $\sigma_m$ value of 0.2 or higher, preferably 0.3 or higher. Examples of the electron-attracting group include a halogen atom (e.g., fluorine, chlorine, bromine), a cyano group, sulfonyl group (e.g., methanesulfonyl, benzenesulfonyl), sulfinyl group (e.g., methanesulfinyl), acyl group (e.g., acetyl, benzoyl), oxycarbonyl group (e.g., methoxycarbonyl), carbamoyl group (e.g., N-methylcarbamoyl), sulfamoyl group (e.g., methylsulfamoyl), halogen-substituted alkyl group (e.g., trifluoromethyl), heterocyclic group (e.g., 2-benzoxazolyl and pyrrolo), quaternary onium group (e.g., triphenylphosphonium, trialkylammoniums, pyridinium), nitro group, and sulfonamido group. Preferred is a fluorine atom. Examples of $L_1$, which has such an electron-attracting group, include tetrafluoroethylene, fluoromethylene, hexafluorotrimethylene, perfluorophenylene, difluorovinylene, cyanomethylene, and methanesulfonylethylene.

In the case where X in formula (1) represents an anionic group, the hydrazide compound is preferably represented by the following formula (2-a) or (2-b):

$$Ar-NHNH-\overset{\overset{\displaystyle O}{\|}}{C}-L_2-COOH \quad (2\text{-a})$$

$$(Ar-NHNH-\overset{\overset{\displaystyle O}{\|}}{C}-L_2-COO^-)_m M^{m+} \quad (2\text{-b})$$

wherein Ar represents an aromatic group; $L_2$ represents a divalent alkylene or phenylene group substituted with one or more fluorine atoms; M represents a counter cation; and m is an integer of 1 to 3.

In formulae (2-a) and (2-b), Ar has the same meaning as in formula (1), and preferred examples thereof are also in the same range as for formula (1). $L_2$ represents a divalent alkylene or phenylene group partly or wholly substituted with fluorine atoms.

Examples of the group represented by $L_2$ include —$CF_2CF_2$—, —$C_3F_6$—, —$CF_2CH_2$—, —CFH—, —$(CF_2)_4$—, —$(CF_2)_6$—, —$C_6F_4$— (tetrafluorophenylene group), and —$CF_2$—. Especially preferred groups represented by $L_2$ are —$CF_2CF_2$— and —$C_3F_6$—.

In formula (2-b), M represents a counter cation and m represents an integer of 1 to 3. Examples of the cation represented by M include a lithium ion, sodium ion, potassium ion, calcium ion, magnesium ion, aluminum ion, zinc ion, barium ion, quaternary ammonium ion, heterocycle containing a quaternized nitrogen atom, and quaternary phosphonium ion.

M is especially preferably a sodium ion or a potassium ion. In this case, m is 1.

The group represented by Ar in formulae (2-a) and (2-b) may contain a substituent group which accelerates adsorption onto silver halide grains.

The compound represented by formulae (2-a) and (2-b) is preferably represented by the following formula (3-a) or (3-b).

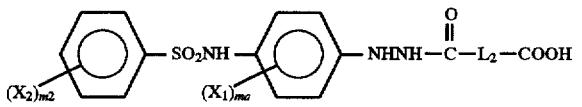

(3-a)

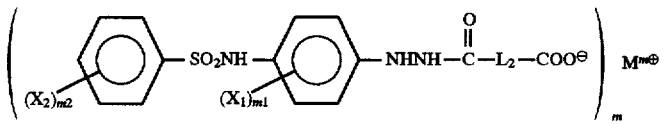

(3-b)

In the above formulae, $L_2$, M, and m each has the same meaning as in formulae (2-a) and (2-b). $X_1$ and $X_2$ each represents a group capable of being bonded as a substituent to a benzene ring. $m_1$ and $m_2$ represent an integer of 0 to 4 and an integer of 0 to 5, respectively. When $m_1$ or $m_2$ is an integer of 2 or larger, the groups represented by $X_1$ or $X_2$ may be the same or different and may be bonded to each other to form a ring.

The substituent represented by $X_1$ has the same meaning as the substituent described hereinabove. Preferred examples of the substituent include an alkyl group, hydroxyl group, amino group, alkylamido group, arylamido group, alkylsulfonamido group, arylsulfonamido group, carboxyl group, sulfo group, salts of these groups, alkylthio group, mercapto group, acyloxy group, and heterocyclic group.

Especially preferred of the compounds represented by formula (3-a) or (3-b) are those represented by the formula wherein $m_1$ is 0.

$X_2$ has the same meaning as the substituent of Ar described hereinabove with regard to formulae (2-a) and (2-b), and preferred examples thereof are also in the same range. The group represented by $X_2$ may contain a group which accelerates adsorption onto silver halide grains. $m_2$ is preferably 1 or 2, more preferably 1.

Especially preferred of the compounds represented by formula (3-a) or (3-b) are those represented by the following formulae (4-a, b) to (7-a, b).

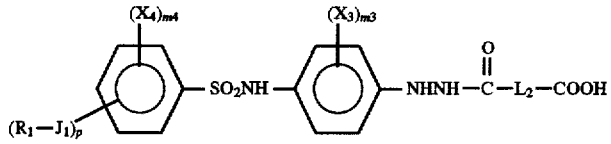

(4-a)

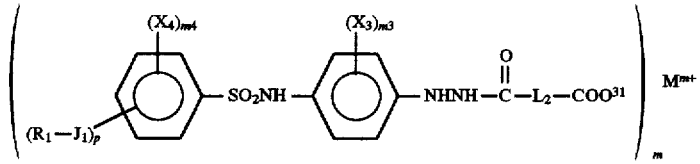

(4-b)

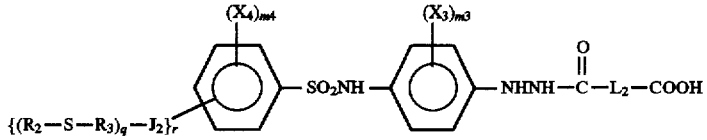

(5-a)

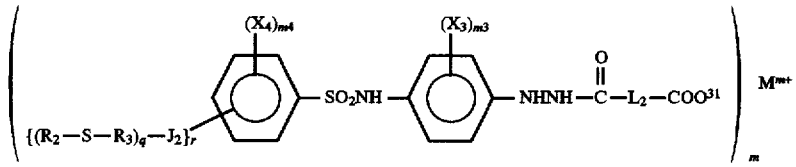

(5-b)

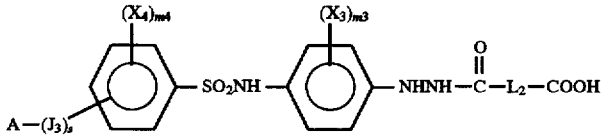

(6-a)

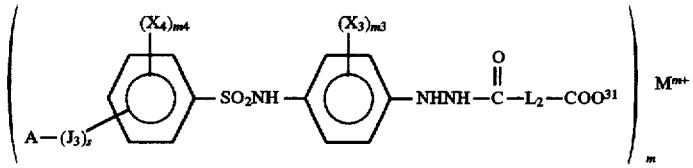

(6-b)

-continued

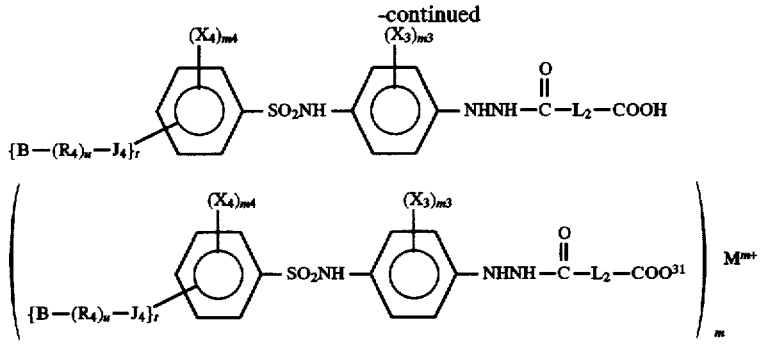

(7-a)

(7-b)

In formulae (4-a, b) to (7-a, b), $X_3$ and $X_4$ each represents a substituent, and have the same meanings as $X_1$ and $X_2$ in formula (3-a) or (3-b). $m_3$ and $m_4$ each represents an integer of 0 to 4.

$J_1$, $J_2$, $J_3$, and $J_4$ each represents a divalent connecting group. Examples thereof include groups represented by $-SO_2NR_{11}-$, $-NR_{11}SO_2-$, $-CONR_{11}-$, $-NR_{11}CO-$, $-COO-$, $-O-CO-$, $-O-$, $-S-$, $-NR_{11}SO_2NR_{12}-$, and $-NR_{11}CONR_{12}-$, wherein $R_{11}$ and $R_{12}$ each represents a hydrogen atom, an aliphatic group, or an aromatic group.

p, q, r, and t each represents 1 or 2. When p, r, and t each is 2, $m_4$ represents an integer of 3 or smaller. s and u each represents 0 or 1.

In formula (4-a) or (4-b), $R_1$ represents a substituted or unsubstituted, branched or linear alkyl group having from 4 to 16 carbon atoms in total. When the alkyl group represented by $R_1$ has a substituent, examples of this substituent include the same groups as the aforementioned examples of the substituent of Ar in formula (1). Preferred examples of the substituent include an aryloxy group, alkoxy group (including those containing ethyleneoxy repeating units), carboxyl group, and alkoxycarbonyl group.

In formula (5-a) or (5-b), $R_2$ represents an alkyl group, a cycloalkyl group, an aryl group, or a heterocyclic group, and $R_3$ represents a divalent aliphatic group. The total number of carbon atoms contained in $R_2$ and $R_3$ is preferably from 2 to 20. These groups may further have a substituent. Preferred examples of the substituent include an alkoxy group (including those containing ethyleneoxy repeating units), alkyl group, carboxyl group, alkoxycarbonyl group, carbamoyl group, ammonium group, amino group, hydroxyl group, and alkylthio group.

In formula (6-a) or (6-b), A represents a group which accelerates adsorption onto silver halide grains. Examples of A include the same groups as the aforementioned adsorption-accelerating substituent groups which Ar in general formula (1) may have. Preferred examples of A include an aromatic or heterocyclic group containing a mercapto group, a heterocyclic group having a mercaptoalkylene group, a thioureido group, a thiourethane group, a thioamido group, an alkyl or cycloalkyl group containing a disulfide bond, and a nitrogenous heterocyclic group containing two or more nitrogen atoms at least one of which is bonded to a hydrogen atom. Specific examples thereof include mercapto, mercaptophenyl, 2-mercapto-1-thia-3,4-diazolyl, 5-mercaptotetrazolyl, 2-mercapto-1,3,4-triazolyl, 2-mercaptobenzoxazolyl, 2-mercaptobenzothiazolyl, 2-mercaptopyridyl, 4-mercapto-1,3,3a,7-tetrazaindenyl, benzotriazolyl, thiatriazolyl, thioureido, N'-phenylthioureido, and phenylthiourethane.

In formula (7-a) or (7-b), B represents a cationic group and a counter anion therefor. Examples of the cationic group include a quaternary ammonium group, a nitrogenous heterocyclic group having a quaternized nitrogen atom, a quaternary phosphonium group, and a tertiary sulfonium group, and examples of the counter anion include a chlorine anion, bromine anion, iodine anion, and sulfo anion.

The cationic group represented by B is preferably a quaternary ammonium group or a nitrogenous heterocyclic group having a quaternized nitrogen atom. Examples of these groups include a trialkylammonium group, pyridinium group, quinolinium group, isoquinolinium group, phenanthrinium group, triazolinium group, imidazolinium group, and benzothiazolinium group.

These groups may be further substituted with a substituent. Preferred substituents include an alkyl group, aryl group, alkoxy group, alkylcarbamoyl group, amino group, ammonium group, and heterocyclic group.

Especially preferred examples of the cationic group represented by B are a trialkylammonium group and a pyridinium group, and especially preferred examples of the counter ion are a chlorine anion and a bromine anion.

$R_4$ represents a divalent aliphatic group, and may further have a substituent. $R_4$ is preferably an alkylene group, especially preferably an unsubstituted, linear or branched alkylene group.

In formulae (4-a, b) to (7-a, b), M and m each has the same meaning as in formulae (2-a) and (2-b).

When the compound for use in the present invention is represented by formula (1) wherein X represents an anionic group, specific examples thereof are given below. However, the compound for use in this invention should not be construed as being limited thereto.

1
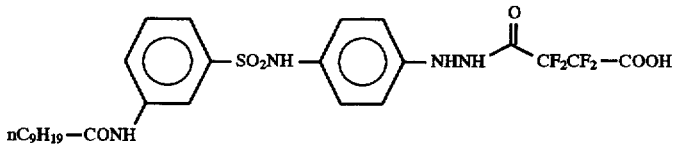
2
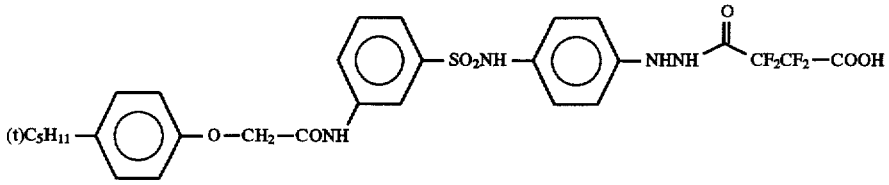
3
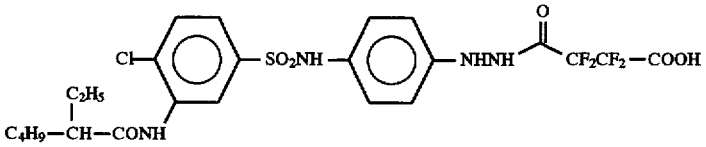
4
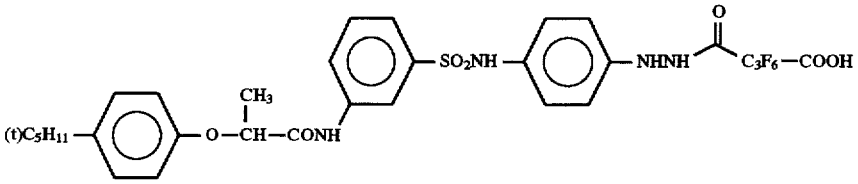
5
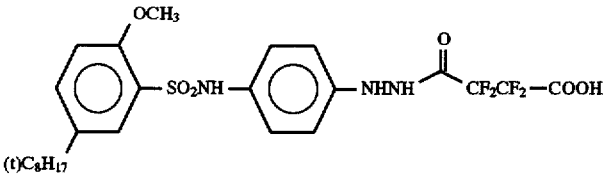
6
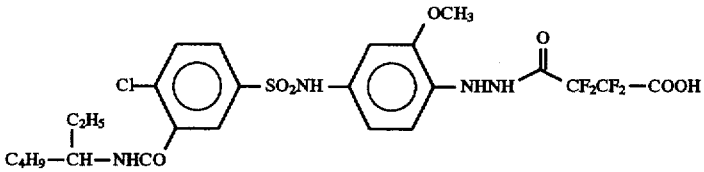
7
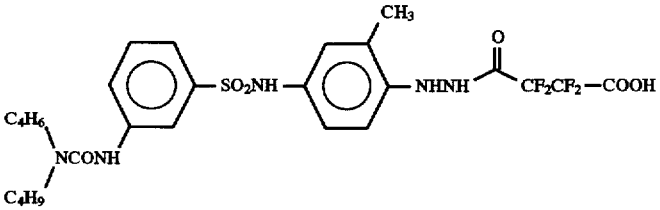
8
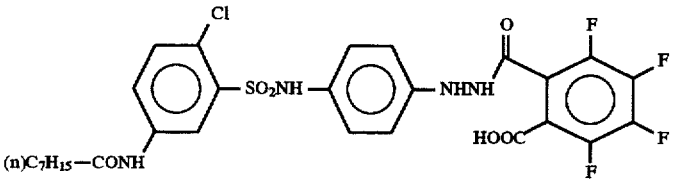
9
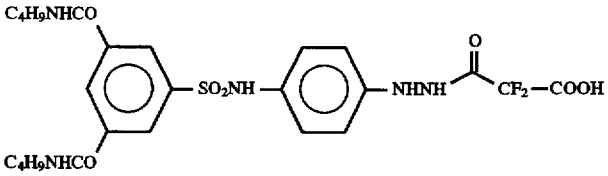

-continued
10
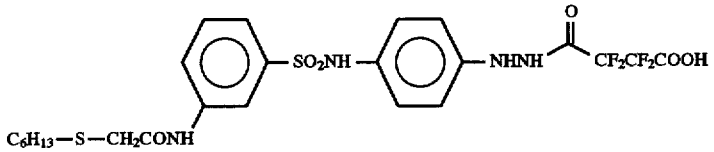
11
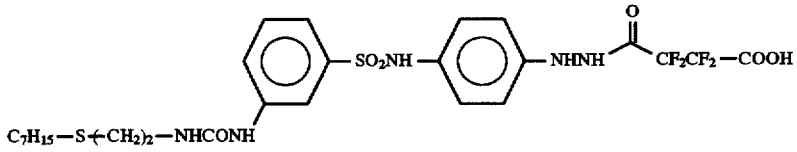
12
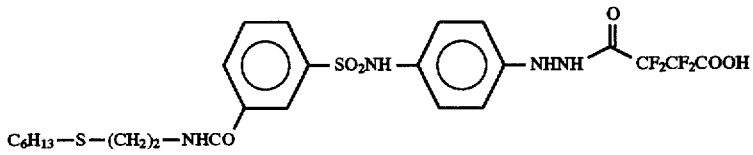
13
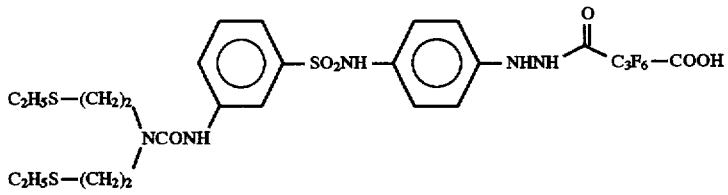
14
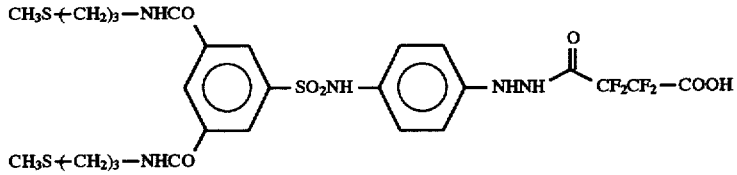
15
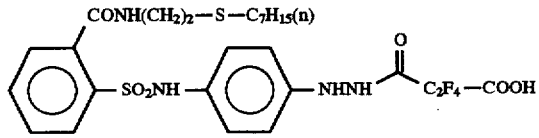
16
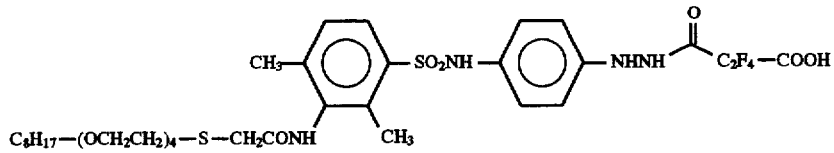
17
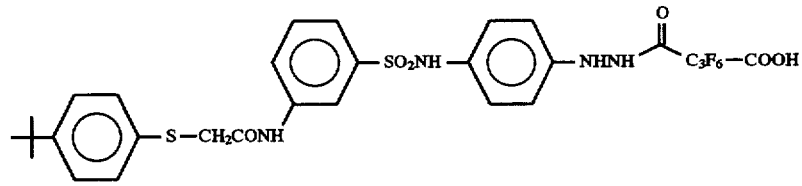
18
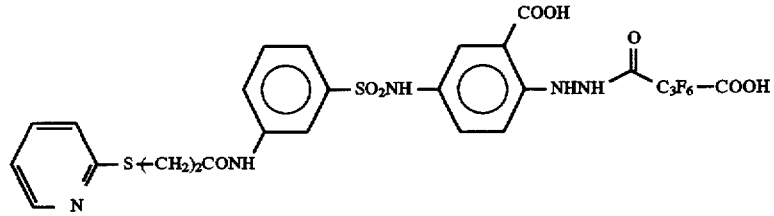

-continued
19
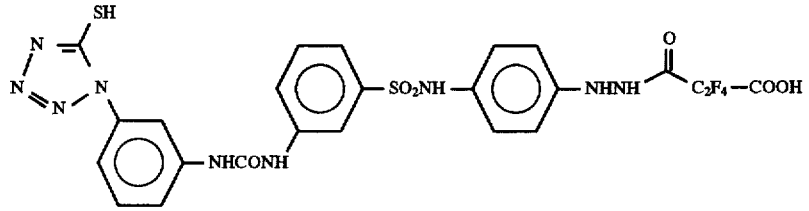
20
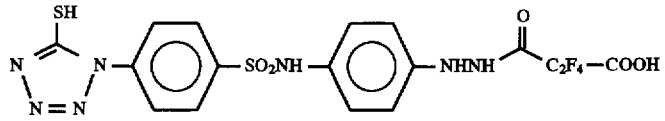
21
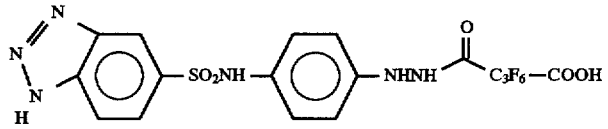
22
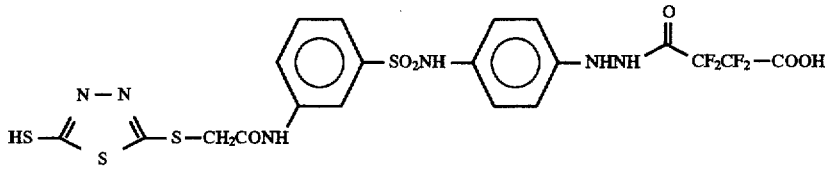
23
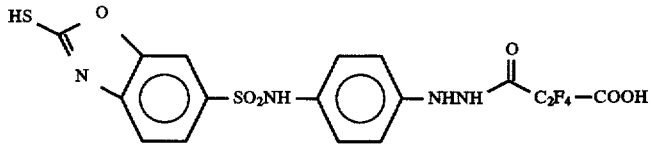
24
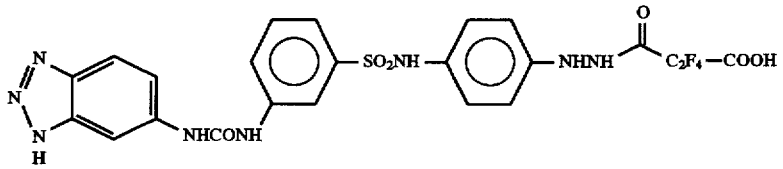
25
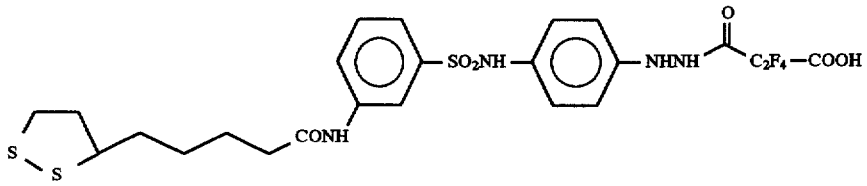
26
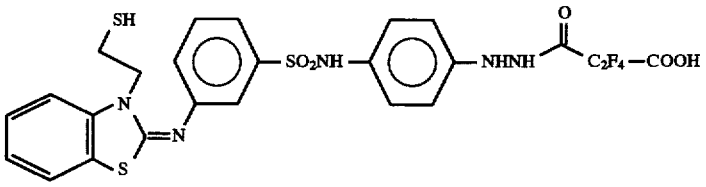
27
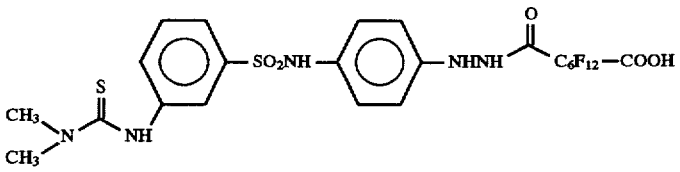

-continued
28
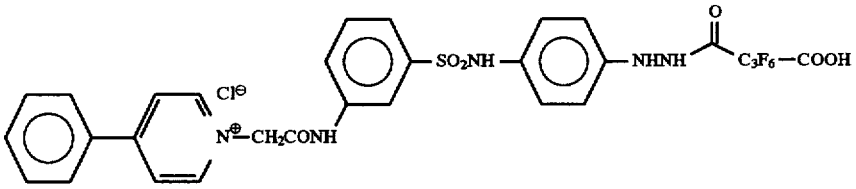
29
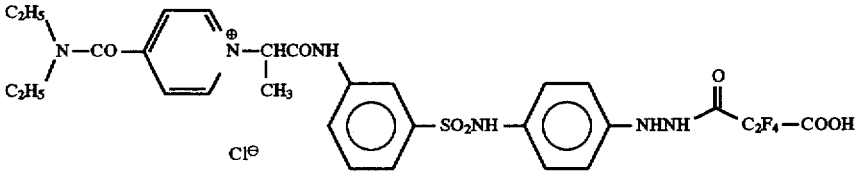
30
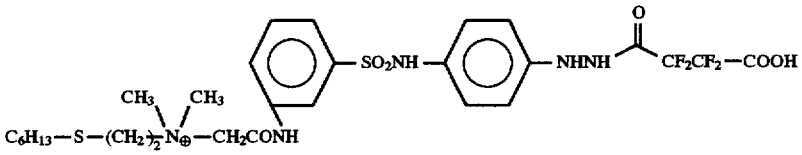
31
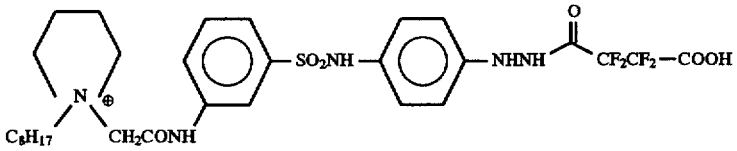
32
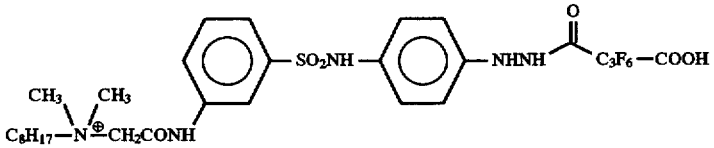
33
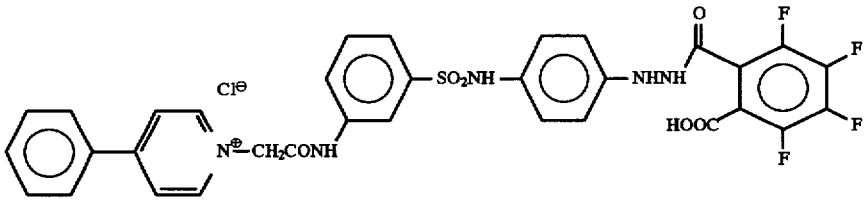
34
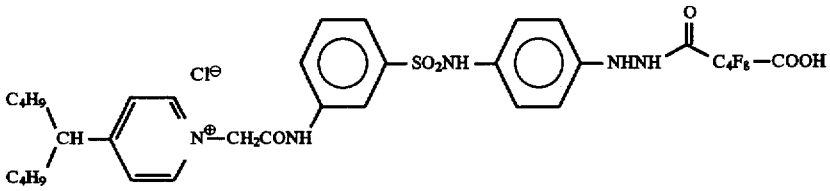
35
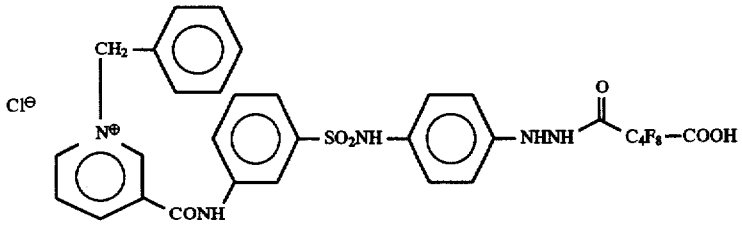

-continued
36
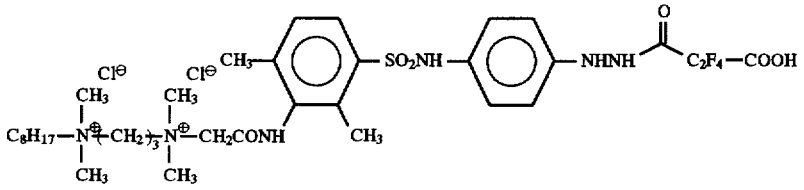
37
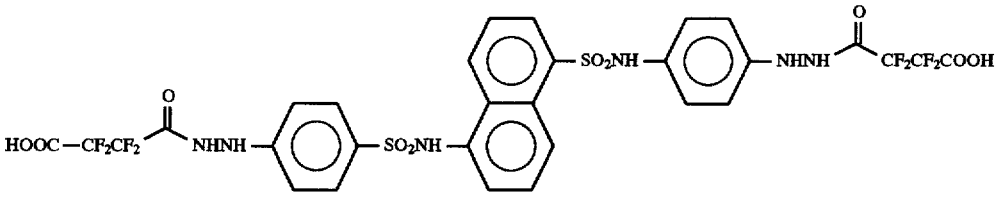
38
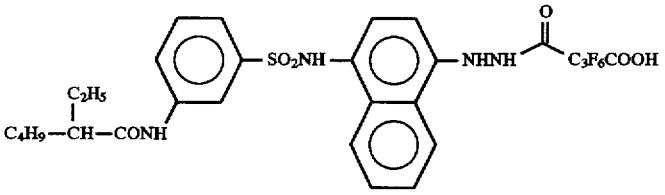
39
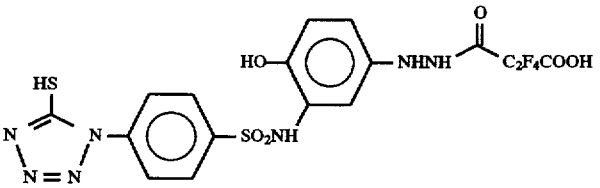
40
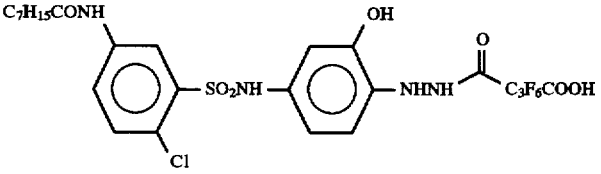
41
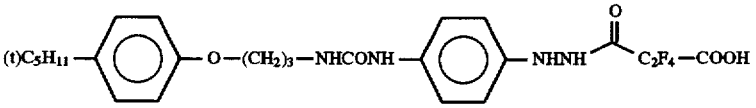
42
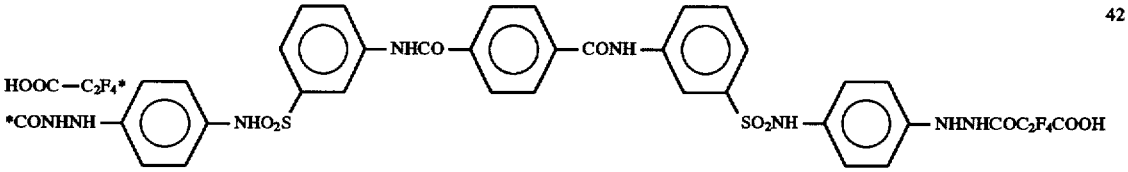
43
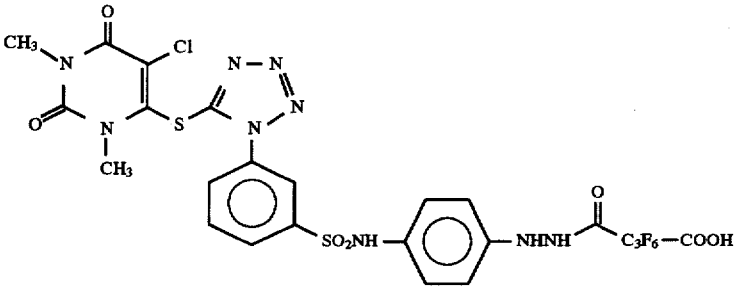

-continued
44
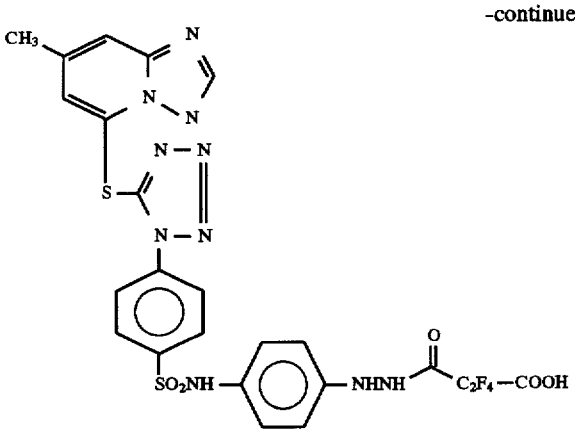
45
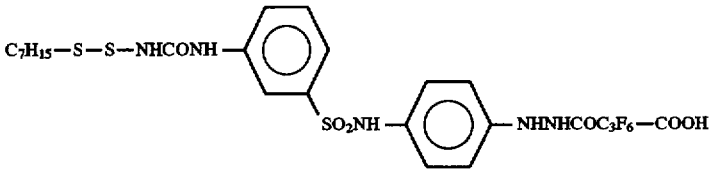
46
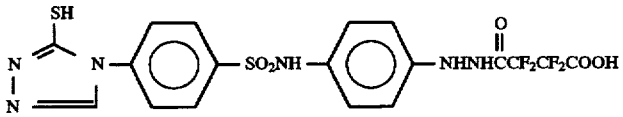
47
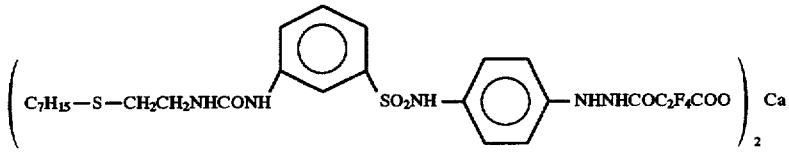
48
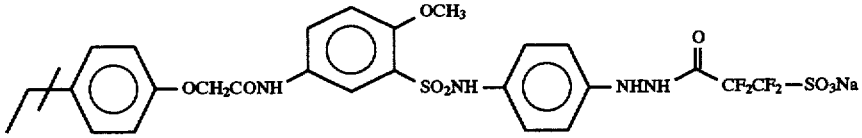
49
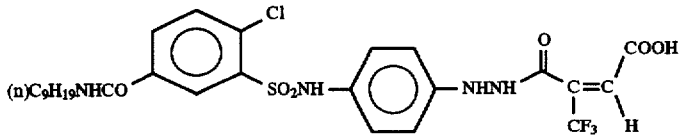
50
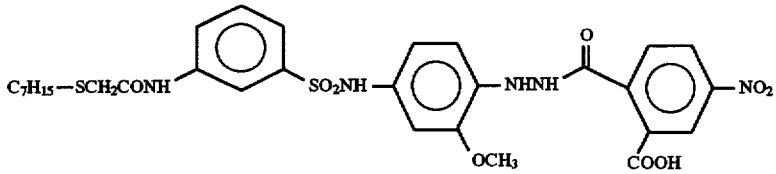
51
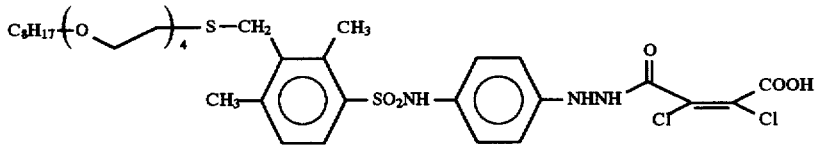
52
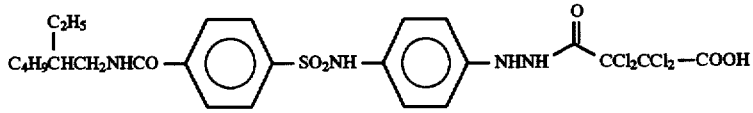

-continued

53

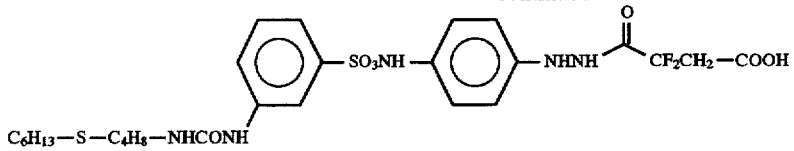

54

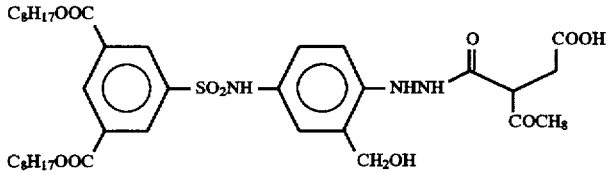

55

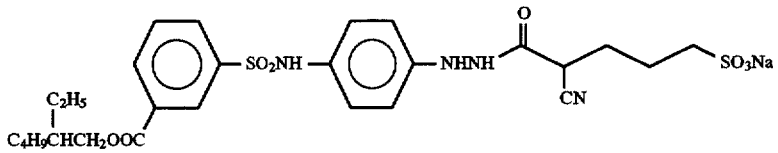

56

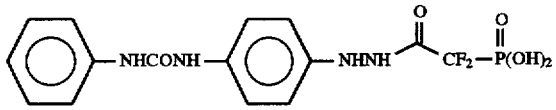

57

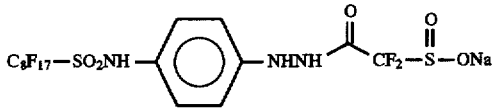

58

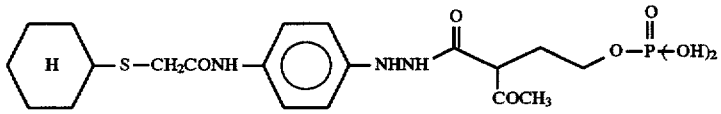

59

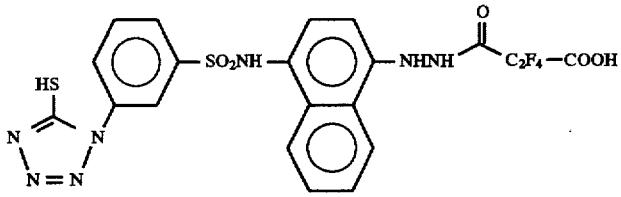

60

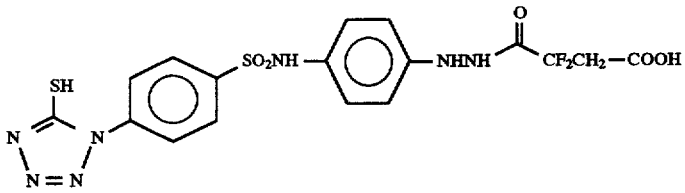

The compound for use in the present invention can be easily synthesized, as illustrated in the following synthesis scheme, by reacting a hydrazine derivative with the anhydride or chloride of a dicarboxylic acid substituted by an electron-attracting group or with a compound represented by formula (8), which is synthesized from the acid chloride.

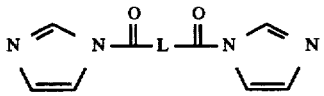

(8)

wherein L represents a fluorinated alkylene or phenylene group.

(Synthesis scheme)

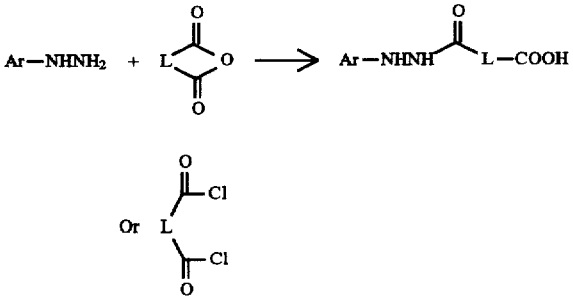

-continued

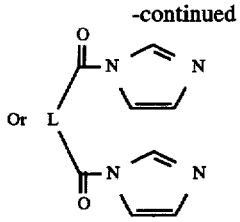

Synthesis Examples (Synthesis of Compound No. 1)

Compound No. 1 was synthesized according to scheme 2.

(Synthesis of Compound No. 1)

All the crude crystals of intermediate 4 were dissolved in a dimethylimidazolidinone/acetonitrile mixed solvent to give a solution (300 ml). Thereto was added dropwise 50 ml of an acetonitrile solution of 2.33 ml of tetrafluorosuccinic anhydride with cooling with ice. After an ordinary post-treatment was performed, the reaction product was purified by column chromatography to obtain 3.7 g of Compound No. 1 (yield through two steps, 23%; amorphous).

(Synthesis of Compound No. 2)

The same procedure as in the synthesis of Compound No. 1 was carried out, except that p-t-amylphenoxyacetyl chloride was used in place of decanoyl chloride. Thus, Compound No. 2 was synthesized.

(Synthesis of Compound No. 11)

Scheme 2:

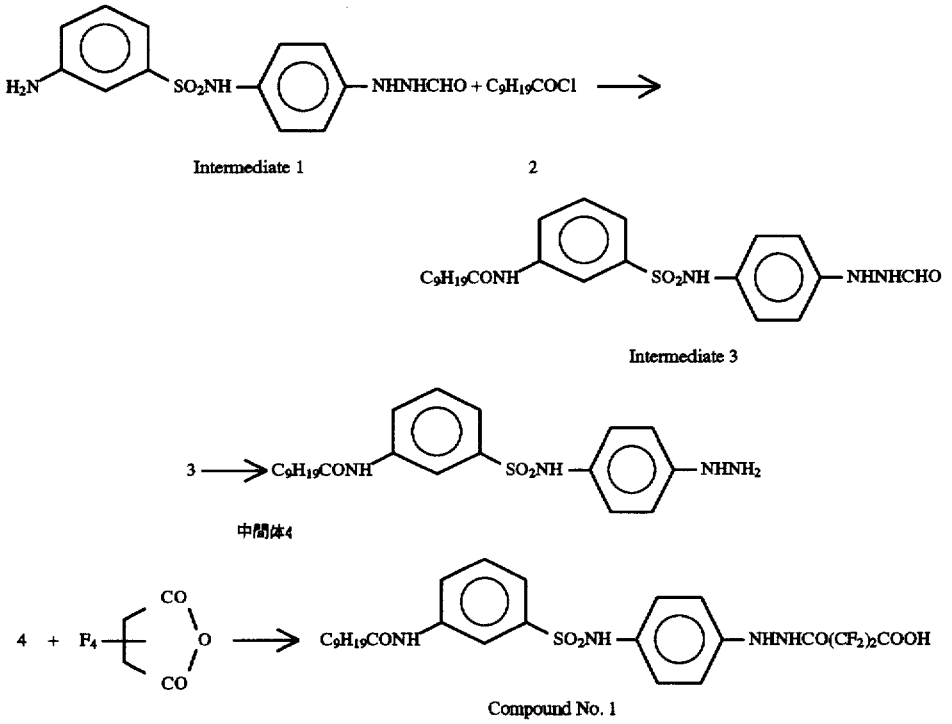

(Synthesis of Intermediate 1)

After reacting N-p-Nitrophenyl-N'-formylhydrazine with m-nitrobenzenesulfonyl chloride, the resulting N-m-nitrobenzenesulfonamidophenyl-N'-formylhydrazine was reduced with iron to produce intermediate 1.

(Synthesis of Intermediate 3)

To 100 ml of a solution of 10.0 g of intermediate 1 in an acetonitrile/dimethylacetamide mixed solvent was added dropwise 30 ml of an acetonitrile solution of 7.14 g of decanoyl chloride with cooling with ice. After an ordinary post-treatment, the reaction product was crystallized out from ethyl acetate to obtain 12.31 g of intermediate 3.

(Synthesis of Intermediate 4)

Three hundred milliliters of a methanol suspension of 12.30 g of intermediate 3 and 4.54 g of 1,5-naphthalenedisulfonic acid was stirred at 50° C. in a nitrogen atmosphere for 3 hours. Ethyl acetate and an aqueous sodium bicarbonate solution were added thereto to extract a reaction product. The extract was dried, and the ethyl acetate layer was then concentrated to obtain crude crystals (intermediate 4).

Intermediate 1, which was shown in scheme 2, was reacted with phenyl chlorocarbonate to incorporated phenylurethane into the intermediate. This reaction product was reacted with β-heptylmercaptoethylamine to produce intermediate 5.

Intermediate 5:

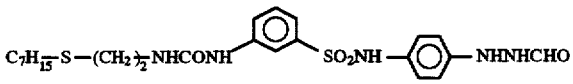

The same procedure as in the synthesis of Compound No. 1 was carried out, except that the thus-obtained intermediate 5 was used in place of intermediate 3, which was shown in scheme 2. Thus, Compound No. 11 (mp, 170°–175° C.) was synthesized.

(Synthesis of Compound No. 45)

The same procedure as in the synthesis of Compound No. 11 was carried out, except that hexafluoroglutaric anhydride was used in place of tetrafluorosuccinic anhydride. Thus, Compound No. 45 was synthesized.

(Synthesis of Compound No. 19)

Intermediate 1, which was shown in scheme 2, was reacted with phenyl chlorocarbonate to incorporate phenylurethane into the intermediate. This reaction product was reacted with 1-m-aminophenyl-5-mercaptotetrazole to produce intermediate 6.

Intermediate 6:

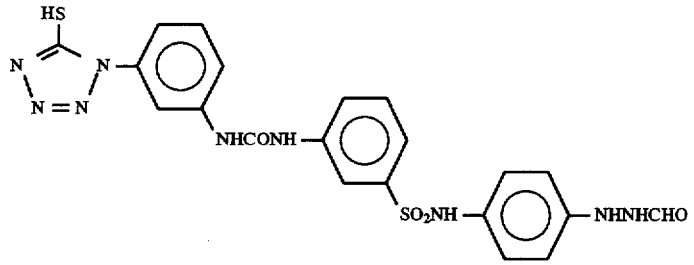

The subsequent procedure was carried out in substantially the same manner as in the synthesis of Compound No. 1, except that the thus-obtained intermediate 6 was used in place of intermediate 3, which was shown in scheme 2. Thus, Compound No. 19 was synthesized.

The compound for use in the present invention may have a bis-form structure made up of two radicals bonded together which each is formed by the removal of a hydrogen atom from a molecule represented by formula (1).

When X in formula (1) represents a nonionic group, the hydrazide compound represented by formula (1) functions as a hydrazine nucleating agent.

When X in formula (1) represents a nonionic group, the hydrazide compound represented by general formula (1) is preferably represented by the following formula (9):

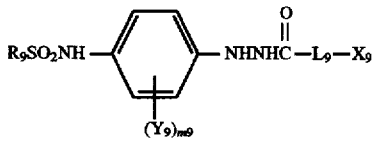

(9)

wherein $R_9$ represents an alkyl group, an aryl group, or a heterocyclic group; $Y_9$ represents a substituent of the benzene ring; $m_9$ is an integer of 0 to 4; and $L_9$ and $X_9$ have the same meanings as $L_1$ and X, respectively, in formula (1).

Examples of $R_9$ are given below. The alkyl group is a linear, branched, or cyclic alkyl group having from 1 to 16, preferably from 1 to 12 carbon atoms, and examples thereof include methyl, ethyl, propyl, isopropyl, t-butyl, allyl, propargyl, 2-butenyl, benzyl, cyclopentyl, and 2-acetamidoethyl. Examples of the aryl group include the same aryl groups enumerated hereinabove with regard to Ar in formula (1). The heterocyclic group is a five- or six-membered, saturated or unsaturated heterocyclic group having from 1 to 5 carbon atoms and containing one or more heteroatoms of one or more elements selected from oxygen, nitrogen, and sulfur, and examples thereof include 2-furyl, 2-thienyl, 2-pyrimidinyl, 2-benzotriazolyl, imidazolyl, and pyrazolyl. $R_9$ may be further substituted with any of the aforementioned substituents with which Ar may be substituted. Examples of $Y_9$ include the aforementioned substituents with which Ar in formula (1) may be substituted.

When the compound for use in the present invention is represented by formula (1) wherein X represents a nonionic group, specific examples of this compound, serving as a nucleating agent, are given below. However, the compound for use in this invention should not be construed as being limited thereto.

101.
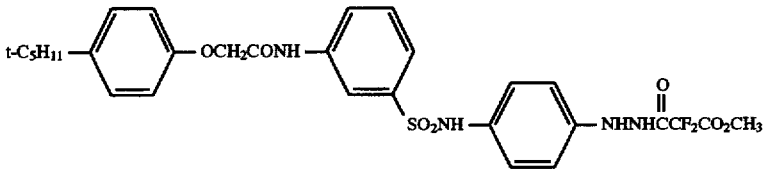
102.
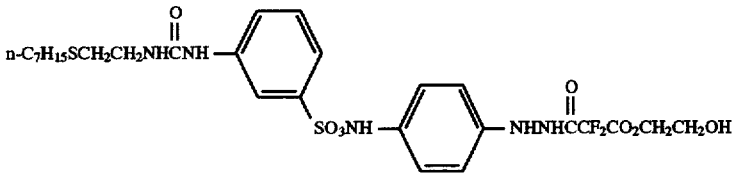
103.
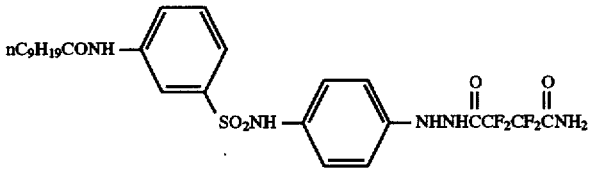
104.
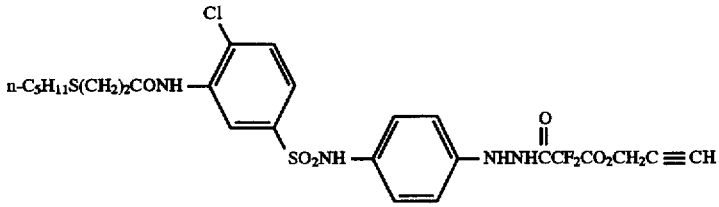
105.
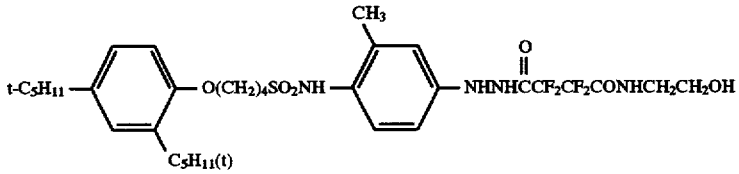
106.
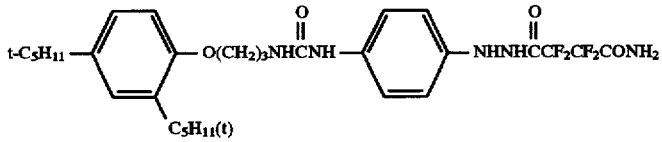
107.
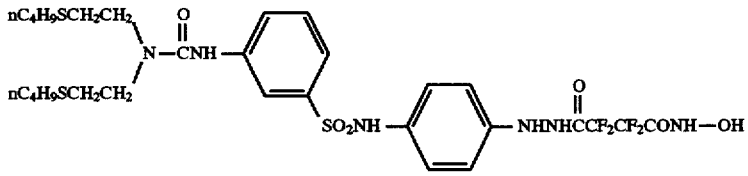
108.
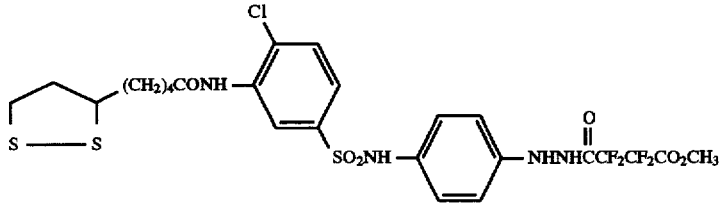

-continued
109.
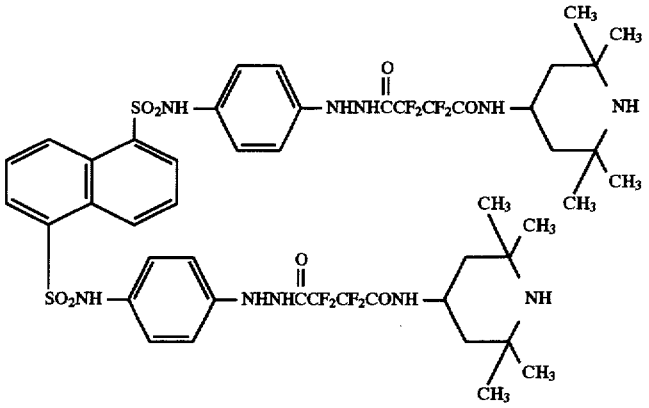
110.
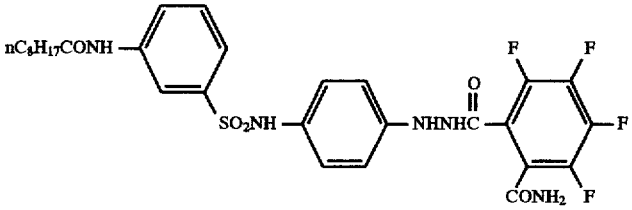
111.
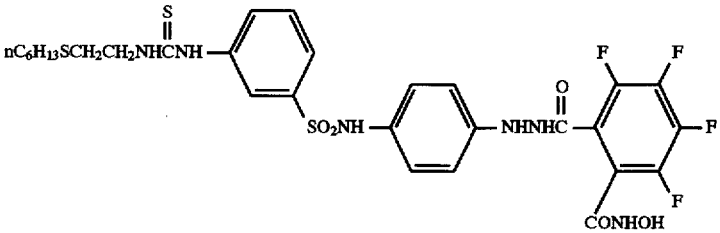
112.
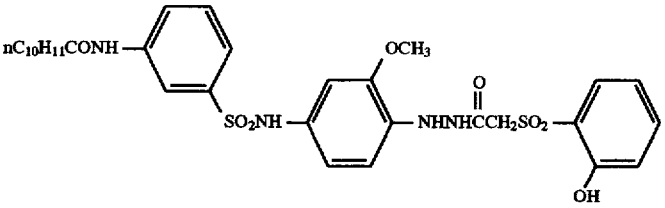
113.
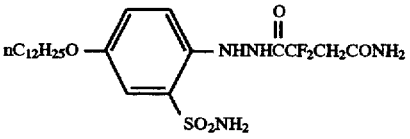
114.
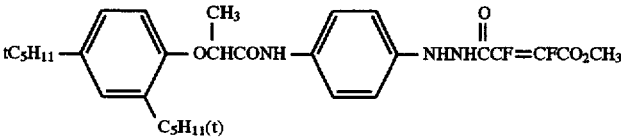
115.
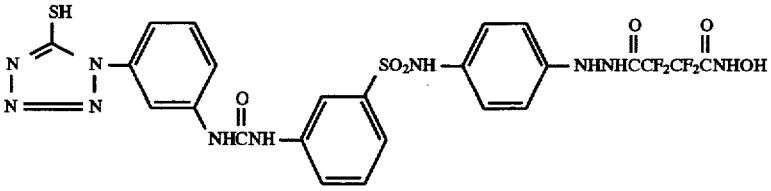

-continued
116.
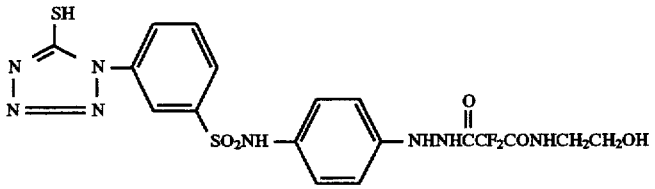
117.
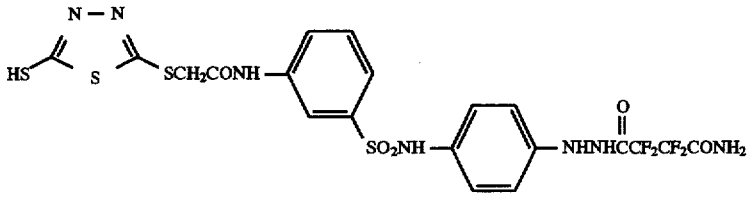
118.
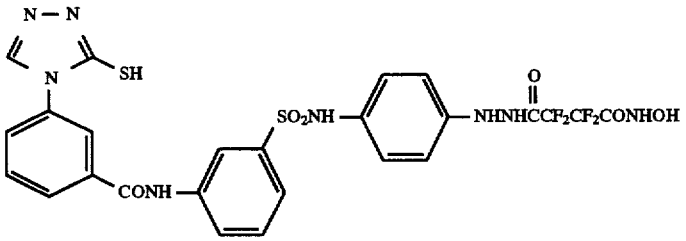
119.
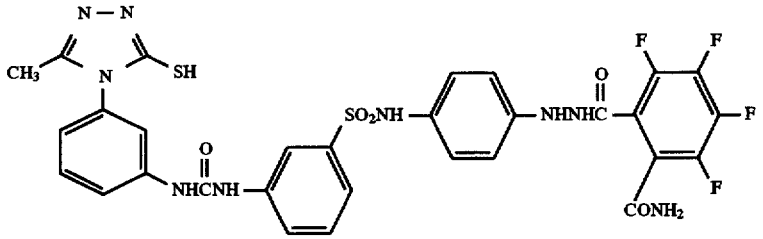
120.
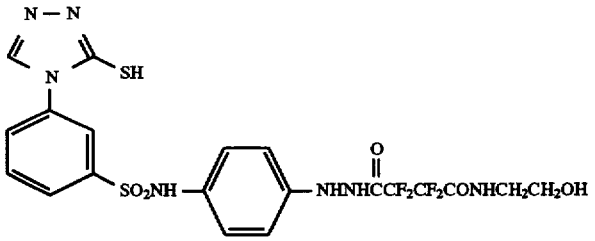
121.
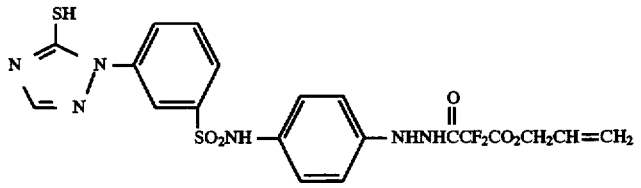
122.
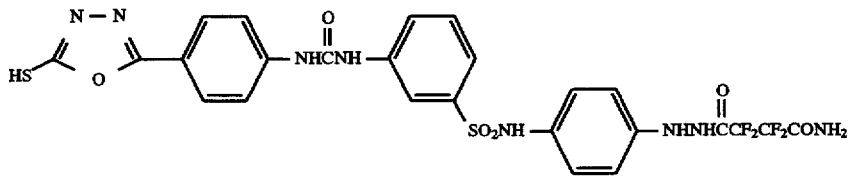

-continued

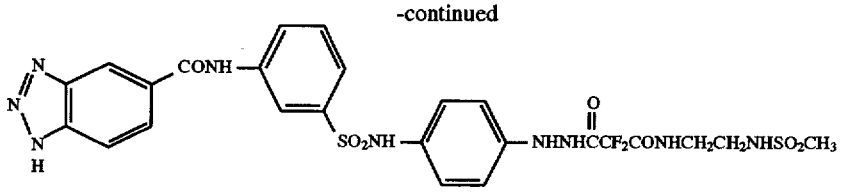

123.

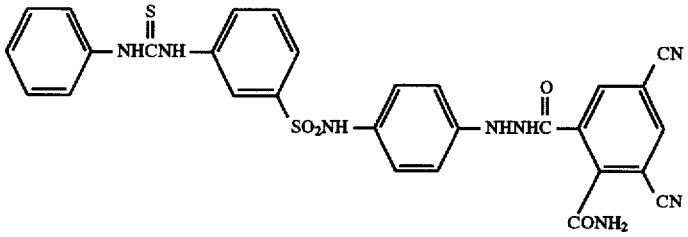

124.

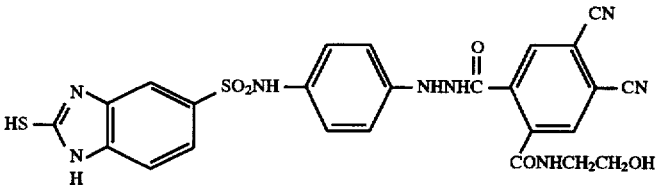

125.

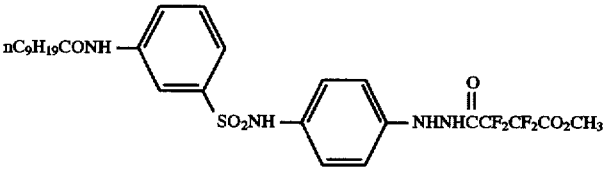

126.

The compound for use in the present invention can be synthesized by reacting a hydrazine derivative with a carbonyl chloride, carboxylic ester, or active carboxamide each having an electron-attracting group and a group capable of forming a hydrogen bond with a hydrazine hydrogen atom. Alternatively, the desired compound may be synthesized by reacting a mixture of a hydrazine derivative and a carboxylic acid having an electron-attracting group and a group capable of forming a hydrogen bond with a hydrazine hydrogen atom with any of various condensing agents (e.g., dicyclohexylcarbodiimide and chlorocarbonic esters).

These synthesis methods are explained below by reference to Synthesis Examples for synthesizing Compounds Nos. 126 and 103.

The desired compounds were produced according to the following synthesis scheme.

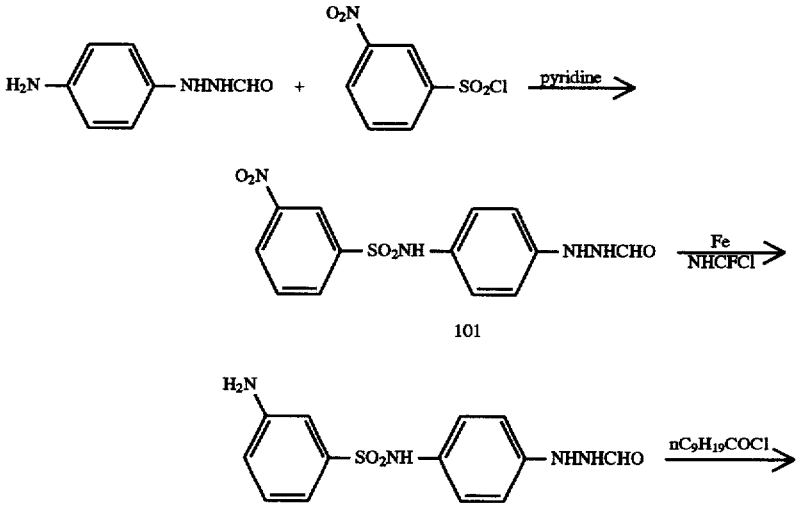

-continued

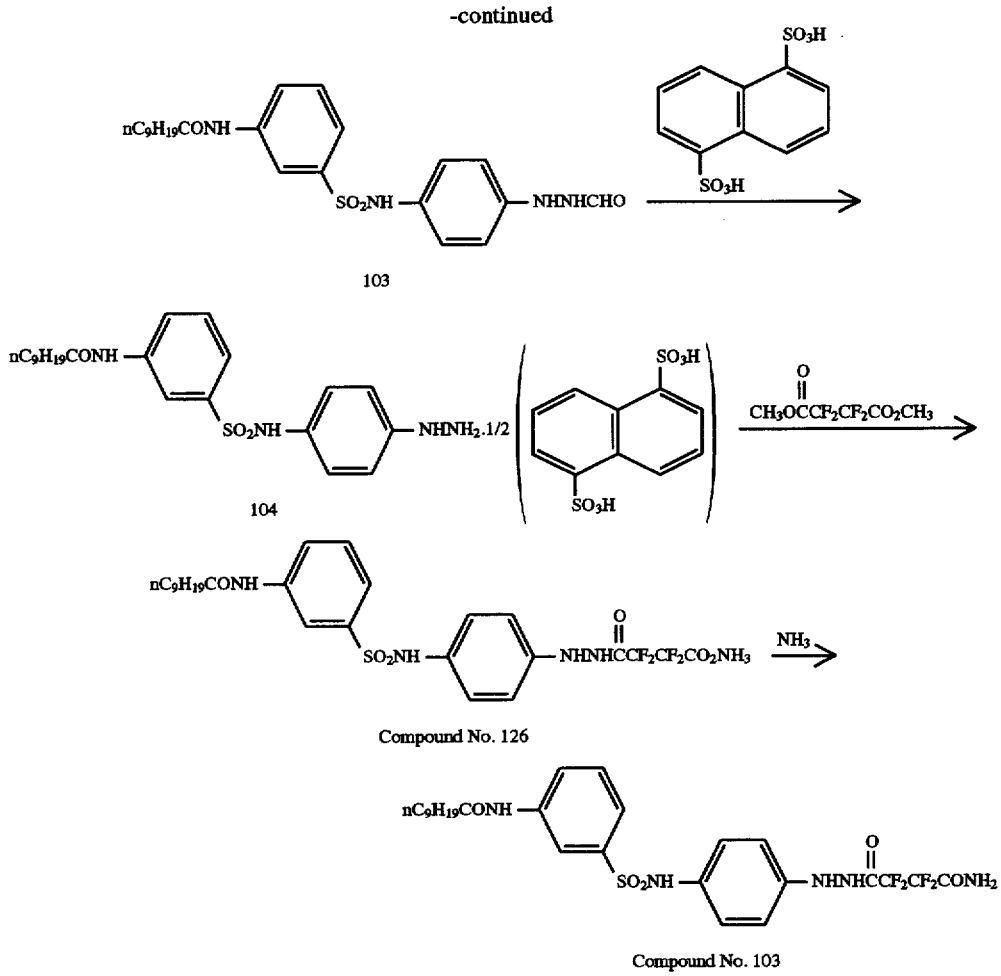

1. Synthesis of Intermediate 102

N-p-Aminophenyl-N'-formylhydrazine was reacted with m-nitrobenzenesulfonyl chloride. The resulting N-m-nitrobenzenesulfonamidophenyl-N'-formylhydrazine (intermediate 101) was reduced with iron to produce intermediate 102.

2. Synthesis of Intermediate 103

To 100 ml of a solution of 10.0 g of intermediate 102 in an acetonitrile/dimethylacetamide mixed solvent was added dropwise 30 ml of an acetonitrile solution of 7.14 g of decanoyl chloride with cooling with ice. After an ordinary post-treatment, the reaction product was crystallized out from ethyl acetate to obtain 12.31 g of intermediate 103.

3. Synthesis of Intermediate 104

Three hundred milliliters of a methanol suspension of 12.30 g of intermediate 103 and 4.54 g of 1,5-naphthalenedisulfonic acid was stirred at 50° C. in a nitrogen atmosphere for 3 hours. Ethyl acetate and an aqueous sodium bicarbonate solution were added thereto to extract a reaction product. The extract was dried, and the ethyl acetate layer was then concentrated to obtain crude crystals (intermediate 104).

4. Synthesis of Compound No. 126

All the crude crystals of intermediate 104 were dispersed into a mixture of 80 me of dimethylimidazolidinone and 200 ml of acetonitrile. Thereto were added 6.5 g of dimethyl tetrafluorosuccinate and 2.7 g of triethylamine in a nitrogen atmosphere. Reaction was conducted by heating the mixture first at 50° C. for 2 hours and then with refluxing for 3 hours. Ethyl acetate and water were added to the reaction mixture to extract a reaction product. The extract was washed with water, and the ethyl acetate layer was concentrated. The reaction product was purified by silica gel column chromatography (developing solvent: ethyl acetate/n-hexane=10/1 to 3/1) to obtain 12.5 g (76%) of the desired compound, which had a melting point of 121° C.

5. Synthesis of Compound No. 103

In 120 ml of a 5% methanol solution of ammonia was dissolved 10 g of Compound No. 126. Reaction was conducted at 40° C. for 3 hours in a nitrogen atmosphere. The reaction mixture was concentrated, and the reaction product was purified by silica gel column chromatography (developing solvent: ethyl acetate/n-hexane=5/1 to 3/1) to obtain 6.4 g (65%) of the desired compound, which had a melting point of 145° C.

The hydrazine compound represented by formula (1) may be used after being dissolved in an appropriate water-miscible solvent. Examples of the solvent include alcohols (e.g., methanol, ethanol, propanol, and fluorinated alcohols), ketones (e.g., acetone, methyl ethyl ketone), dimethylformamide, dimethyl sulfoxide, and methyl cellosolve.

It is also possible to use the hydrazine compound in the form of a dispersion, which can be prepared by the well known emulsification method in which the hydrazine compound is dissolved in a mixture of an oil, e.g., dibutyl phthalate, tricresyl phosphate, glyceryl triacetate, or diethyl phthalate, and a co-solvent, e.g., ethyl acetate or cyclohexanone, and the solution is mechanically emulsified. Alternatively, the nucleating agent may be used as a suspension prepared by a known solid-dispersing technique in which a powder of the hydrazine derivative is dispersed into water by means of a ball mill, colloid mill, or ultrasonic wave.

The hydrazine compound represented by formula (1) may be incorporated into either a silver halide emulsion layer or any other hydrophilic colloid layer on the same side of the support as the silver halide emulsion layer. It is, however, preferred to incorporate the nucleating agent into the silver halide emulsion layer or a hydrophilic colloid layer(s) adjacent thereto.

The incorporation amount of the hydrazine compound represented by formula (1) is preferably from $1\times10^{-6}$ to $1\times10^{-2}$ mol, more preferably from $1\times10^{-5}$ to $5\times10^{-3}$ mol, and most preferably from $5\times10^{-5}$ to $1\times10^{-3}$ mol, per mol of the silver halide.

A known nucleating accelerator may be used in the present invention in combination with the nucleating agent. Examples of the nucleating accelerator include amine compounds, hydrazine compounds, quaternary onium salt compounds, and carbinol compounds. Specific examples of these nucleating accelerators are given in JP-A-4-56749, JP-A-63-124045, and JP-A-62-187340.

The nucleating accelerator for use in the present invention is preferably represented by the following formula (I), (II), (III) and (IV):

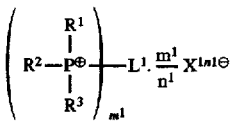

(I)

wherein $R^1$, $R^2$ and $R^3$ each represents an alkyl group, a cycloalkyl group, an aryl group, an alkenyl group, a cycloalkenyl group or a heterocyclic group, which each may be substituted; $m^1$ represents an integer of from 1 to 4; $L^1$ represents an $m^1$-valent organic group which bonds to the P atom in formula (I) via its carbon atom; $n^1$ is an integer of 1 to 3; and $X^1$ represents an $n^1$-valent anion and $X^1$ may be connected to $L^1$;

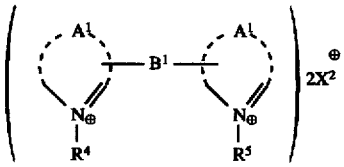

(II)

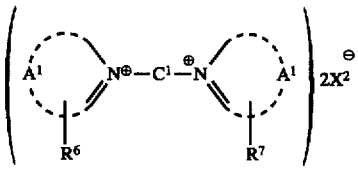

(III)

wherein $A^1$ represents an organic group necessary for forming a heterocyclic ring; $B^1$ and $C^1$ each represents a divalent group; $R^4$ and $R^5$ each represents an alkyl group or an aryl group, which each may be substituted; $R^6$ and $R^7$ each represents a hydrogen atom or a substituent; and $X^2$ represents an anion, with the proviso that, if an intermolecular salt is formed, $X^2$ does not exist;

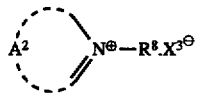

(IV)

wherein $A^2$ represents an atomic group necessary for forming a nitrogen-containing heteroaromatic ring; $R^8$ represents an alkyl group; and $X^{3-}$ represents a counter anion.

The compound represented by formula (I) will now be described in detail.

$R^1$, $R^2$ and $R^3$ each represents an alkyl group, a cycloalkyl group, an aryl group, an alkenyl group, a cycloalkenyl group or a heterocyclic group, which each may be substituted with one or more substituents.

$m^1$ is an integer of 1 to 4; $L^1$ represents an $m^1$-valent organic group which bonds to the P atom in formula (I) via its carbon atom; $n^1$ represents an integer of 1 to 3; and $X^1$ represents an $n^1$-valent anion and may be connected to $L^1$.

Examples of the groups represented by $R^1$, $R^2$ and $R^3$ include a straight-chain or branched alkyl group (e.g., methyl, ethyl, propyl, isopropyl, butyl, isobutyl, sec-butyl, tert-butyl, octyl, 2-ethylhexyl, dodecyl, hexadecyl, octadecyl), aralkyl group (e.g., substituted or unsubstituted benzyl), cycloalkyl group (e.g., cyclopropyl, cyclopentyl, cyclohexyl), aryl group (e.g., phenyl, naphthyl, phenantollyl), alkenyl group (e.g., allyl, vinyl, 5-hexenyl), cycloalkenyl group (e.g., cyclopentenyl, cyclohexenyl), and heterocyclic group (e.g., pyridyl, quinolyl, furyl, imidazolyl, thiazolyl, thiadiazolyl, benzotriazolyl, benzothiazolyl, morpholyl, pyrimidyl, pyrrolidnyl). These substituents may be further substituted with one or more substituents. Examples thereof include, in addition to the groups represented by $R^1$, $R^2$ and $R^3$, a halogen atom (e.g., fluorine, chlorine, bromine, iodine), a nitro group, primary, secondary or tertiary amino group, alkylether group, arylether group, alkylthioether group, arylthioether group, carbonamido group, carbamoyl group, sulfonamido group, sulfamoyl group, hydroxyl group, sulfoxy group, sulfonyl group, carboxyl group, sulfonic acid group, cyano group or carbonyl group. Examples of the group represented by $L^1$ include, in addition to the groups represented by $R^1$, $R^2$ and $R^3$, a polymethylene group (e.g., trimethylene, tetramethylene, hexamethylene, pentamethylene, octamethylene, dodecamethylene), divalent aromatic group (e.g., phenylene, biphenylene, naphtylene), polyvalent aliphatic group (e.g., trimethylenemethyl, tetramethylenemethyl), and polyvalent aromatic group (e.g., phenylene-1,3,5-toluyl, phenylene-1,2,4,5-tetrayl).

Examples of the anion represented by $X^1$ include a halogen ion (e.g., chlorine ion, bromine ion, iodine ion), carboxylate ion (e.g., acetate ion, oxalate ion, fumarate ion, benzoate ion), sulfonate ion (e.g., p-toluene sulfonate ion, methane sulfonate ion, butane sulfonate ion, benzene sulfonate ion), sulfuric acid ion, perchloric acid ion, carboxylic acid ion, and nitric acid ion.

In formula (I), $R^1$, $R^2$ and $R^3$ are each preferably a group having from 1 to 20 carbon atoms, and particularly preferably an aryl group having from 6 to 15 carbon atoms. $m^1$ is preferably 1 or 2, and when $m^1$ is 1, $L^1$ is preferably a group having from 1 to 20 carbon atoms, and particularly preferably an alkyl or aryl group having from 1 to 15 total carbon atoms. When $m^1$ is 2, the divalent organic group represented by $L^1$ is preferably an alkylene group, an arylene group, or a divalent group formed by bonding these groups, as well as a divalent group formed by bonding these groups in combination with a group such as —CO—, —O—, —$NR^9$— (wherein $R^9$ represents a hydrogen atom, or one of the groups represented by $R^1$, $R^2$ and $R^3$, when the $R^9$ groups exist plurally, they may be the same or different and may be combined with each other), —S—, —SO—, and —$SO_2$—. When $m^1$ is 2, $L^1$ is particularly preferably a divalent group having from 1 to 20 total carbon atoms which bonds to the P atom via the carbon atom of $L^1$. When $m^1$ is an integer of 2 or more, the plurality of $R^1$, $R^2$ and $R^3$ in the molecule may be the same or different.

$n^1$ is preferably 1 or 2, and $m^1$ is preferably 1 or 2. $X^1$ may be bonded to $R^1$, $R^2$, $R^3$ or $L^1$ to form an intermolecular salt.

Many of the compounds represented by formula (I) are known, and some of them are commercially available. The general processes for production include a process in which a phosphinic acid is reacted with an alkylating agent such as alkyl halide or sulfonate; or a pair anion of phosphonium salt is ion-exchanged according to a usual process.

Specific examples of the compounds represented by formula (I) are described below, but the present invention should not be restricted thereto:

A-101

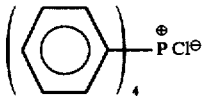

A-102

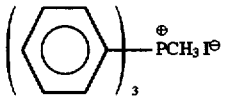

A-103

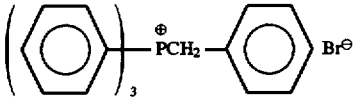

A-104

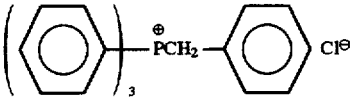

A-105

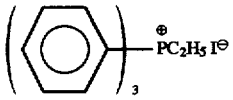

A-106

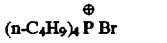

A-107

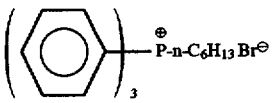

A-108

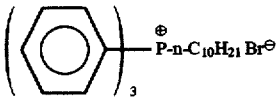

A-109

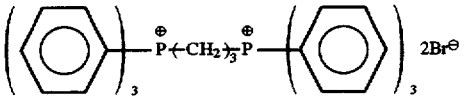

A-110

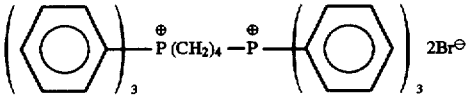

A-111

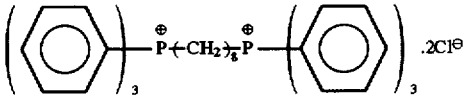

A-112

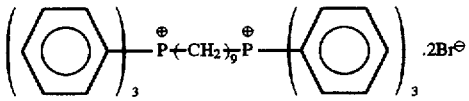

A-113

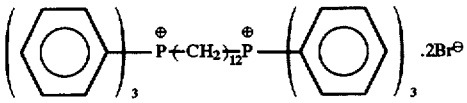

A-114

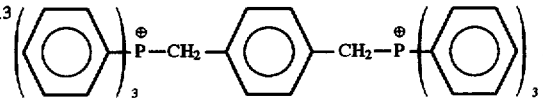

A-115

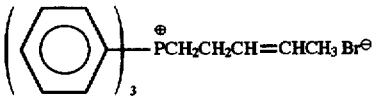

A-116

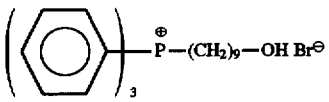

A-117

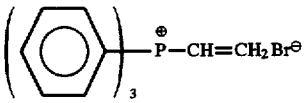

A-118

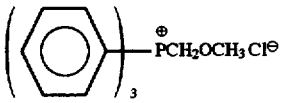

A-119

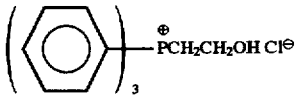

A-120

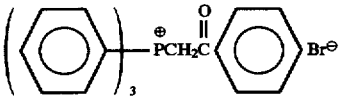

A-121

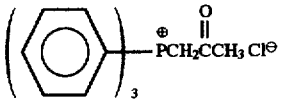

A-122

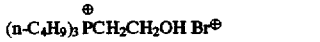

A-123

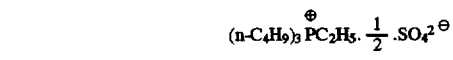

A-124

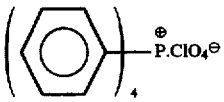

-continued
A-125
$Ph_3\overset{\oplus}{P}-(CH_2)_4COOH\ Br^{\ominus}$
A-126
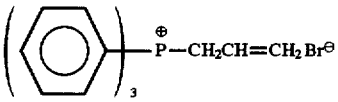
A-127
$(n\text{-}C_4H_9)_3\overset{\oplus}{P}\text{-}n\text{-}C_{16}H_{33}\ Br^{\ominus}$
A-128
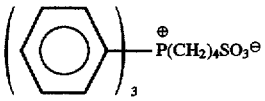
A-129
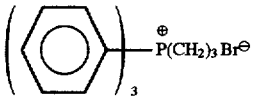
A-130
$(n\text{-}C_4H_9)_3\overset{\oplus}{P}CH_2CH_2OH.CH_3-C_6H_4-SO_3^{\ominus}$
A-131
$(n\text{-}C_4H_9)_3\overset{\oplus}{P}CH_3I^{\ominus}$
A-132
$(HOCH_2)_3\overset{\oplus}{P}CH_3I^{\ominus}$
A-133
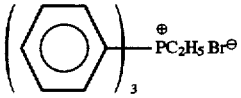
A-134
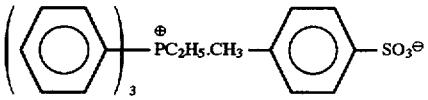
A-135
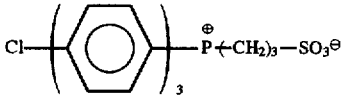
A-136
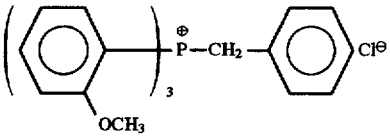
A-137
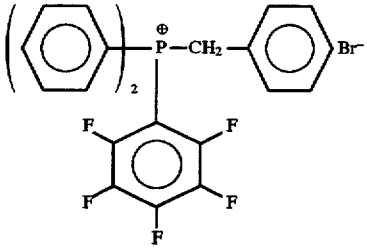
A-138
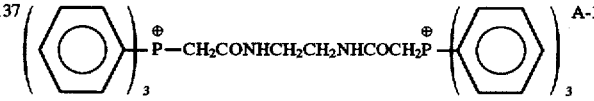
2Cl⁻
A-139
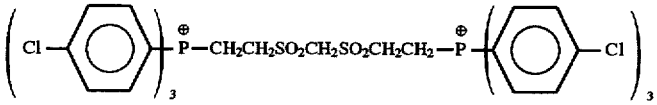
2BF₄⁻
A-140
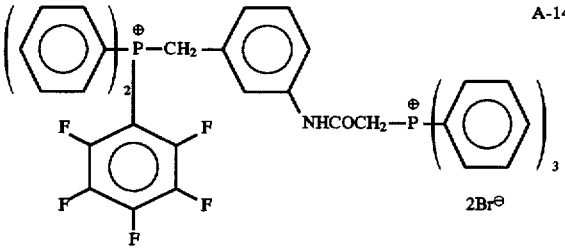
A-141
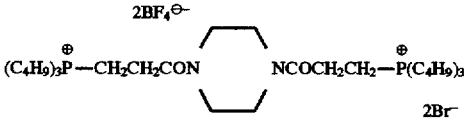
2Br⁻
A-142
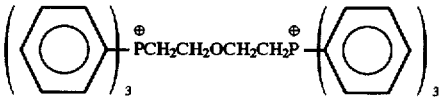
2Cl⁻
A-143
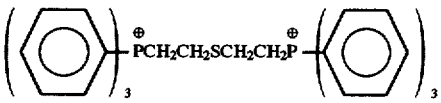
2Br⁻
A-144
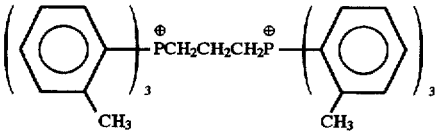
2Br⁻
A-145
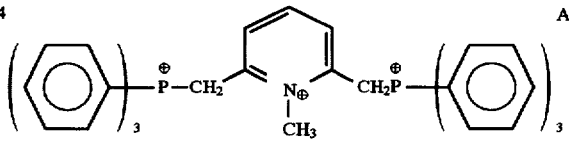
$3CF_3SO_3^{\ominus}$ -continued

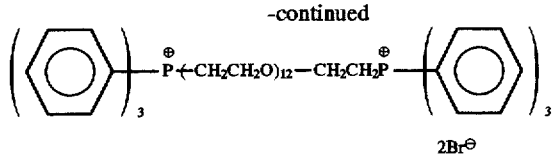

A-146

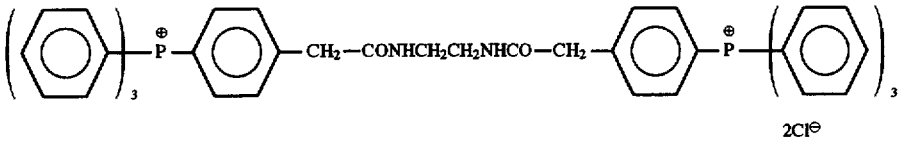

A-147

The compounds represented by formulae (II) and (III) will now be described in detail.

In formulae (II) and (III), $A^1$ represents an organic group necessary for forming a heterocyclic ring, and may contain a carbon atom, hydrogen atom, oxygen atom, nitrogen atom, or sulfur atom. The heterocyclic group formed by $A^1$ may be condensed with a benzene ring. $A^1$ preferably forms a 5- or 6-membered ring, and more preferably a pyridine ring.

The divalent group represented by $B^1$ or $C^1$ is preferably an alkylene group, an arylene group, an alkenylene group, $—SO_2—$, —SO—, —O—, —S—, and $—N(R^{10})—$, and combinations thereof. $R^{10}$ represents an alkyl group, an aryl group, or a hydrogen atom. B and C are each particularly preferably an alkylene group, an arylene group, —O— and —S—, and combinations thereof.

$R^4$ and $R^5$ are each preferably an alkyl group having from 1 to 20 carbon atoms, which may be the same or different. The alkyl group may be substituted with one or more substituents. Examples of the substituents include a halogen atom (e.g., chlorine, bromine), a substituted or unsubstituted alkyl group (e.g., methyl, hydroxyethyl), substituted or unsubstituted aryl group (e.g., phenyl, tolyl, p-chlorophenyl), substituted or unsubstituted acyl group (e.g., benzoyl, p-bromobenzoyl, acetyl), sulfo group, carboxyl group, hydroxyl group, alkoxy group (e.g., methoxy, ethoxy), aryloxy group, amido group, sulfamoyl group, carbamoyl group, ureido group, unsubstituted or alkyl-substituted amino group, cyano group, nitro group, alkylthio group, and arylthio group. $R^4$ and $R^5$ are each preferably an alkyl group having from 1 to 10 carbon atoms. Preferable examples of the substituents include an aryl group, sulfo group, carboxyl group and hydroxyl group.

$R^6$ and $R^7$ each represents a hydrogen atom or a substituent. Examples of the substituent are selected from the substituents exemplified as the substituents of alkyl groups represented by $R^4$ and $R^5$. $R^6$ and $R^7$ are each preferably a substituent having from 0 to 10 carbon atoms, and more specifically an aryl-substituted alkyl group or a substituted or unsubstituted aryl group.

$X^2$ represents an anion, but if an intermolecular salt is formed, $X^2$ does not exist. Examples of $X^2$ include a chlorine ion, bromine ion, iodine ion, nitric acid ion, sulfuric acid ion, p-toluenesulfonic acid ion, and oxalate ion.

Specific examples will now be described below, but the present invention is not restricted thereto. The compounds according to the present invention can easily be synthesized by the process known (*Quart. Rev.* 16, 163 (1962)).

Specific examples of the compounds represented by formulae (II) and (III) will now be described, but the present invention should not be restricted thereto.

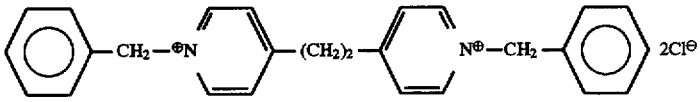

A-201

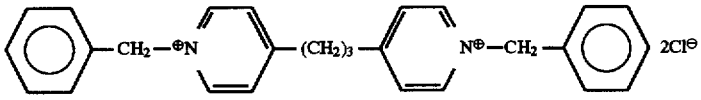

A-202

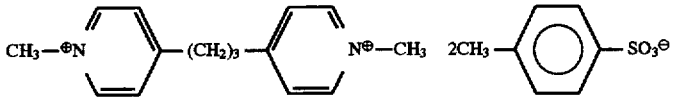

A-203

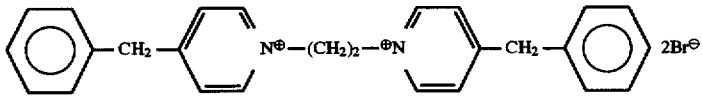

A-204

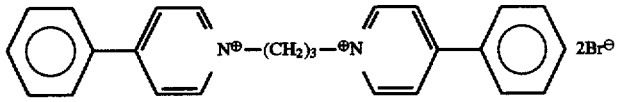

A-205

-continued
A-206
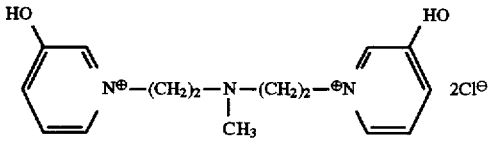
A-207
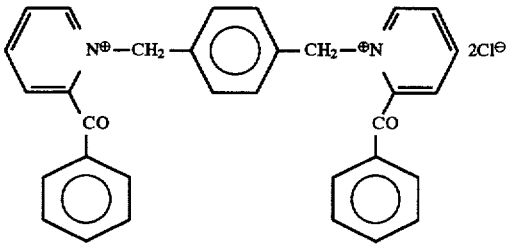
A-208
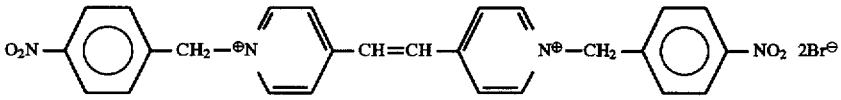
A-209
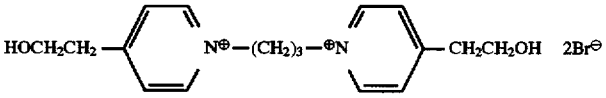
A-210
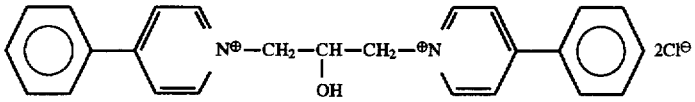
A-211
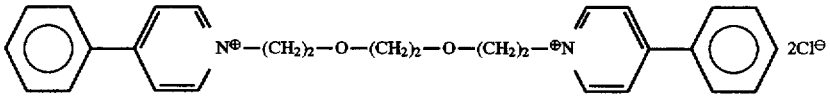
A-212
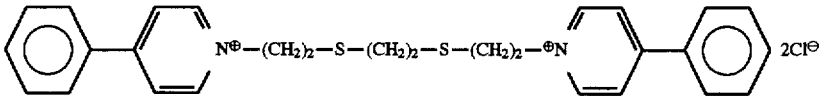
A-213
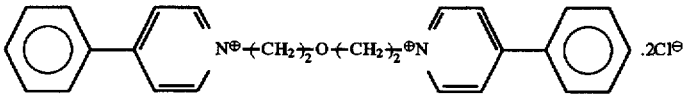
A-214
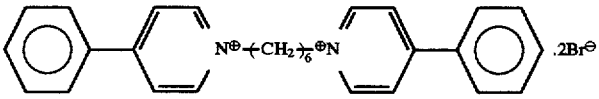
A-215
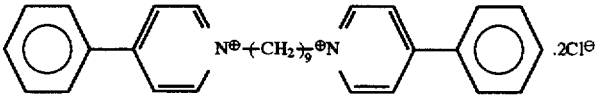
A-216
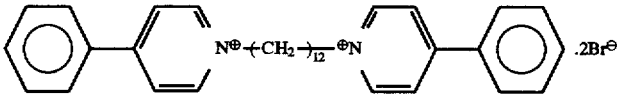
A-217
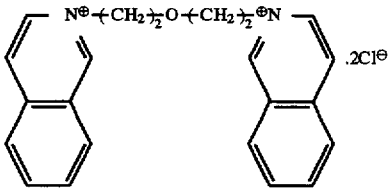

-continued
A-218
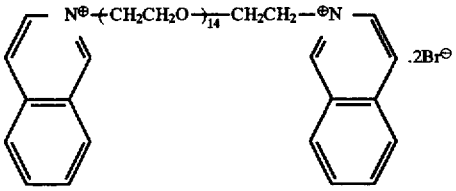
A-219
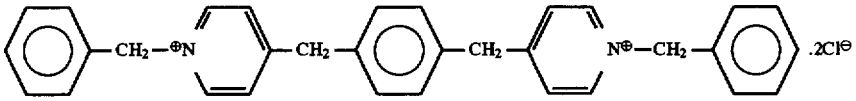
A-220
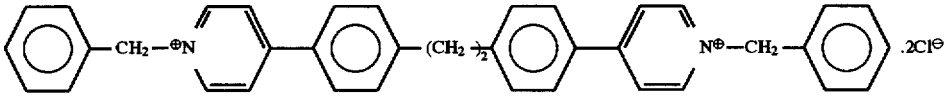
A-221
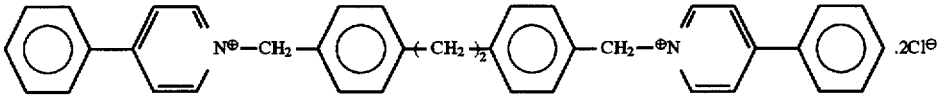
A-222
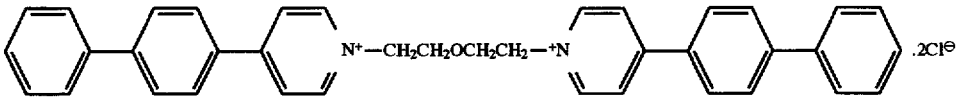
A-223
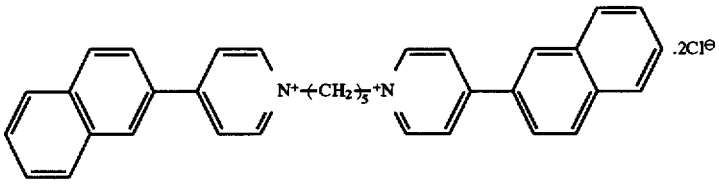
A-224
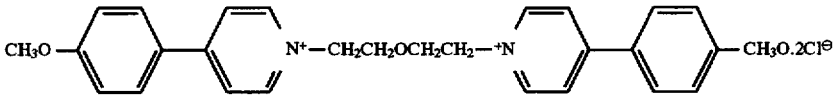
A-225
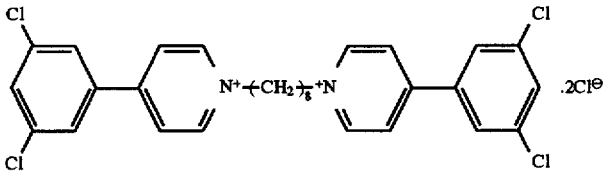
A-226
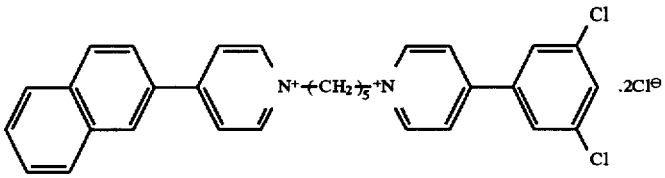
A-227
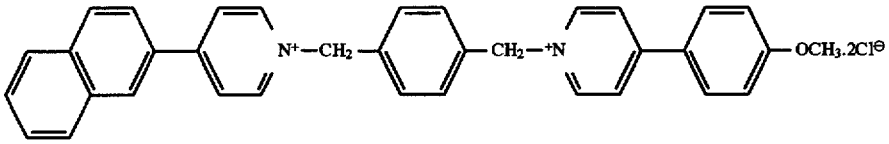
A-228
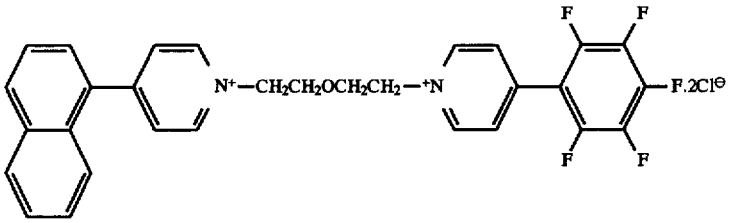

-continued

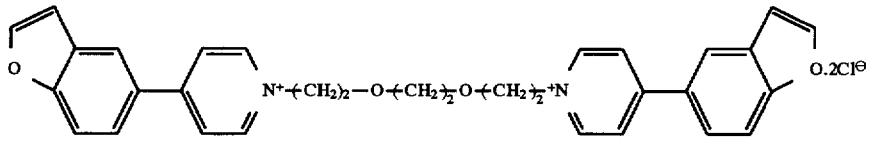

A-229

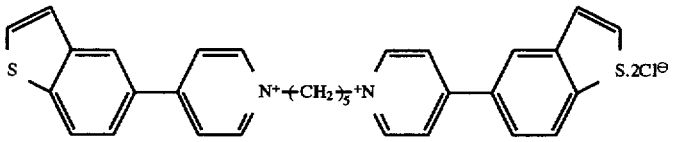

A-230

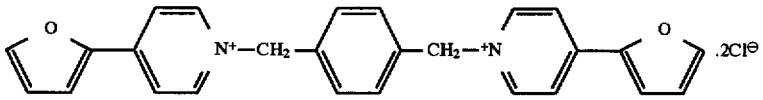

A-231

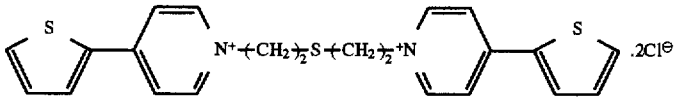

A-232

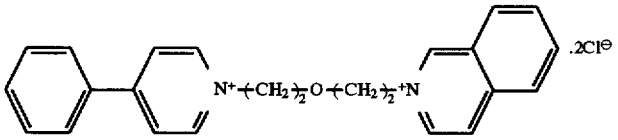

A-233

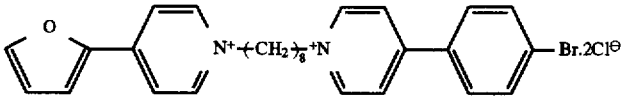

A-234

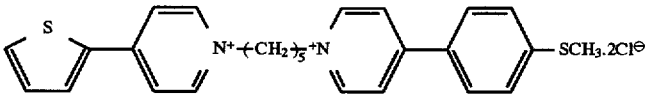

A-235

The compound represented by formula (IV) will now be described in detail.

The nitrogen-containing heterocyclic aromatic ring represented by $Z^3$ may contain a carbon atom, a hydrogen atom, an oxygen atom or a sulfur atom in addition to the nitrogen atom, and a benzene ring may be further condensed therewith. The heterocyclic ring formed is preferably a 5- or 6-membered ring, more preferably a pyridine ring, a quinoline ring, or an isoquinoline ring.

$R^8$ is preferably an alkyl group having from 1 to 20 carbon atoms, and may be a straight-chain, branched, or cyclic alkyl group. The alkyl group has more preferably from 1 to 12 carbon atoms, particularly preferably from 1 to 8, carbon atoms.

$X^{3-}$ represents an anion, but $X^{3-}$ does not exist if a intermolecular salt is formed. Examples of $X^{3-}$ include a chlorine ion, bromine ion, iodine ion, nitric acid ion, sulfuric acid ion, p-toluenesulfonic acid ion, and oxalate ion.

The groups represented by $Z^3$ and $R^8$ may be substituted with one or more substituents. Examples of preferable substituents include a halogen atom (e.g., chlorine, bromine), a substituted or unsubstituted aryl group (e.g., phenyl, tolyl, p-chlorophenyl), substituted or unsubstituted acyl group (e.g., benzoyl, p-bromobenzoyl, acetyl), sulfo group, carboxyl group, hydroxyl group, alkoxy group (e.g., methoxy, ethoxy), aryloxy group, amido group, sulfamoyl group, carbamoyl group, ureido group, unsubstituted or alkyl-substituted amino group, cyano group, nitro group, alkylthio group, and arylthio group. The substituents are more preferably an aryl group, a sulfo group, a carboxyl group or a hydroxyl group.

In addition, preferable examples of the substituents on $Z^3$ include a substituted or unsubstituted alkyl group (e.g., methyl, hydroxyethyl) and substituted or unsubstituted aralkyl group (e.g., benzyl, p-methoxyphenethyl) are also preferred.

Specific examples will now be described below, but the present invention is not restricted thereto. The compounds according to the present invention can easily be synthesized by the process known (*Quart. Rev.* 16, 163 (1962)).

Specific examples of the compounds represented by formula (IV) will now be described, but the present invention should not be restricted thereto.

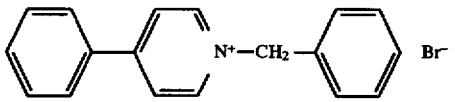

A-236

-continued
A-237
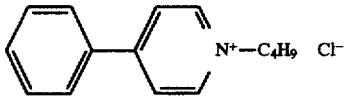
A-238
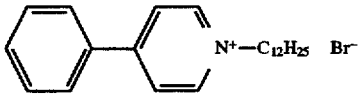
A-239
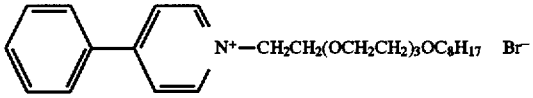
A-240
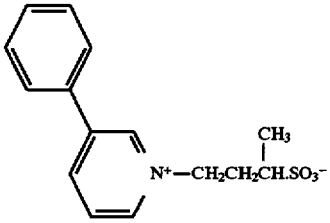
A-241
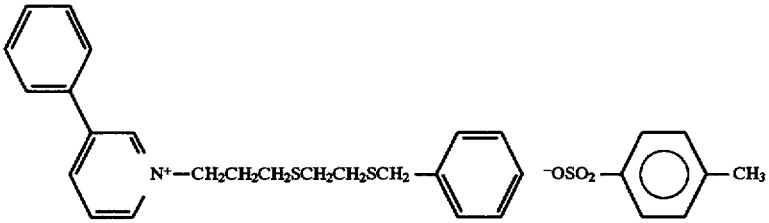
A-242
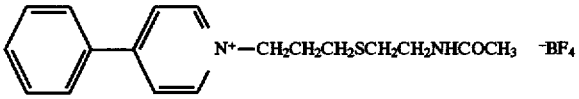
A-243
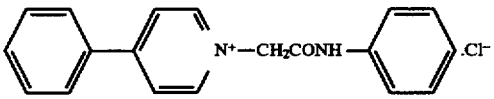
A-244
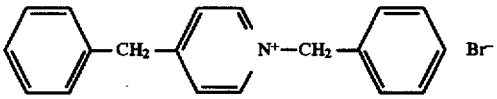
A-245
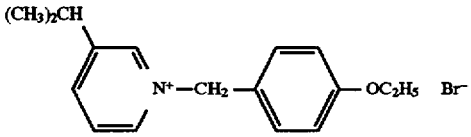
A-246
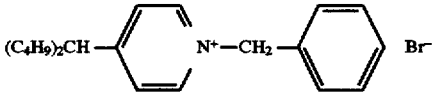
A-247
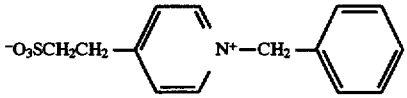
A-248
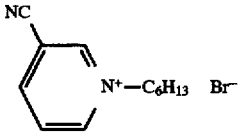

-continued

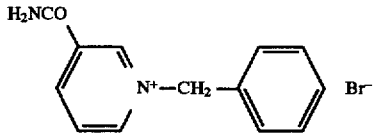

A-249

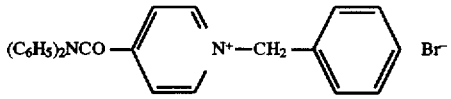

A-250

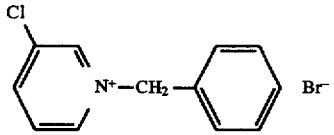

A-251

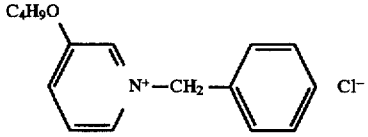

A-252

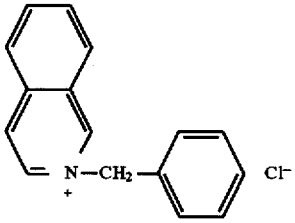

A-253

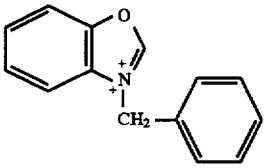

A-254

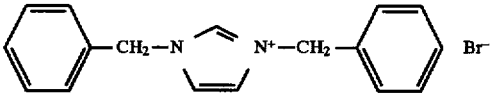

A-255

The amount added of the compounds represented by formulae (I), (II), (III) and (IV) are not particularly limited and depend on the characteristics of the light-sensitive material. However, the amounts are preferably from $1\times10^{-5}$ to $2\times10^{-2}$ mol, more preferably from $2\times10^{-5}$ to $1\times10^{-2}$ mol, per mol of silver.

The compounds represented by formulae (I), (II), (III) and (IV) may be dissolved in a proper water-miscible organic solvent, for example, alcohol (e.g., methanol, ethanol, propanol, fluorinated alcohol), ketone (e.g., acetone, methyl ethyl ketone), dimethylformamide, dimethylsulfoxide and methyl cellosolve.

Furthermore, these compounds may be used in the form of emulsified dispersion, which is prepared using the well-known emulsion dispersion method in which the hydrazine derivative is dissolved using an oil such as dibutyl phthalate, tricresyl phosphate, glyceryl triacetate, and diethyl phthalate, or an auxiliary solvent, such as ethyl acetate and cyclohexanone, and then dispersed mechanically in an emulsified condition. Also, these compounds may be used as fine dispersions according to a solid dispersion method.

The silver halide for use in the silver halide photographic light-sensitive material of the present invention are not particularly limited, and includes silver halide, silver chlorobromide, silver iodochlorobromide, silver bromide, and silver iodobromide. When the light-sensitive material is used for scanner or camera, the content of silver chloride is preferably 50 mol % or more. If the light-sensitive material according to the present invention is used for dot-to-dot working (contact working) in an illuminated room, the content of silver chloride is preferably 90 mol % or more, more preferably 95 mol % or more, and silver chlorobromide or silver chloroiodobromide containing from 0 to 10 mol % of silver bromide is preferred. If the ratio of the silver bromide or silver iodide increase, it is not preferred because the safe light safety in an illuminated room is deteriorated and $\gamma$ is lowered.

The shape of silver halide grains may be any of cubic, octahedral, tetradecanehedral, amorphous and tabular forms, preferably a regularly crystallite form, and more preferably a cubic form. The average particle size of the silver halide is preferably from 0.1 to 0.7 μm, more preferably from 0.2 to 0.5 μm. The variation coefficient thereof represented by ((the standard deviation of the particle size)/(the average particle size))×100 is usually 20% or less, preferably 15% or less, and more preferably 10% or less. The emulsion for use in the present invention is preferably a monodispersion emulsion. In the present invention, the silver halide emulsion suitable for line original (line work) or halftone original is preferably prepared by adding an iridium salt or a complex salt thereof in an amount of $10^{-8}$ to $10^{-5}$ per mol of silver.

The silver halide grains may have uniform phases between the inside and the outer layer, or may have different phases therebetween.

The photographic emulsions for use in the present invention can be prepared using methods described in, e.g., P. Glafkides, *Chemie et Physique Photographique*, Paul Montel, Paris (1967), G. F. Duffin, *Photographic Emulsion Chemistry*, The Focal Press, London (1966), V. L. Zelikman et al, *Making and Coating Photographic Emulsion*, The Focal Press, London (1964).

Suitable methods for reacting a water-soluble silver salt with a water-soluble halide include a single jet method, a double jet method, and a combination thereof.

A method in which silver halide grains are produced in the presence of excess silver ion (reverse mixing method) can be employed. On the other hand, the controlled double jet method, in which the pAg of the liquid phase wherein silver halide grains are to be precipitated is maintained constant, may be employed. Further, it is preferred to form the grain using the silver halide solvent, such as ammonia, thioethers and tetrasubstituted thioureas. Preferably, tetrasubstituted thioureas are used as the silver halide solvent disclosed in JP-A-53-82408 and JP-A-55-77737. The thioureas are preferably tetramethylthiourea or 1,3-dimethyl-2-imidazolidinethione.

According to the controlled double jet method and the grain formation method using a silver halide solvent, a silver halide emulsion having a regularly crystallite shape and a narrow distribution of grain sizes can be obtained with ease, and so these methods are useful for making the silver halide emulsions for use in the present invention.

For unifying the grain sizes, it is also preferred that the grain growth is accelerated within the limits of critical saturation degree by using a method of changing the addition speed of silver nitrate or an alkali halide depending on the speed of grain growth, as described in British Patent No. 1,535,016, JP-B-48-36890 and JP-B-52-16364, or a method of changing the concentrations of the aqueous solutions, as described in British Patent No. 4,242,445 and JP-A-55-158124.

The silver halide grains for use in the photographic material of the present invention may contain at least one metal selected from rhodium, rhenium, ruthenium, osmium, and iridium to obtain a high contrast or a low fog. The content thereof is preferably from $1\times10^{-9}$ to $1\times10^{-3}$ mol, more preferably from $1\times10^{-8}$ to $5\times10^{-6}$ mol, per mol of silver. These metals may be used in combination of two or more. Furthermore, these metals may be contained in silver halide grains uniformly or may be contained in silver halide grains as a molecule form as described in JP-A-63-29603, JP-A-2-305235, JP-A-3-167545, and JP-A-4-76534.

The rhodium compounds for use in the present invention include water-soluble ones. Examples thereof include a rhodium(III) halide compound and a rhodium complex salt containing as a ligand halogen, amine, oxalate, such as a hexachlororhodium(III) complex salt, a hexabromorhodium (III) complex salt, a hexaamminerhodium(III) complex salt and a trioxalatorhodium(III) complex salt. These rhodium compounds are dissolved in water or an appropriate solvent. A conventional method, that is, a method of adding an aqueous solution of halogenated acid (e.g., hydrochloric acid, hydrobromic acid, hydrofluoric acid) or an alkali halide (e.g., KCl, NaCl, KBr, NaBr), can be adopted for stabilizing the solution of a rhodium compound. Instead of using a water-soluble rhodium compound, it is possible to incorporate rhodium into emulsion grains by adding rhodium-doped silver halide grains to the silver halide preparation system and dissolving the grains therein.

These compounds can be properly added at the time silver halide emulsion grains are formed, or at any stage prior to the emulsion coating. In particular, they are preferably added at the time the emulsion is formed and thereby to be incorporated into silver halide grains.

The rhenium, ruthenium and osmium for use in the present invention is added in the form of water-soluble complex salt disclosed in, for example, JP-A-63-2042, JP-A-1-285941, JP-A-2-20852, JP-A-2-20855. Particularly, the following six-coordination complexes are preferred:

$$[M^{O}L^{O}_{6}]^{-n^{O}}$$

wherein $M^{O}$ represents Ru, Re or Os; $L^{O}$ represents a ligand; and $n^{O}$ is 0, 1, 2, 3 or 4. In this case, a counter ion is not critical, so that an ammonium ion or an alkali metal ion is used as the counter ion.

Preferable examples of the ligand include a halide ligand, a cyanide ligand, a cyan oxide ligand, a nitrosyl ligand or a thionitrosyl ligand. Specific examples of the metal complexes for use in the present invention are given below. However, the invention should not construed as being limited to these examples.

| | | |
|---|---|---|
| $[ReCl_6]^{-3}$ | $[ReBr_6]^{-3}$ | $[ReCl_5(NO)]^{-2}$ |
| $[Re(NS)Br_5]^{-2}$ | $[Re(NO)(CN)_5]^{-2}$ | $[Re(O)_2(NO)_4]^{-3}$ |
| $[RuCl_6]^{-3}$ | $[RuCl_4(H_2O)_2]^{-2}$ | $[RuCl_5(NO)]^{-2}$ |
| $[RuBr_5(NS)]^{-2}$ | $[Ru(CN)_6]^{-4}$ | $[Ru(CO)_3Cl_3]^{-2}$ |
| $[Ru(CO)Cl_5]^{-2}$ | $[Ru(CO)Br_5]^{-2}$ | |
| $[OsCl_5]^{-3}$ | $[OsCl_5(NO)]^{-2}$ | $[Os(NO)(CN)_5]^{-2}$ |
| $[Os(NS)Br_5]^{-2}$ | $[Os(CN)_6]^{-4}$ | $[Os(O)_2(CN)_4]^{-4}$ |

These metal complexes may be properly added at the time silver halide emulsion grains are formed, or at any stage prior to the emulsion coating. In particular, they are preferably added at the time the emulsion is formed to be incorporated into silver halide grains.

The method for incorporating the above-described metal complex into silver halide grains by adding it during the grain formation include a method of adding in advance a solution prepared by dissolving in water the metal complex powder or its mixture with NaCl or KCl to either a water-soluble salt solution or a water-soluble halide solution for the grain formation; a method of forming silver halide grains by simultaneously admixing three solutions, namely a silver salt solution, a halide solution and the foregoing metal complex powder-containing solution as the third solution; and a method of pouring a water solution of the metal complex in a desired amount into the reaction vessel under grain formation. In particular, preferred is the method of adding to an aqueous halide solution a solution prepared by dissolving in water the metal complex powder together with NaCl or KCl.

For adsorbing the metal complex on the grain surface, an aqueous solution thereof may be poured into the reaction vessel in a required amount just after the grain formation, during or at the conclusion of physical ripening, or at the time of chemical ripening.

Examples of the iridium compound for use in the present invention include various iridium compounds, e.g., hexachloroiridium, hexaammineiridium, trioxalatoiridium, hexacyanoiridium. These iridium compounds are dissolved in water or an appropriate solvent. The methods for stabilizing the solution of an iridium compound include a conventional methods, that is, a method of adding an aqueous solution of halogenated acid (e.g., hydrochloric acid, hydrobromic acid, hydrofluoric acid) or alkali halide (e.g., KCl, NaCl, KBr, NaBr). Instead of using a water-soluble iridium compound, it is possible to incorporate iridium into emulsion grains by adding iridium-doped silver halide grains to the silver halide preparation system and dissolving the grains therein.

Particularly, iridium salts such as iridium chloride and ammonium hexachloroiridium(III) are preferably used in combination to obtain emulsion having a high sensitivity and a hard contrast.

These iridium compounds may be properly added at the time silver halide emulsion grains are formed, or at any stage prior to the emulsion coating. In particular, they are preferably added at the time the emulsion is formed to be incorporated into silver halide grains.

Silver halide grains for use in the present invention may be doped by other heavy metal salts. In particular, the doping of an Fe complex salt, such as $K_4[Fe(CN)_6]$, is preferred.

The silver halide particles for use in the present invention may contain metal atoms such as iron, cobalt, nickel, palladium, platinum, gold, thallium, copper, and zinc. These metals are preferably added in an amount of from $1\times10^{-9}$ to $1\times10^{-4}$ mol per mol of silver halide. These metals are contained by adding in the form of a metal salt such as a single salt, a double salt and a complex salt during particle preparation.

The silver halide emulsion for use in the present invention may be preferably chemically sensitized. Examples of the chemical sensitization include known methods, such as a sulfur sensitization method, a selenium sensitization method, a tellurium sensitization method, a noble metal sensitization method, and a reduction sensitization method. Preferably, the silver halide emulsion is sensitized with a selenium sensitizer or a tellurium sensitizer. These methods can be used alone or in combination. In the combined use, it is preferred to combine, e.g., a sulfur sensitization method and a gold sensitization method, a sulfur sensitization method, a selenium sensitization and a gold sensitization method, or a sulfur sensitization method, a tellurium sensitization method and a gold sensitization method.

In the sulfur sensitization method in the present invention, the sensitization can be generally effected by adding a sulfur sensitizer to an emulsion and stirring the emulsion for a prescribed time under a temperature of 40° C. or more. The sulfur sensitizer includes known compounds such as sulfur compounds contained in gelatin, thiosulfates, thioureas, thiazoles, and rhodanines. Of these sulfur sensitizers, thiosulfates and thiourea compounds are preferred. The amount of a sulfur sensitizer added, though it depends on various conditions, such as the pH and the temperature at the time of chemical sensitization and the size of silver halide grains, is preferably from $10^{-7}$ to $10^{-2}$ mol, more preferably from $10^{-5}$ to $10^{-3}$ mol, per mol of silver halide.

Selenium sensitizers for use in the present invention include known selenium compounds. Generally, selenium sensitization can be effected by adding an unstable selenium compound and/or a nonunstable selenium compound to the silver halide emulsion and agitating the resulting emulsion at a high temperature, preferably 40° C. or more, for a definite time. Examples of the unstable selenium compounds include those disclosed in JP-B-44-15748, JP-B-43-13489, JP-A-4-25832, JP-A-4-107442 and JP-A-4-324855. The compounds represented by formula (VIII) or (IX) described in JP-A-4-324855 are preferably used.

The tellurium sensitizers for use in the present invention are compounds capable of producing silver telluride, which is presumed to act as a sensitization nucleus, at the surface or the inside of silver halide grains. The production rate of silver telluride in a silver halide emulsion can be examined by the method disclosed in JP-A-5-313284.

Specific examples of the tellurium sensitizers include the compounds disclosed in U.S. Pat. Nos. 1,623,499, 3,320,069 and 3,772,031; British Patent Nos. 235,211, 1,121,496, 1,295,462 and 1,396,696; Canadian Patent No. 800,958, JP-A-4-204640, JP-A-4-271341, JP-A-4-333043 and JP-A-5-303157; *J. Chem. Soc. Commun.*, 635 (1980); ibid. 1102 (1979); ibid. 645 (1979); *J. Chem. Soc. Perkin. Trans.*, 1,2191 (1980); S. Patai (compiler), *The Chemistry of Organic Selenium and Tellurium Compounds*, Vol. 1 (1986); and ibid. Vol. 2 (1987). In particular, the compounds represented by formulae (II), (III) and (IV) in JP-A-5-313284 are preferred.

The amounts of selenium and tellurium sensitizers for use in the present invention, though they depend on the conditions under which the silver halide grains are ripened chemically, are generally from $10^{-8}$ to $10^{-2}$ mol, preferably from $10^{-7}$ to $10^{-3}$ mol, per mol of silver halide. The chemical sensitization, although the present invention does not impose any particular restriction thereon, is generally carried out at a pH of 5 to 8, at a pAg of 6 to 11, preferably 7 to 10, and at a temperature of 40° to 95° C., preferably 45° to 85° C.

Examples of the noble metal sensitizers for use in the present invention include gold, platinum, palladium and iridium. In particular, gold sensitizers are preferred. Examples of the gold sensitizers include chloroauric acid, potassium chloroaurate, potassium aurithiocyanate and auric sulfide. These sensitizers can be used in an amount of $10^{-7}$; to $10^{-2}$ mol per mol of silver halide.

In a process of producing silver halide emulsion grains for use in the present invention or allowing the produced grains to ripen physically, a cadmium salt, a zinc salt, a lead salt, and a thallium salt may be present.

Further, the reduction sensitization can be adopted in the present invention. Examples of the reduction sensitizer include stannous salts, amines, formamidinesulfinic acid and silane compounds.

To the silver halide emulsions for use in the present invention, thiosulfonic acid compounds may be added according to the method described in European Patent (EP) No. 293,917.

The present photographic material may contain only one kind of silver halide emulsion or not less than two kinds of silver halide emulsions (differing in average grain size, halide composition, crystal habit or chemical sensitization condition).

Spectral sensitizing dyes for use in the present invention are not particularly limited.

The amount of sensitizing dyes added is, though depending on the shape and the size of silver halide grains, from $4\times10^{-6}$ to $8\times10^{-3}$ mol per mol of silver halide. For example, if the size of silver halide grains is from 0.2 to 1.3 μm, the amount of sensitizing dyes added is preferably from $2\times10^{-7}$ to $3.5\times10^{-6}$ mol, particularly preferably from $6.5\times10^{-7}$ to $2.0\times10^{-6}$ mol, per $m^2$ of surface area of silver halide grains.

The light-sensitive silver halide emulsions for use in the present invention may be spectrally sensitized with sensitizing dyes to extend their sensitivities to blue rays of relatively long wavelengths, green rays, red rays or infrared rays. Examples of the sensitizing dyes include cyanine dyes, merocyanine dyes, complex cyanine dyes, complex merocyanine dyes, holopolar cyanine dyes, styryl dyes, hemicyanine dyes, oxonol dyes and hemioxonol dyes.

The sensitizing dyes useful in the present invention include those described in *Research Disclosure*, Item 17643, Section IV-A (December 1978, p. 23); ibid., Item 1831, Section X (August 1978, p. 437) and the references cited in these literatures.

In special cases where various type of scanners are used for exposure, sensitizing dyes which impart spectral sensitivities suited for spectral properties of the light source of the scanner used can be selected.

For instance, the preferable dyes include the following: (A) the simple merocyanines disclosed in JP-A-60-162247, JP-A-2-48653, U.S. Pat. No. 2,161,331, West German Patent No. 936,071 and JP-A-5-11382 for an argon laser light source, (B) the trinuclear cyanine dyes disclosed in JP-A-50-62425, JP-A-54-18726 and JP-A-59-102229 for an He—Ne laser light source, (C) the thiacarbocyanines disclosed in JP-B-48-42172, JP-B-51-9609, JP-B-55-39818, JP-A-62-284343 and JP-A-2-105135 for an LED or red semiconductor laser light source, and (D) the tricarbocyanines disclosed in JP-A-59-191032 and JP-A-60-80841 and the 4-quinoline nucleus-containing dicarbocyanines represented by formula (IIIa) or (IIIb) in JP-A-59-192242 and JP-A-3-67242 for an infrared semiconductor layer light source.

These sensitizing dyes may be used alone or in combination. Combinations of sensitizing dyes are often used for the purpose of supersensitization. Materials which can exhibit a supersensitizing effect in combination with sensitizing dyes although they themselves do not spectrally sensitize silver halide emulsions or do not absorb light in the visible region may be incorporated in the emulsions.

Useful sensitizing dyes, supersensitizing combinations of dyes, and materials capable of exhibiting a supersensitizing effect are described in, e.g., *Research Disclosure*, Vol. 176, Item 17643, Section IV-J (December 1978, p. 23).

In particular, the dyes described below are preferably used for an argon laser light source:

S1-1

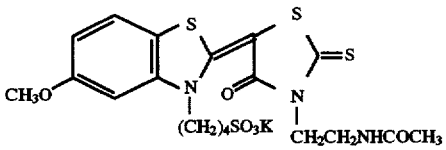

S1-2

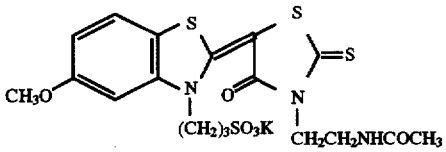

S1-3

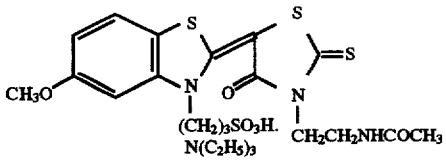

S1-4

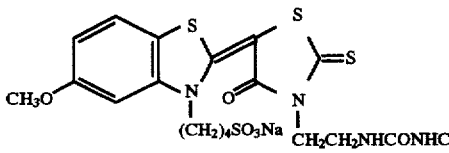

S1-5

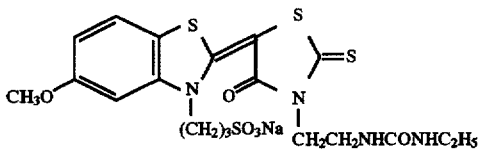

-continued

S1-6

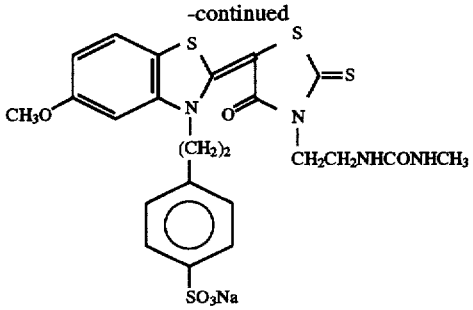

S1-7

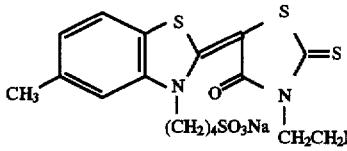

S1-8

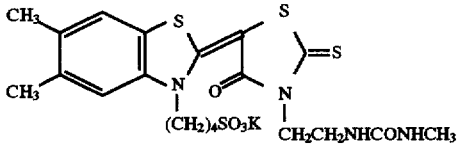

S1-9

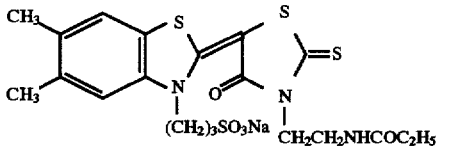

S1-10

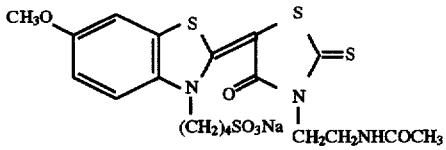

S1-11

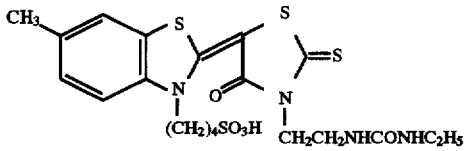

S1-12

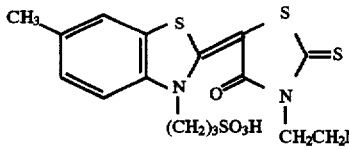

S1-13

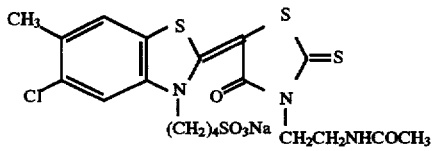

In addition to the dyes described above, the sensitizing dyes represented by formula (I) in JP-A-6-75322 (from page 8, last line to page 13, line 4) are particularly preferred for a helium-neon laser light source. Specific examples of the sensitizing dyes are described below. In addition, the sensitizing dyes represented by formula (I) of JP-A-6-75322 may be preferably used.

S2-1
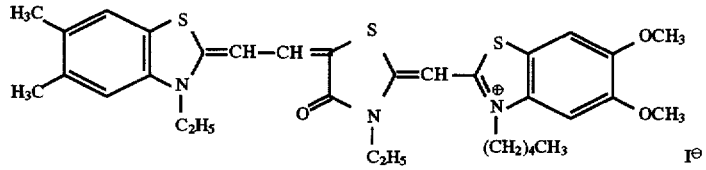
S2-2
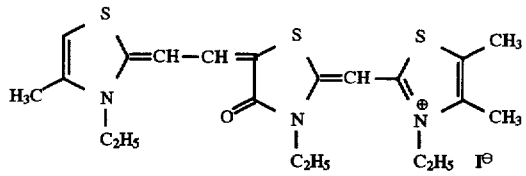
S2-3
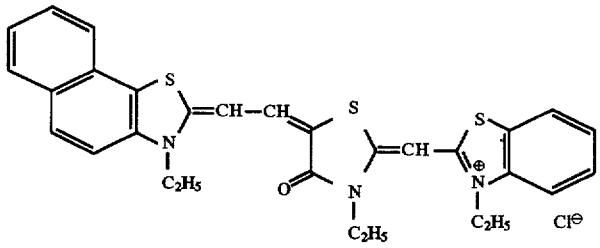
S2-4
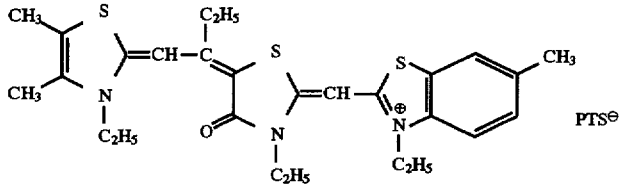
S2-5
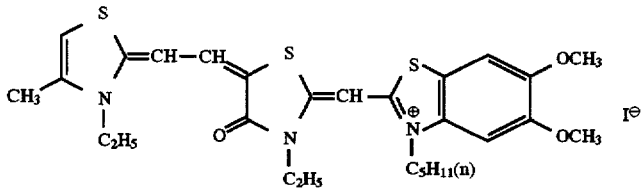
S2-6
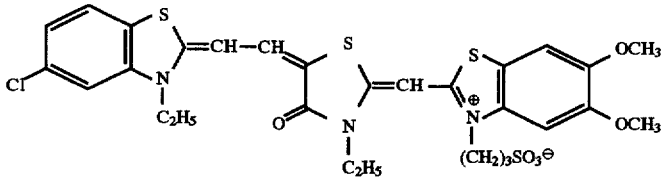
S2-7
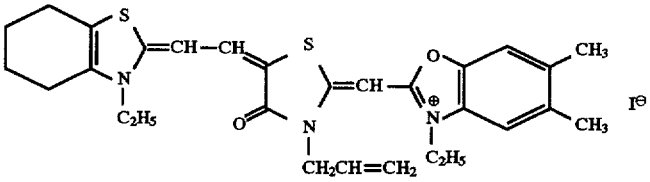
S2-8
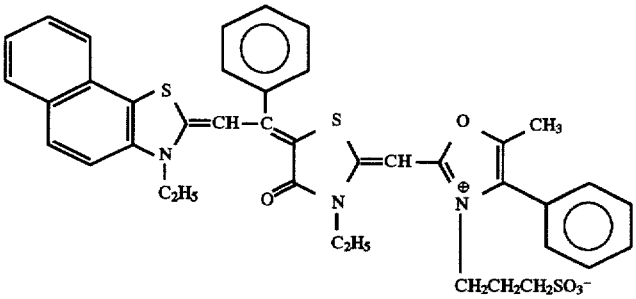

-continued
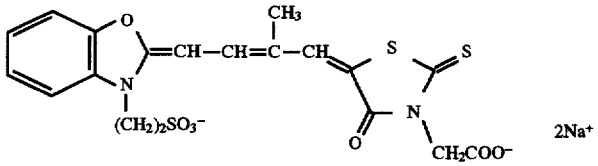
S2-9
For LED and red semiconductor laser light sources, the dyes illustrated below are particularly suitable.
S3-1
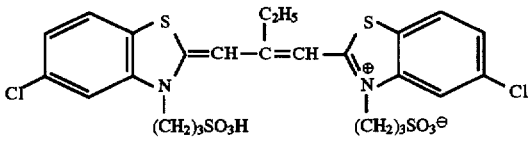
S3-2
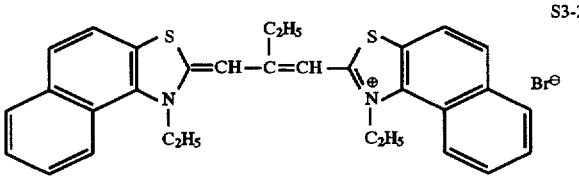
S3-3
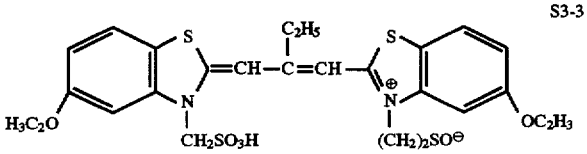
S3-4
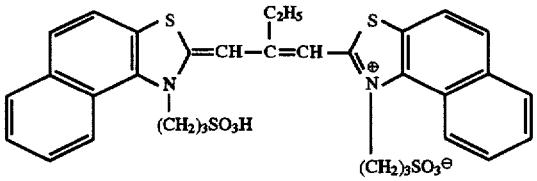
-continued
S3-5
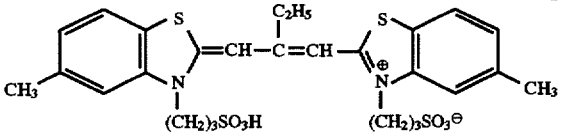
S3-6
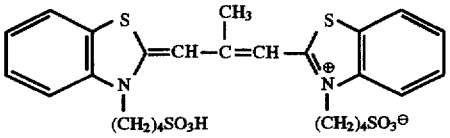
S3-7
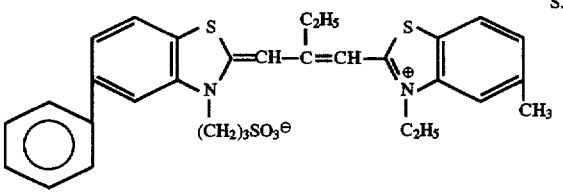
S3-8
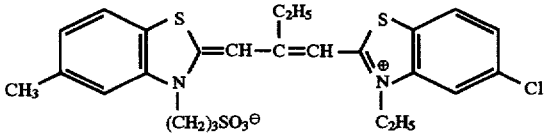
S4-1
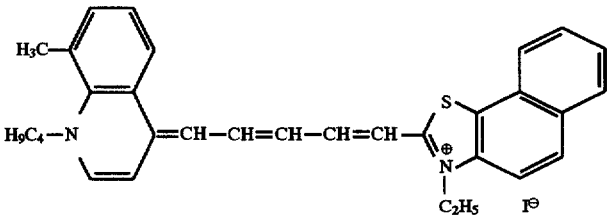
S4-2
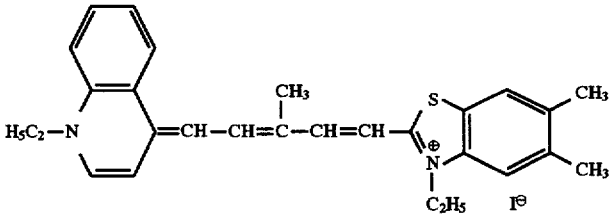

-continued
S4-3
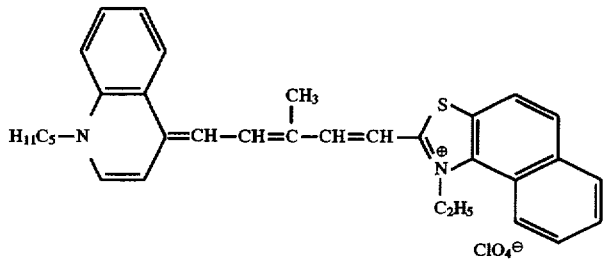
S4-4
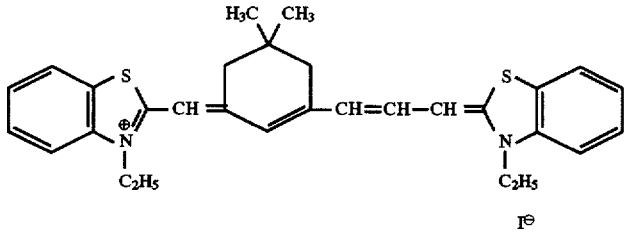
S4-5
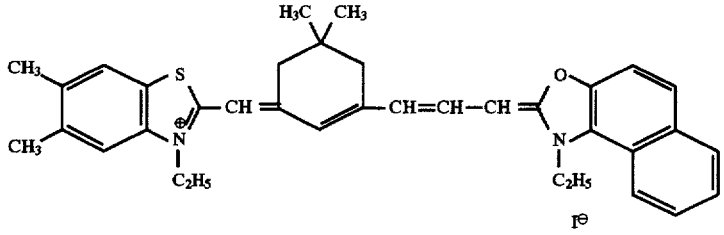
S4-6
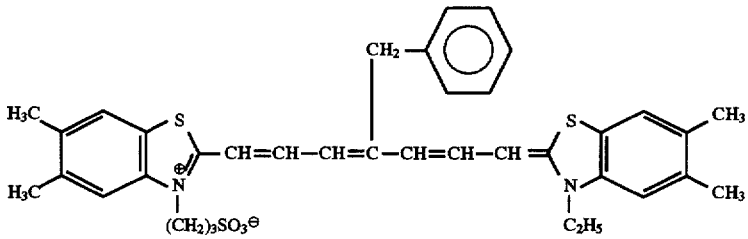
S4-7
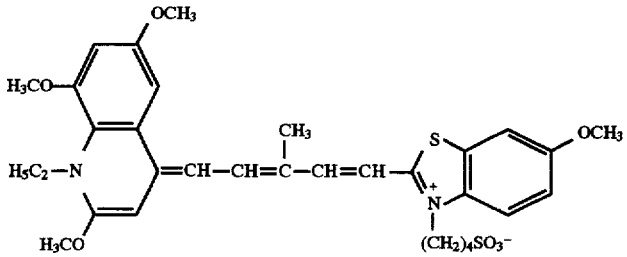
S4-8
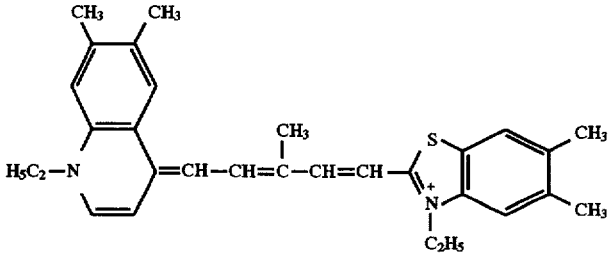

-continued
S4-9
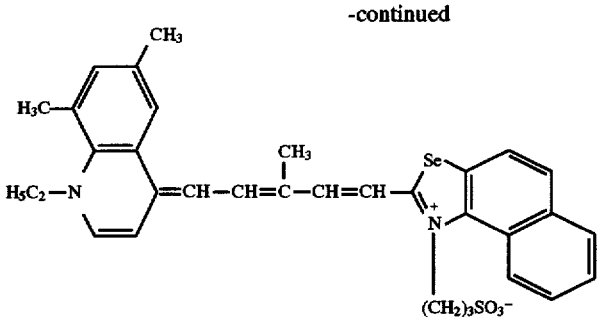
For an infrared semiconductor laser light source, the dyes described below are particularly suitable.
For a white light such as camera photographing, the sensitizing dyes represented by formula (IV) in JP-A-7-36139 (from page 20, line 14 to page 22, line 23) are preferred. Examples thereof are described below.
S5-1
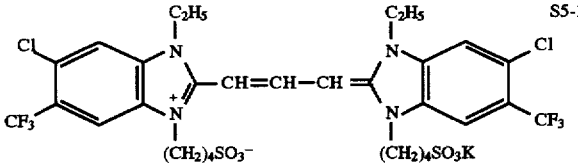
S5-2
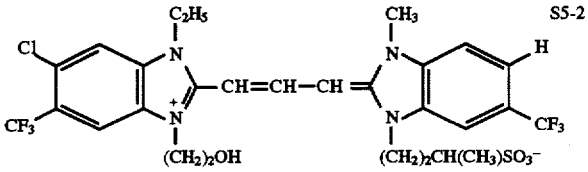
S5-3
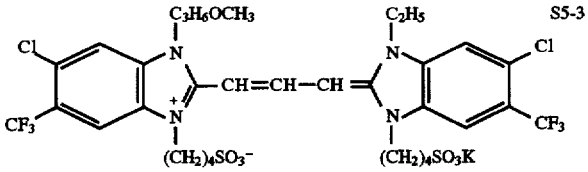
S5-4
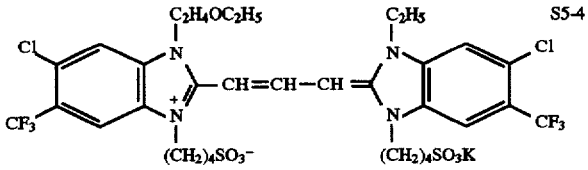
S5-5
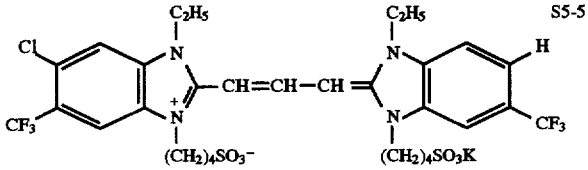
S5-6
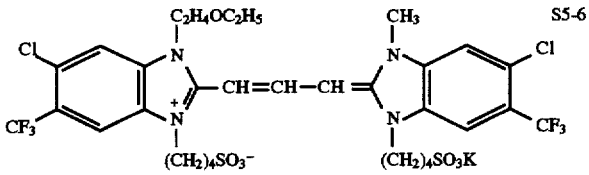
-continued
S5-7
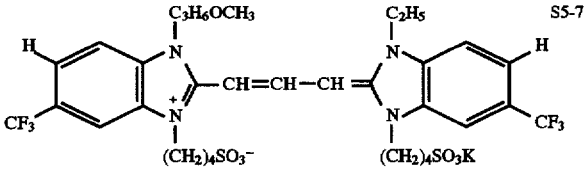
S5-8
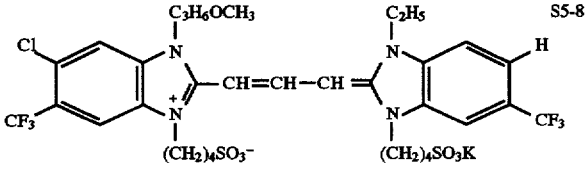
S5-9
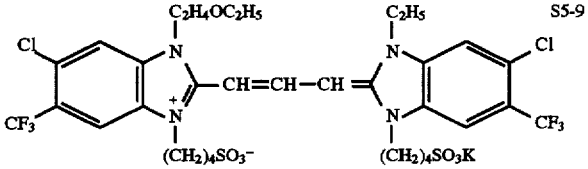
S5-10
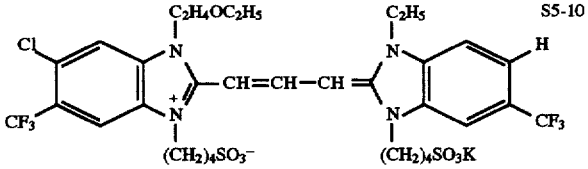
S5-11
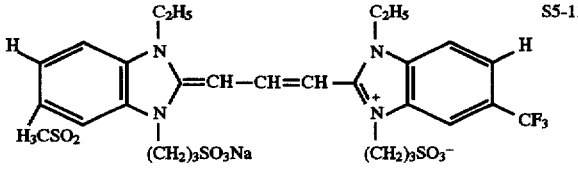
S5-12
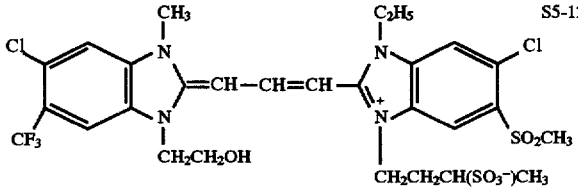
S5-13
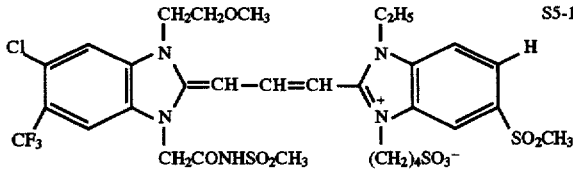

-continued

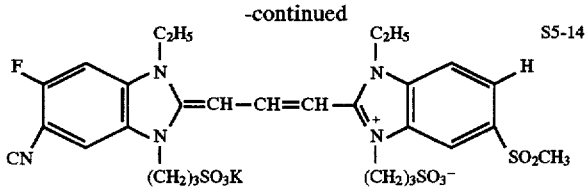

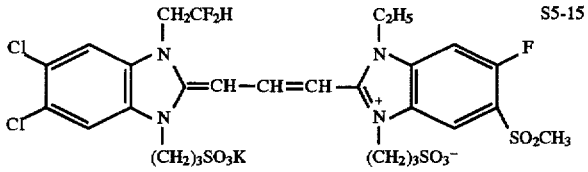

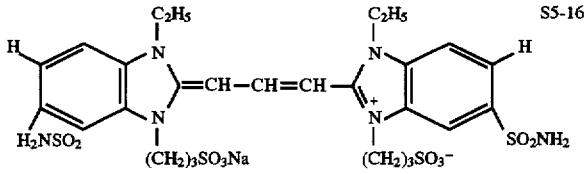

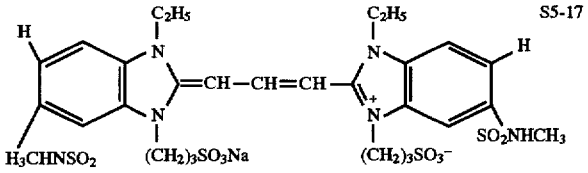

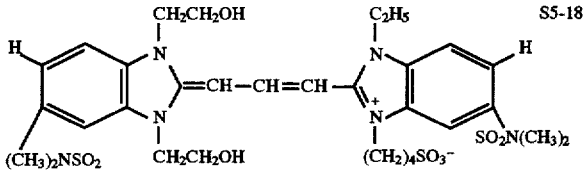

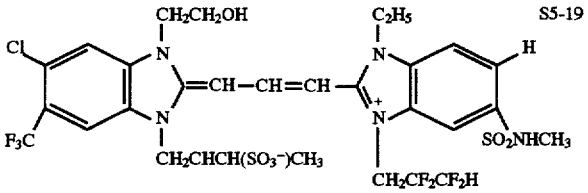

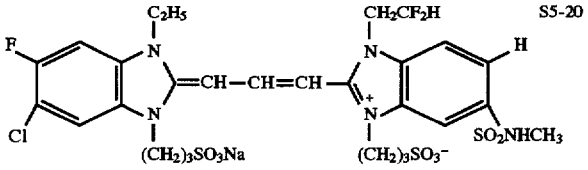

Gelatin is preferably used as a protective colloid for a photographic emulsion or a binder for other hydrophilic colloid layer. In addition to the gelatin, other hydrophilic colloids can be used. Examples thereof include gelatin derivatives; graft polymers of gelatin and other high polymers; proteins such as albumin and casein; cellulose derivatives such as hydroxyethyl cellulose, carboxymethyl cellulose, and cellulose sulfate; sodium alginate; sugar derivatives such as starch derivatives; and various kinds of synthetic hydrophilic high polymers of homopolymers or copolymers such as polyvinyl alcohol, polyvinyl alcohol partial acetal, poly-N-vinylpyrolidone, polyacrylic acid, polymethacrylic acid, polyacrylamide, polyvinylimidazole, and polyvinylpyrazol.

The gelatin for use in the present invention may be lime-processed gelatin, acid-processed gelatin, a gelatin hydrolysis product or a gelatin enzyme-decomposed product.

Various compounds can be incorporated into the photographic material of the present invention for the purpose of preventing a fog or stabilizing a photographic performance during manufacturing, storage or a photographic processing of the photographic material. Many compounds known as an anti-foggant or a stabilizer may be added into the photographic material. Examples thereof include azoles such as benzothiazolium salts, nitroindazoles, chlorobenzimidazoles, bromobenzimidazoles, mercaprothiadiazoles, aminotriazoles, benzothiazoles, and nitrobenzotriazoles; mercaptopyrimidines; mercaptotriazines; thioketo compounds such as oxazolinethione; azaindenes such as triazaindenes, tetrazaindenes (particularly 4-hydroxy-substituted (1,3,3a,7)tetrazaindenes), and pentazaindenes; hydroquinone, and the derivatives thereof; disulfides such as thioctic acid; benzenethiosulfonic acid, benzenesulfinic acid, and benzenesulfonamide. Among these compounds, preferred are benzotriazoles (for example, 5-methylbenzotriazole) and nitroindazoles (for example, 5-nitroindazole). These compounds may be contained in a processing solution.

The photographic material of the present invention may contain an organic desensitizer. The organic desensitizer has at least one water soluble group or alkali dissocitative group.

These preferred organic desensitizers are exemplified in U.S. Pat. No. 4,908,293. The organic desensitizer is used in an amount of $1.0\times10^{-8}$ to $1.0\times10^{-4}$ mol/m$^2$, preferably from $1.0\times10^{-7}$ to $1.0\times10^{-5}$ mol/m$^2$, in a silver halide emulsion layer.

The photographic material of the present invention may contain a developing accelerator. Examples of the developing accelerator or an accelerator for a nucleating infectious development for use in the present invention include compounds containing an N or S atom as well as compounds disclosed in JP-A-53-77616, JP-A-54-37732, JP-A-53-137133, JP-A-60-140340 and JP-A-60-14959.

Specific examples thereof are described below.

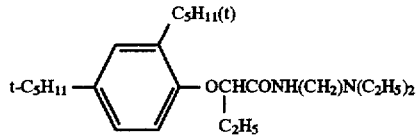

(1)

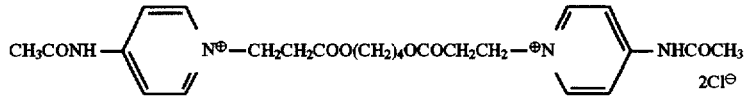

(2)

-continued
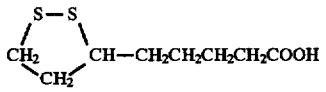
(3)
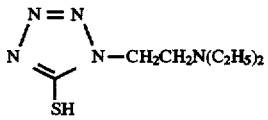
(4)
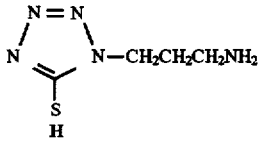
(5)
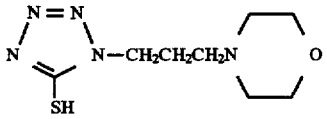
(6)
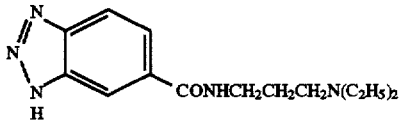
(7)
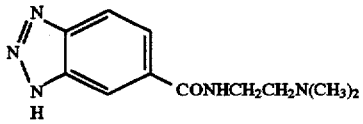
(8)
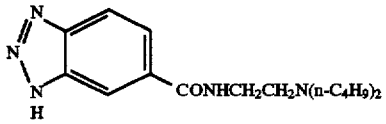
(9)
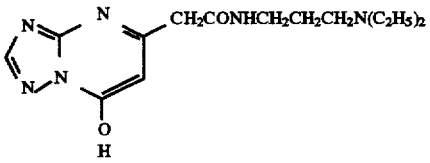
(10)
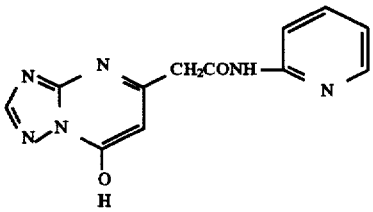
(11)
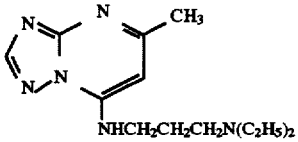
(12)
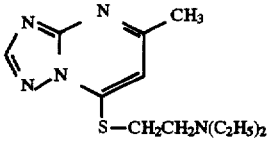
(13)

-continued

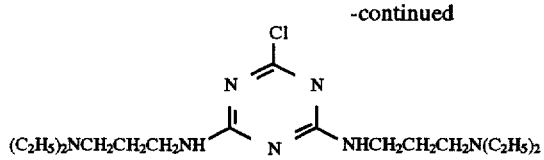

(14)

$(C_2H_5)_2NCH_2CH(OH)CH_2OH$ (15)

$n\text{-}C_4H_9N(C_2H_4OH)_2$ (16)

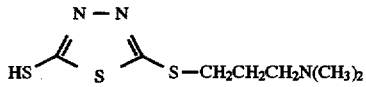

(17)

The accelerators have a different optimum addition amount according to the type of the compounds and are preferably used in an amount of from $1.0\times10^{-3}$ to 0.5 g/m$^2$, preferably from $5.0\times10^{-3}$ to 0.1 g/m$^2$. These accelerators are dissolved in a suitable solvent (for example, water, alcohol such as methanol and ethanol, acetone, dimethylformamide, methyl cellosolve) to add them into a coating solution.

These additives may be used in combination of plural kinds.

The emulsion layers and other hydrophilic colloid layers in the photographic material of the present invention may contain dyes as a filter dye or for the various purposes of irradiation prevention and others. Examples of the filter dye include a dye for further lowering a photographic sensitivity, preferably a UV absorber having a spectral absorption maximum in an inherent sensitive region of silver halide and a dye having a substantial light absorption primarily in a region of 310 to 600 nm for rasing a safety against a safelight in handling a daylight photographic material.

These dyes are preferably added to an emulsion layer according to the objects or an upper part of a silver halide emulsion layer, that is, a non-light-sensitive hydrophilic layer farther from a support than the silver halide emulsion layer together with a mordant to fix them. An addition amount of the dye is different according to a molar extinction coefficient, and it is usually added in an amount of $10^{-3}$ g/m$^2$ to 1 g/m$^2$, preferably from 10 mg/m$^2$ to 500 mg/m$^2$.

The above-described dyes can be dissolved or dispersed in a suitable solvent (for example, alcohol (e.g., methanol, ethanol, propanol), acetone, methyl cellosolve, or a mixture thereof) to add them to a coating solution.

These dyes may be used in combination of two or more kinds of the dyes.

Examples of these dyes are described in U.S. Pat. No. 4,908,293. In addition, UV absorbers described in U.S. Pat. Nos. 3,533,794, 3,314,794, and 3,352,681, JP-A-46-2784, U.S. Pat. Nos. 3,705,805, 3,707,375, 4,045,229, 3,700,455 and 3,499,762, and German Patent Publication No. 1,547,863 may also be used. Furthermore, pyrazolone oxonol dyes described in U.S. Pat. No. 2,274,782; diarylazo dyes described in U.S. Pat. No. 2,956,879; styryl dyes and butadienyl dyes described in U.S. Pat. Nos. 3,423,207 and 3,384,487; mericyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and dyes described in British Patent Nos. 584,609 and 1,177,429, JP-A-48-85130, JP-A-49-99620 and JP-A-49-114420 and U.S. Pat. Nos. 2,533,472, 3,148,187, 3,177,078, 3,247,127, 3,540,887, 3,575,704 and 3,653,905 may be also used.

An inorganic or organic hardener may be incorporated into a photographic emulsion layer and the other hydrophilic colloid layers in the photographic material of the present invention. Examples of the hardener include chromium salts (e.g., chromium alum, chromium acetate), aldehydes (e.g., formaldehyde, glyoxal, glutaraldehyde), N-methylol compounds (e.g., dimethylolurea, methyloldimethylhyrantoin), dioxane derivatives (e.g., 2,3-dihydroxydioxane), active vinyl compounds (e.g., 1,3,5-triacryloylhexahydro-s-triazine, 1,3-vinylsulfonyl-2-propanol), active halogen compounds (e.g., 2,4-dichloro-6-hydroxy-s-triazine), mucohalogenic acids (e.g., mucochloric acid, muchophenoxychloric acid), epoxy compounds (e.g., tetramethylene glycol diglycidyl ether), and isocyanate compounds (e.g., hexamethylenediisocyanate). These compounds may be used singly or in combination.

Furthermore, the polymer hardeners described in JP-A-56-66841, British Patent No. 1,322,971 and U.S. Pat. No. 3,671,256 may be also used.

The photographic emulsion layers and other hydrophilic colloid layers in the photographic material of the present invention may contain various surfactants for various purposes such as coating aid, anti-electrification, improvement in sliding performance, emulsification dispersion, anti-sticking, and improvement in the photographic characteristics (e.g., development acceleration, hard gradation, sensitization). Examples of the surfactant include a nonionic surfactant such as saponin (steroid type), alkylene oxide derivatives (e.g., polyethylene glycol, polyethylene glycol/polypropylene glycol condensation products, polyethylene glycol alkyl ethers, polyethylene glycol alkyl aryl ethers, polyethylene glycol esters, polyethylene glycol sorbitan esters, polyalkylene glycol alkylamines or amides, polyethylene oxide adducts of silicon), glycidol derivatives (e.g., alkyenylsuccinic acid polyglycerides, alkylphenol polyglycerides), fatty acid esters of polyhydric alcohol, and alkyl esters of saccharose; an anionic surfactant having an acid group such as a carboxyl group, a sulfo group, a phospho group, a sulfurate group, and a phosphorate group, such as alkylcarbonates, alkylsufonates, alkylbenzenesulfonates, anlkylnaphthalenesulfonates, alkylsulfurates, alkylphosphorates, N-acyl-N-alkyltaurines, sulfosuccinates, sulfoalkyl polyoxyethylenealkylphenyl ethers, and polyoxyethylene alkylphosphorates; and amphoteric surfactant such as amino acids, aminoalkylsulfonic acids, aminoalkylsulfurates or phosphorates, alkylbetains, and amine oxides; and a cationic surfacatant such as alkylamine hydrochloric acids, aliphatic or aromatic quaternary ammonium salts, heterocyclic quaternary ammonium salts such as pyridinium and imidazolium, and aliphatic or heterocycle-containing phosphonium or sulfonium salts.

The surfactants particularly preferably used in the present invention are polyalkylene oxides having a molecular weight of 600 or more, described in JP-B-58-9412. Furthermore, a polymer latex such as polyalkyl aryclate can be incorporated for a dimensional stabilization.

The developer in the course of developing the photographic material according to the present invention (the developing initiator and the developer replenisher are totally referred to as a developer; this is repeated to be following) may contain additives which are usually utilized (e.g., preservatives, chelating agents).

The developing agent for use in the developer of the present invention is not particularly limited; however, developing agents containing dihydroxybenzenes or ascorbic acid derivatives are preferred because they provide good dot (halftone) properties. More preferably, a combination of dihydroxybenzenes and 1-phenyl-3-pyrazolidones, a combination of dihydroxybenzenes and p-aminophenols, a combination of ascorbic acid derivatives and 1-phenyl-3-pyrazolidones, and a combination of ascorbic acid derivatives and p-aminophenols are more preferred because of their good developing ability.

Examples of the dihydroxybenzene developing agent for use in the present invention include hydroquinone, chlorohydroquinone, bromohydroquinone, isopropylhydroquinone, methylhydroquinone, hydroquinone monosulfonate, 2,3-dichlorohydroquinone, 2,5-dichlorohydroquinone, 2,3-dibromohydroquinone, and 2,5-dimethylhydroquinone. Among these, hydroquinone are particularly preferred.

Examples of the ascorbic acid derivative include ascorbic acid, erysorbic acid, which is a stereo isomer of ascorbic acid, and these alkali metal salts (e.g., sodium salts, potassium salts).

Examples of the 1-phenyl-3-pyrazolidone and derivatives thereof as an auxiliary developing agent include 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxydimethyl-3-pyrazolidone.

Furthermore, examples of the p-aminophenol and derivatives thereof as an auxiliary developing agent include N-methyl-p-aminophenol, p-aminophenol, N-(β-hydroxyethyl)-p-aminophenol, N-(4-hydroxyphenyl) glycine, 2-methyl-p-aminophenol, and p-benzylaminophenol. Among these, N-methyl-p-aminophenol is preferred.

When the developing agent and the auxiliary developing agent such as 1-phenyl-3-pyrazolidones and p-aminophenols are used in combination, the auxiliary developing agent is used in an amount of from $10^{-3}$ to 0.1 mol, preferably from $10^{-3}$ to 0.06 mol, per liter of the developer.

The developing agent is preferably used in an amount of from 0.05 to 0.8 mol, more preferably from 0.2 to 0.6 mol, per liter of developer. When the combination of a dihydroxybenzene with a 1-phenyl-3-pyrazolidone or p-aminophenol is used as a developing agent, the former is preferably used in an amount of from 0.05 to 0.6 mol, more preferably from 0.2 to 0.5 mol, per liter of developer, and the latter is preferably used in an amount of 0.06 mol, more preferably 0.03 mol, per liter of developer or less.

Examples of the preservatives for use in the present invention include sodium sulfite, potassium sulfite, lithium sulfite, ammonium sulfite, sodium bisulfite, sodium metasulfite, and formaldehyde-sodium bisulfite. The sulfite (free sulfite ion) is used in an amount of 0.20 mol/l or more, preferably 0.30 mol/l or more, and particularly preferably 0.4 mol/l, but if it is added too excessively, there is a cause for silver staining in the developer. Accordingly, the upper limit is preferably 2.0 mol/l, more preferably 1.2 mol/l. The amount is more preferably from 0.35 to 0.7 mol/l.

In combination with the sulfite, a small amount of an ascorbic acid derivative may added as a preservative for the dihydroxybenzene developing agent. The ascorbic acid derivative include ascorbic acid, erysorbic acid, which is a stereo isomer of ascorbic acid, and these alkali metal salts (e.g., sodium salts, potassium salts). Sodium erysorbate is preferably used in terms of the cost for material. The concentration ratio of the addition amount thereof to the amount of the dihydroxybenzene developing agent by mol is preferably from 0.03/1 to 0.12/1, more preferably from 0.05/1 to 0.10/1. In using the ascorbic derivative as a preservative, it is preferred to contain no boron compound in the developer.

Alkali agents which can be used for adjusting the pH include pH adjusting agents or buffers such as usual water-soluble inorganic alkali metal salts (e.g., sodium hydroxide, potassium hydroxide, sodium carbonate, potassium carbonate, sodium phosphate, potassium phosphate, sodium silicate, potassium silicate).

The pH of the developer for use in the present invention is preferably from 9.0 to 11.0, more preferably from 9.8 to 11.0. If the pH is more than 11.0, it is not preferred because the keeping property of the developer is lowered. Furthermore, if the pH is less than 9.0, it is not preferred because sufficient contrast cannot be obtained.

Examples of additives added to the developer of the present invention include a boron compound (e.g., boric acid, borax), a development inhibitor (e.g., sodium bromide, potassium bromide), an organic solvent (e.g., ethylene glycol, diethylene glycol, triethylene glycol, dimethylformamide, methyl cellosolve, hexylene glycol, ethanol, methanol), an alkanolamine (e.g., diethanolamine, triethanolamine), a development accelerator (e.g., imidazole, derivatives thereof), and an antifoggant or black pepper (black spot) inhibitor (e.g., mercapto compound, indazole compound, benzotriazole compound, benzimidazole compound). Specific examples include 5-nitroindazole, 5-p-nitrobenzoylaminoindazole, 1-methyl-5-nitroindazole, 6-nitroindazole, 3-methyl-5-nitroindazole, 5-nitrobenzimidazole, 2-isopropyl-5-nitrobenzimidazole, 5-nitrobenzotriazole, sodium 4-[(2-mercapto-1,3,4-thiadiazol-2-yl)thio]butanesulfonate, 5-amino-1,3,4-thiadiazole-2-thiol, methylbenzotriazole, 5-methylbenzotriazole, 2-mercaptobenzotriazole, 1-phenyl-5-mercaptotetrazol, sodium 2-mercaptobenzimidazole-5-sulfonate). The addition amount of the antifoggant is from 0.01 to 10 mmol, more preferably from 0.05 to 2 mmol, per liter of the developer. Particularly, the amino compounds described in JP-A-56-106244 and the imidazole compounds described in JP-B-48-35493 are preferred for accelerating the development or improving the sensitivity.

Further, various kinds of organic and inorganic chelating agents can be used in combination in the developer of the present invention. Examples of the inorganic chelating agents include sodium tetrapolyphosphate and sodium hexametaphosphate.

Examples of the organic chelating agents include organic carboxylic acid, aminopolycarboxylic acid, organic phosphonic acid, aminophosphonic acid, and organic phosphonocarboxylic acid.

Examples of the organic carboxylic acids include acrylic acid, oxalic acid, malonic acid, succinic acid, glutaric acid, adipic acid, pimelic acid, suberic acid, acielaidic acid, sebacic acid, nonanedicarboxylic acid, decanedicarboxylic acid, undecanedicarboxylic acid, maleic acid, itaconic acid, malic acid, citric acid, and tartaric acid.

Examples of the aminopolycarboxylic acids include iminodiacetic acid, nitrilotriacetic acid, nitrilotripropionic acid, ethylenediaminomonohydroxyethyltriacetic acid, ethylenediaminetetraacetic acid, glycol ether tetraacetic acid, 1,2-diaminopropanetetraacetic acid, diethylenetriaminepentaacetic acid, triethylenetetraminehexaacetic acid, 1,3-diamino-2-propanoltetraacetic acid, glycol ether diaminotetraacetic acid, and compounds disclosed in JP-A-52-25632, JP-A-55-67747, JP-A-57-102624, and JP-B-53-40900.

Examples of the organic phosphonic acids include hydroxyalkylidene-diphosphonic acid disclosed in U.S. Pat. Nos. 3,214,454, 3,794,591 and German Patent Publication No. 2,227,639, and the compounds disclosed in *Research Disclosure*, Vol. 181, Item 18170 (May, 1979).

Examples of the aminophosphonic acids include aminotris(methylenephosphonic acid), ethylenediaminotetramethylenephosphonic acid, aminotrimethylenephosphonic acid, and the compounds disclosed in *Research Disclosure*, No. 18170, JP-A-57-208554, JP-A-54-61125, JP-A-55-29883 and JP-A-56-97347.

Examples of the organic phosphonocarboxylic acids include the compounds disclosed in JP-A-52-102726, JP-A-53-42730, JP-A-54-121127, JP-A-55-4024, JP-A-55-4025, JP-A-55-126241, JP-A-55-65955, and *Research Disclosure*, No. 18170.

These chelating agents may be used in the form of alkali metal salts or ammonium salts. The addition amount of these chelating agents is preferably from $1\times10^{-4}$ to $1\times10^{-1}$ mol, more preferably from $1\times10^{-3}$ to $1\times10^{-2}$ mol, per liter of the developer.

Furthermore, the developer for use in the present invention can contain the compounds disclosed in JP-A-56-24347, JP-B-56-46585, JP-B-62-2849, and JP-A-4-362942 as a silver stain inhibitor.

Also, the developer for use in the present invention can contain the compounds disclosed in JP-A-62-212651 as a development unevenness inhibitor, and the compounds disclosed in JP-A-61-267759 as a dissolving aid.

Moreover, the developer may contain a color toning agent, a surfactant, an antifoaming agent, and a hardener, if needed.

The development processing temperature and the development processing time are related reciprocally and determined in relationship with the total processing time, and generally the processing temperature is from about 20° to 50° C., preferably from 25° to 45° C., and the processing time is from 10 seconds to 2 minutes, preferably from 7 seconds to one minute and 30 seconds.

Preferably, the processing solution is concentrated for preservation and is diluted when it is used in order to save the transportation cost, package material cost and spaces. The salt component contained in the developer is preferably a potassium salt to concentrate the developer.

The fixing solution for use in the fixing step in the present invention is an aqueous solution containing sodium thiosulfate and ammonium thiosulfate, and if needed, tartaric acid, citric acid, gluconic acid, boric acid, iminodiacetic acid, 5-sulfosalicylic acid, glucohepatnic acid, Tiron, ethylenediamine tertaacetic acid, diethylenetriamine pentaacetic acid, nitrilo triacetic acid, and salts thereof. However, it is preferred that the boric acid is not contained in view of the environmental preservation.

Examples of the fixing agent in the fixing solution for use in the present invention include sodium thiosulfate and ammonium thiosulfate. The sodium thiosulfate is preferred in view of the fixing velocity and the sodium thioammonium is preferred in view of the environmental preservation. The amount added of the fixing agent is not particularly limited, but is usually from about 0.1 to 5 mol/l, preferably from 0.1 to 2 mol/l, and more preferably from 0.2 to 1.5 mol/l.

The fixing solution can include, if needed, a hardening agent (e.g., water-soluble aluminum compound), a preservative (e.g., sulfite, bisulfite), a pH buffer (e.g., acetic acid), a pH adjustor (e.g., ammonia, sulfuric acid), a chelating agent a surfactant, a wetting agent, and a fixing accelerator.

Examples of the surfactant include an anionic surfactant (e.g., sulfated product, sulfonated product), a polyethylene surfactant, and amphoteric surfactants disclosed in JP-A-57-6840, and known defoaming agents can also be used. Examples of the wetting agent include alkanolamine and alkylene glycol. Examples of the fixing accelerator include thiourea derivatives disclosed in JP-B-45-35754, JP-B-58-122535 and JP-B-58-122536, alcohol having a triple bond in the molecule, thioether compounds disclosed in U.S. Pat. No. 4,126,459, mesoionic compounds disclosed in JP-A-4-229860, and compounds disclosed in JP-A-2-44355.

Examples of the pH buffer for use in the fixing solution include an organic acid such as acetic acid, malic acid, succinic acid, tartaric acid, citric acid, maleic acid, glycol acid and adipic acid, an inorganic acid such as boric acid, phosphate and sulfite. Among these, preferred are acetic acid, tartaric acid, and sulfite.

The pH buffer is used so as to inhibit the pH increase of the fixing solution by incorporation of the developer. The pH buffer is used in an amount of from 0.01 to 1.0 mol/l, preferably from 0.02 to 0.6 mol/l.

The pH of the fixing solution is generally 3.8 or more, preferably from 4.0 to 6.5, and more preferably from 4.5 to 6.0.

As a dye dissolution accelerator, the compounds disclosed in JP-A-64-4739 can be used.

As a hardener in the fixing solution for use in the present invention, water-soluble aluminum salts and chromium salts are used. The water-soluble ammonium salt is preferred and examples thereof include aluminum chloride, aluminum sulfate and potassium alum. The amount added of the pH buffer is preferably from 0.01 to 0.2 mol, more preferably from 0.03 to 0.08 mol, per liter of the fixing solution.

The fixing temperature is from about 20° to 50° C., preferably from 25° to 45° C.; and the fixing time is from 5 seconds to one minute, preferably from 7 to 50 seconds.

The replenishing amount of the fixing solution is preferably 600 ml or less, more preferably 500 ml or less, per $m^2$ of the processed photographic material.

In the photographic processing method of the present invention, the photographic material is processed with washing water or a stabilizing solution after the development and fixation steps, and then dried. It is possible to perform the washing or stabilizing step using washing water or a stabilizing solution at a replenishment rate of at most 3 liter of a replenisher per $m^2$ of silver halide photographic material (including the replenishment rate of zero, namely the washing with stored water). That is, not only economizing water in the washing step but also making a piping work unnecessary in setting up an automatic developing machine becomes possible.

As a method for reduction in replenishment of washing water, the multistage (e.g., two-stage, three-stage) counter current process has been known for a long time. If this process is applied to the present invention, the fixation-processed photographic material is processed as it is brought into contact with successive, more and more cleaned processing solutions, that is, processing solutions less and less contaminated with the fixer. Accordingly, more efficient washing can be carried out.

When the washing step is performed with a small amount of water, it is preferred to use a washing tank equipped with squeeze rollers or crossover rollers, as disclosed in JP-A-63-18350 and JP-A-62-287252. Further, the addition of various kinds of oxidizing agents and the filtration may be supplemented for the purpose of reduction in pollution load. An increase in pollution load is a big problem that the washing with little water faces.

In the present invention also, part or all of the overflow generated from the washing or stabilizing bath by replenishing the bath with the water, which is rendered moldproof by the above-cited means, in proportion as the processing proceeds can be used in the prior step wherein the processing solution having a fixability is used, as described in JP-A-60-235133.

Moreover, a water-soluble surfactant or a defoaming agent may be included in washing water to prevent generation of irregular foaming which is liable to generate when washing is conducted with a small amount of water and/or to prevent components of the processing agents adhered to a squeegee roller from transferring to the processed film.

In addition, dye adsorbents disclosed in JP-A-63-163456 may be included in a washing tank to inhibit contamination by dyes dissolved from photographic materials.

When a photographic material is subjected to stabilizing processing after the washing processing, bath containing compounds disclosed in JP-A-2-201357, JP-A-2-132435, JP-A-1-102553 and JP-A-46-44446 may be used as a final bath. This stabilizing bath may contain, if needed, ammonium compounds, metal compounds such as Bi and Al, brightening agents, various kinds of chelating agents, film pH adjustors, hardening agents, sterilizers, antimold agents (e.g., JP-A-62-115154), alkanolamines, surfactants, and washing accelerators (e.g., sulfites). Tap water, deionized water, and water sterilized by a halogen, ultraviolet sterilizing lamp or various oxidizing agents (e.g., ozone, hydrogen peroxide, chlorate) or tap water containing the compounds disclosed in JP-A-4-39652 and JP-A-5-241309 are preferably used as washing water in a washing step or a stabilizing step.

The temperature and time of the washing and stabilizing bath processing are preferably from 0° to 50° C. and from 5 seconds and 2 minutes.

After then, drying is preferably carried out at about 40° to 100° C. for about 5 seconds to 3 minutes and 30 seconds.

The processing solution used in the present invention is preferably stored in a package material slightly pervious to oxygen as disclosed in JP-A-61-73147. Furthermore, the developing may be supplied with the supplying system described in JP-A-62-91939.

When the replenishing amount is lowered, the evaporation and air oxidation of the solution are inhibited by reducing the contact area of the solution and the air of the solution tank. Automatic developing machines of roller conveyance type are described in, e.g., U.S. Pat. Nos. 3,025,779 and 3,545,971, and the present invention refers them to simply as processors of roller conveyance type. A processor of roller conveyance type involves four processes, namely development, fixation, washing and drying processes. Also, it is most advantageous for the present method to follow those four processes, although the present method does not exclude other processes (e.g., stop process). The four processes may contain a stabilizing step in place of the washing step. In the washing step, a method for reduction in replenishment of washing water can be applied using a multistage (e.g., two-stage or three-stage) counter current process.

The components in which water is removed from the compositions of the developer or fixer may be provided as a solid, and the solid may be dissolved in water to be ready for use for the developer or fixer. The processing agent in such a form is called a solid-form processing agent (solid processing agent). The solid-form processing agent in the form of powder, tablet, granule, mass or paste may be used. A preferred form is a form as described in JP-A-61-259921 or a tablet form. The tablet can be produced by a general process, for example, as described in JP-A-51-61837, JP-A-54-155038, JP-A-52-88025, U.K. Patent No. 1,213,808, or the like. The granule may be produced by a general process, for example, as described in JP-A-2-109042, JP-A-2-109043, JP-A-3-39735, JP-A-3-39739, or the like. Moreover, the power processing agent may be produced by a general process, for example, as described in JP-A-54-133332, U.K. patent Nos. 725,892 and 729,862, German patent No. 3,733,861.

The bulk density of the solid-form processing agent is preferably in the range of from 0.5 to 6.0 g/cm$^3$, and particularly from 1.0 to 5.0 g/cm$^3$, from the viewpoints of the solubility and the object of the present invention.

The solid-form processing agent may be a solid processing agent, wherein the solid processing agent contains at least two mutually reactive granular substances; the two mutually reactive granular substances are separated by at least one intercalary separation layer containing an inert substance to the two mutually reactive substances; a bag which can be vacuum-packed is used as a coating material; the air in the bag is exhausted; and the exhausted bag is sealed. In this case, the term "inert" means the state where when the substances are physically brought in contact with each other, they are not reacted under normal conditions or no marked reaction occurs even if any reaction occurs. Apart from the fact that the inert substance is inert to the two mutually reactive substances, the inert substance may be inert in the intended use of the two reactive substances. Furthermore, it is a substance which can be simultaneously used together with two mutually reactive substances. For instance, hydroquinone and sodium hydroxide are reacted with each other when they are bought in contact with each other. By using sodium sulfite as a layer for separating hydroquinone and sodium hydroxide, it is possible to store the solid-form processing agent in a package over a prolonged period. Inert plastic films, bags made of a laminate of a plastic substance a metal foil are used as packaging materials for vacuum packaging.

The photographic materials of the present invention are not particularly restricted as to additives, and so various kinds of additives can be used therein. However, those disclosed in the following patent specifications can be preferably added thereto.

| Item | Reference and Passage therein |
|---|---|
| 1) Surfactants and Antistatic agents | JP-A-2-12236, at page 9, from right upper column, line 7, to right lower column, line 7; and JP-A-2-185424, from page 2, left lower column, line 13, to page 4, right lower column, line 18. |
| 2) Antifoggants and Stabilizers | JP-A-2-103536, from page 17, right lower column, line 19, to page 18, right upper column, line 4, and page 18, right lower column, from line 1 to line 5; the thiosulfinic acid compounds disclosed in JP-A-1-237538. |
| 3) Polymer latexes | JP-A-2-103536, page 18, left lower column, from line 6 to line 20. |
| 4) Compounds containing an acidic group | JP-A-2-103536, from page 18, left lower column, line 6, to page 19, left upper column, line |
| 5) Matting agents, Slipping agents, | JP-A-2-103536, at page 19, from left upper column, line 15, to |

-continued

| Item | Reference and Passage therein |
|---|---|
| and Plasticizers | right upper column, line 15. |
| 6) Hardeners | JP-A-2-103536, at page 18, right upper column, from line 5 to line 17. |
| 7) Dyes | JP-A-2-103536, at page 17, right lower column, from line 1 to line 18; the solid dyes disclosed in JP-A-2-294638 and JP-A-5-11382. |
| 8) Binders | JP-A-2-18542, at page 3, right lower column, from line 1 to line 20. |
| 9) Black spot inhibitors | The compounds disclosed in U.S. Pat. No. 4,956,257 and JP-A-1-118832. |
| 10) Redox compounds | The compounds represented by formula (I) disclosed in JP-A-2-301743 (especially Compounds 1 to 50); the compounds represented by formula (R-1), (R-2) and (R-3), Exemplified Compounds 1 to 75, disclosed at pages 3 to 20 in JP-A-3-174143; the compounds disclosed in JP-A-5-257239 and JP-A-4-278939. |
| 11) Monomethine compounds | The compounds represented by formula (II) in JP-A-2-287532 (especially Exemplified Compounds II-1 to II-26). |
| 12) Dihydroxybenzenes | The compounds disclosed in JP-A-3-39948, from page 11, left upper column to page 12, left lower column, and those disclosed in |
| 13) Spectral sensitizing dyes | Spectral sensitizing dyes disclosed in JP-A-2-12236, from page 8, left lower column, line 13 to right lower column, line 4; JP-A-2-103536, from page 16, right lower column, line 3 to page 17, left lower column, line 20; JP-A-1-112235; JP-A-2-124560; JP-A-3-7928; and JP-A-5-11389. |
| 14) Nucleation accelerators | The compounds represented by formulae (I), (II), (III), (IV), (V) and (VI) disclosed in JP-A-6-82943; the compounds represented by formulae (II-m) to (II-p), and Exemplified Compounds II-1 to II-22, disclosed in JP-A-2-103536, from page 9, right upper column, line 13, to page 16, left upper column, line 10; the compounds disclosed in JP-A-1-179939. |

The present invention will be explained below in more detail by reference to Examples, but the invention should not be construed as being limited thereto.

EXAMPLES 1-1 TO 1-10

The following nucleating agents were used as comparative compounds for nucleating agents according to the present invention.

Comparative Compound A

Comparative Compound A

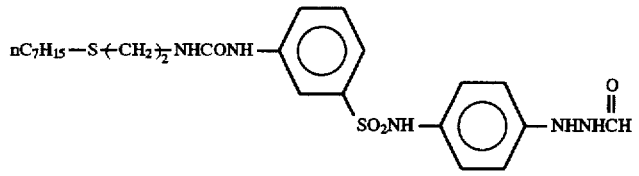

Comparative Compound B

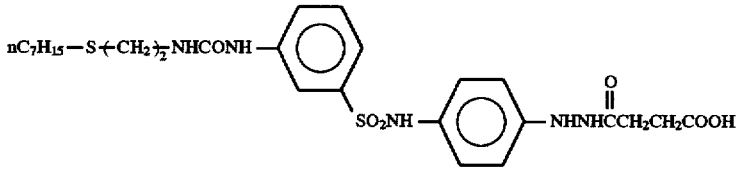

Comparative Compound C

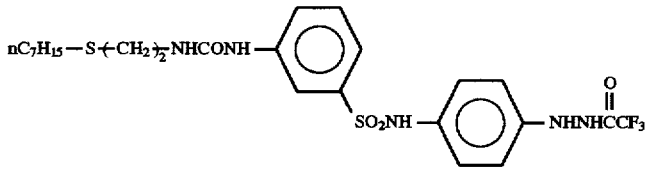

Comparative Compound D

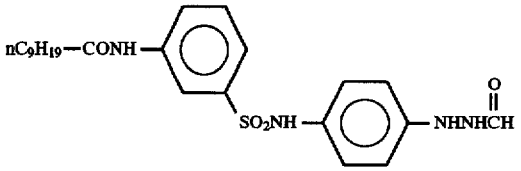

-continued

Comparative Compound E

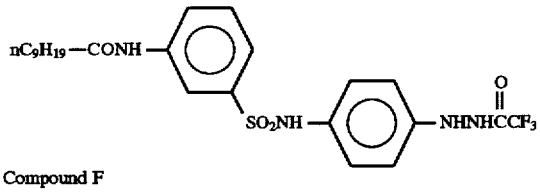

Comparative Compound F

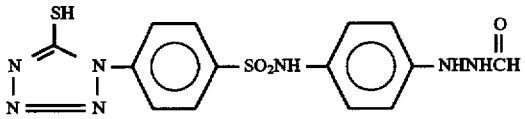

Comparative Compound G

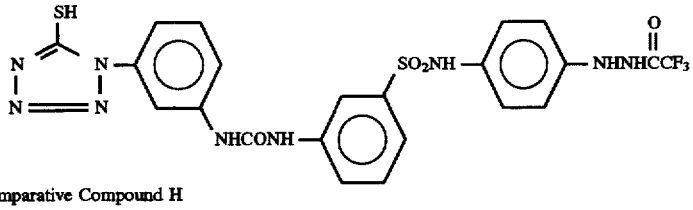

Comparative Compound H

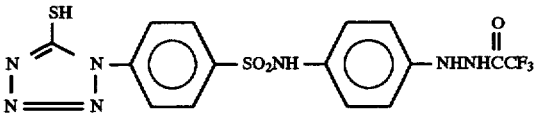

EXAMPLE 1-1

<Production of Silver Halide Photographic Materials>

Preparation of Emulsion:

Emulsion A was prepared by the following method.

[Emulsion A]

An aqueous solution of silver nitrate and an aqueous halogen salt solution containing potassium bromide, sodium chloride, $3.5\times10^{-7}$ mol of $K_3IrCl_6$ per mol of silver, and $2.0\times10^{-7}$ mol of $K_2Rh(H_2O)Cl_5$ per mol of silver were added with stirring to an aqueous gelatin solution containing sodium chloride and 1,3-dimethyl-2-imidazolidinethione by the double-jet method to prepare silver chlorobromide grains having an average grain size of 0.25 μm and a silver chloride content of 70 mol %.

The silver chlorobromide grains were then washed with water by the flocculation method in an ordinary way. Thereto was added 40 g of gelatin per mol of silver, followed by 7 mg of sodium benzenethiosulfonate and 2 mg of benzenesulfinic acid per mol of silver. Thereafter, the resulting mixture was regulated to have a pH of 6.0 and a pAg of 7.5, and 2 mg of sodium thiosulfate and 4 mg of chloroauric acid were added per mol of silver to conduct chemical sensitization so as to result in an optimum-sensitivity temperature of 60° C. To this mixture was added 150 mg of 4-hydroxy-6-methyl-1,3,3a,7-tetrazaindene as a stabilizer, followed by 100 mg of Proxcel as an antiseptic. The grains thus obtained were cubic silver chlorobromide grains having an average grain size of 0.25 μm and a silver chloride content of 70 mol % (coefficient of variation, 10%).

Production of Samples by Coating:

A poly(ethylene terephthalate) film support having a moistureproof undercoat containing vinylidene chloride was coated to form a UL layer, an EM layer, a PC layer, and an OC layer on the support in this order. Thus, samples were produced.

The coating fluid used for forming each layer was prepared by the following method and applied in the amount shown below.

(UL layer)

A dispersion of poly(ethyl acrylate) was added to an aqueous gelatin solution in such a proportion that the amount of the poly(ethyl acrylate) was 30 wt % based on the amount of the gelatin. This mixture was applied at a spread rate of gelatin of 0.5 g/m$^2$.

(EM layer)

To emulsion A described above were added, as sensitizing dyes, $5\times10^{-4}$ mol of compound (S-1) and $5\times10^{-4}$ mol of compound (S-2), each shown later, per mol of silver. To this mixture were added $3\times10^{-4}$ mol of mercapto compound (a), $4\times10^{-4}$ mol of mercapto compound (b), $4\times10^{-4}$ mol of triazine compound (c), $2\times10^{-3}$ mol of 5-chloro-8-hydroxyquinoline, $5\times10^{-4}$ mol of compound (p), and $4\times10^{-4}$ mol of compound (A) as a nucleation accelerator per mol of silver, the compounds (a), (b), (c), (p), and (A) being shown later. Thereto were further added 100 mg of hydroquinone and the sodium salt of N-oleyl-N-methyltaurine in such an amount as to result in a spread rate of this salt of 30 mg/m$^2$. To this mixture were added $1\times10^{-5}$ mol/m$^2$ of a nucleating agent (hydrazine derivative) shown in Table 1, 200 mg/m$^2$ of an aqueous latex of polymer (d), 200 mg/m$^2$ of a dispersion of poly(ethyl acrylate), 200 mg/m$^2$ of a latex of a copolymer of methyl acrylate, sodium 2-acrylamido-2-methylpropanesulfonate, and 2-acetoacetoxyethyl methacrylate (88:5:7 by weight), 200 mg/m$^2$ of a colloidal silica having an average particle diameter of 0.02 μm, and 200 mg/m$^2$ of 1,3-divinylsulfonyl-2-propanol as a hardener. The pH of the solution was adjusted to 5.65 with acetic acid. The coating fluid thus prepared was applied at a spread rate of silver of 3.5 g/m$^2$.

(PC layer)

A dispersion of ethyl polyacrylate was added to an aqueous gelatin solution in such a proportion that the amount of the ethyl acrylate was 50 wt % based on the amount of the gelatin. Thereto were added surfactant (w) shown later and 1,5-dihydroxy-2-benzaldoxime in amounts of 5 mg/m$^2$ and 10 mg/m$^2$, respectively, in terms of spread rate thereof. The coating fluid thus prepared was applied at a spread rate of gelatin of 0.5 g/m$^2$.

(OC layer)

A coating fluid was applied to form a layer comprising 0.5 g/m$^2$ of gelatin, 40 mg/m$^2$ of an amorphous-$SiO_2$ matting agent having an average particle size of about 3.5 μm, 0.1 g/m$^2$ of methanol silica, 100 mg/m$^2$ of polyacrylamide, 20 mg/m$^2$ of a silicone oil, 5 mg/m$^2$ of the fluorine-compound surfactant represented by structural formula (e) given below as a coating aid, and 100 mg/m$^2$ of sodium dodecylbenzenesulfonate.

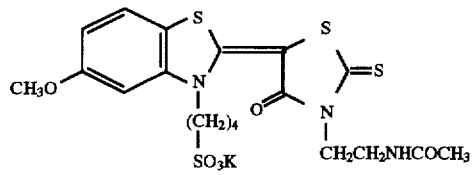
(S-1)

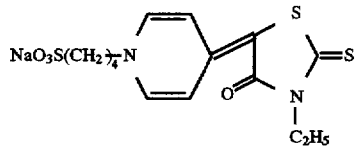
(S-2)

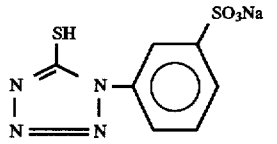
(a)

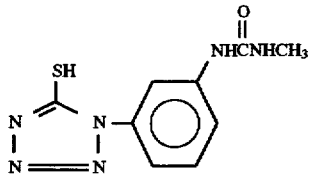
(b)

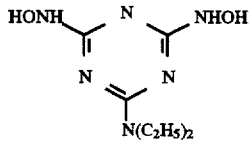
(c)

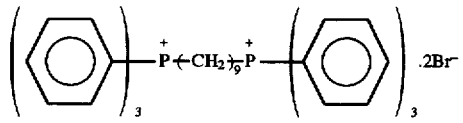
(A)

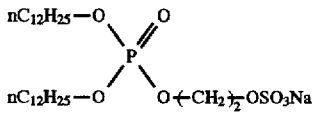
(p)

-continued

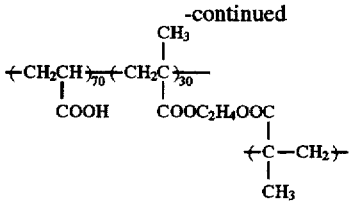
(d)

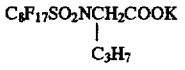
(e)

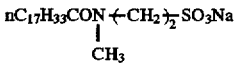
(w)

These samples thus obtained by coating each had a back layer and a back-protective layer each having the following composition.

| [Formulation for back layer] | |
|---|---|
| Gelatin | 3 g/m$^2$ |
| Poly(ethyl acrylate) latex | 2 g/m$^2$ |
| Surfactant, sodium p-docecylbenzenesulfonate | 40 mg/m$^2$ |
| $CH_2{=}CHSO_2CH_2CONH$ ┐ (CH$_2$)$_2$ $CH_2{=}CHSO_2CH_2CONH$ ┘ | 110 mg/m$^2$ |
| $SnO_2$/Sb (90/10 by weight; average particle diameter 0.20 μm) | 200 mg/m$^2$ |
| Dye mixture | |
| Dye [a$_1$] | 70 mg/m$^2$ |
| Dye [b$_1$] | 70 mg/m$^2$ |
| Dye [c$_1$] | 90 mg/m$^2$ |

Dye [a$_1$]

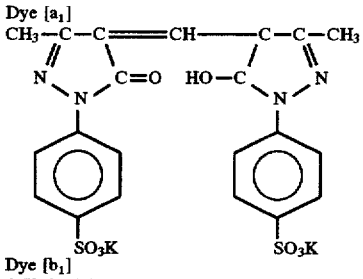

Dye [b$_1$]

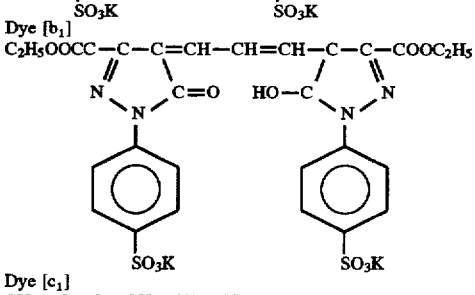

Dye [c$_1$]

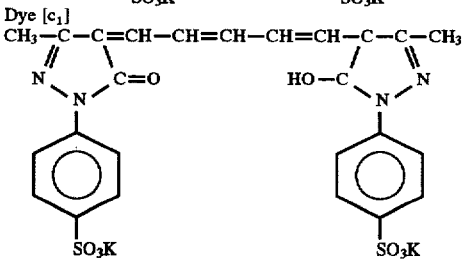

| [Back-protective layer] | |
|---|---|
| Gelatin | 0.8 mg/m$^2$ |
| Fine poly(methyl methacrylate) particles (average particle diameter, 4.5 μm) | 30 mg/m$^2$ |
| Sodium dihexyl α-sulfosuccinate | 15 mg/m$^2$ |
| Sodium p-dodecylbenzenesulfonate | 15 mg/m$^2$ |
| Sodium acetate | 40 mg/m$^2$ |

<Evaluation of Photographic Performances>

(1) Exposure and Processing

The samples described above were exposed to xenon flash light for $10^{-5}$ sec through an interference filter having a peak at 488 nm and through a step wedge. The exposed samples were developed with developing solution A having the following composition at 35° C. for 30 seconds, and then subjected to fixing, washing, and drying.

| Developing solution A: | |
|---|---|
| Potassium hydroxide | 35.0 g |
| Diethylenetriaminepentaacetic acid | 2.0 g |
| Potassium carbonate | 12.0 g |
| Sodiuin metabisulfite | 40.0 g |
| Potassium bromide | 3.0 g |
| Hydroquinone | 25.0 g |
| 5-Methylbenzotriazole | 0.08 g |
| 4-Hydroxymethyl-4-methyl-1-phenyl-3-pyrazolidone | 0.45 g |
| 2,3,5,6,7,8-Hexahydro-2-thioxo-4-(1H)-quinazolinone | 0.04 g |
| Sodium 2-mercaptobenzimidazole-5-sulfonate | 0.15 g |
| Sodium erythorbate | 3.0 g |
| Potassium hydroxide and water were added to adjust the total volume to 1 liter and the pH to 10.5. | |

Potassium hydroxide and water were added to adjust the total volume to 1 liter and the pH to 10.5.

A fixing solution prepared according to the following formulation was used.

| (Formulation for fixing solution) | |
|---|---|
| Ammonium thiosulfate | 359.1 ml |
| Disodium ethylenediaminetetraacetate dihydride | 2.26 g |
| Sodium thiosulfate pentahydrate | 32.8 g |
| Sodium sulfite | 64.8 g |
| NaOH | 37.2 g |
| Glacial acetic acid | 87.3 g |
| Tartaric acid | 8.76 g |
| Sodium gluconate | 6.6 g |
| Aluminum sulfate | 25.3 g |
| pH (adjusted with sulfuric acid or sodium hydroxide) | 4.85 |
| Water was added to adjust the total volume to 1 liter. | |

Water was added to adjust the total volume to 1 liter.

(2) Evaluation of Image Contrast

The contrast of an image is shown in terms of gamma value, which is determined from a characteristic curve and indicates the inclination of the straight line drawn between the point (fog+density 0.1) and the point (fog+density 3.0). Namely, gamma=(3.0−0.1)/[log(exposure giving a density of 3.0)—log(exposure giving a density of 0.1)]. Higher gamma values indicate higher-contrast photographic performances. Photographic materials for graphic arts use desirably have a gamma value of 10 or higher, preferably 15 or higher.

(3) Evaluation of Storage Stability

The samples produced by coating were allowed to stand under conditions of 60° C. and 65% for 3 days.

(i) Determination of Percentage of Residual Nucleating Agent

The nucleating agent was extracted with an organic solvent from each of these aged samples and from the corresponding sample just after coating, and the amounts of the extracted nucleating agent were determined by HPLC.

Percentage of residual nucleating agent (%)=[(amount of nucleating agent extracted from the sample aged at 60° C., 65% for 3 days)/(amount of nucleating agent extracted from the sample just after coating)]×100.

(ii) Sensitivity Change

The aged samples and the samples just after coating were subjected to processing to measure the sensitivities thereof. From the sensitivities, sensitivity changes ($\Delta S_{1.5}$) were calculated.

Sensitivity ($S_{1.5}$): logarithm of exposure giving a density of 1.5

→The lower the value, the higher the sensitivity.

$\Delta S_{1.5}$=($S_{1.5}$ of the sample just after coating)−($S_{1.5}$ of the sample aged at 60° C., 65% for 3 days)

→The lower the value, the more the sensitivity tends to be low.

TABLE 1

| | | Storage stability | | | |
|---|---|---|---|---|---|
| Run No. | Nucleating agent | Gamma (γ) | Percentage of residual nucleating agent (%) | $\Delta S_{1.5}$ | Remarks |
| 1 | Comparative Compound A | 7.2 | 92 | −0.01 | Comparison |
| 2 | Comparative Compound B | 7.5 | 93 | −0.01 | " |
| 3 | Comparative Compound C | 18.9 | 29 | −0.10 | " |
| 4 | 11 | 18.3 | 96 | 0 | Invention |
| 5 | 12 | 17.9 | 95 | 0 | " |
| 6 | 14 | 19.0 | 92 | −0.02 | " |
| 7 | 16 | 17.6 | 93 | −0.01 | " |
| 8 | 17 | 17.7 | 90 | −0.02 | " |
| 9 | 2 | 16.5 | 95 | 0 | " |

Table 1 shows that comparative compounds A and B, although satisfactory in storage stability, had a low nucleating activity and was incapable of giving a gamma of 10 or higher.

On the other hand, comparative compound C, although capable of giving a high gamma, showed poor storage stability and was hence unsuitable for practical use. By using the nucleating agents according to the present invention, photographic materials for use with an argon laser scanner could be obtained which had a high gamma and satisfactory storage stability.

EXAMPLE 1-2

<Production of Silver Halide Photographic Materials>

Preparation of Emulsion:

Emulsion B was prepared by the following method.

[Emulsion B]

The same procedure as for the preparation of emulsion A was carried out, except that the chemical sensitization for obtaining an optimum-sensitivity temperature of 60° C. was conducted by adding 1 mg of the selenium-compound sensitizer represented by the following structural formula, 1 mg of sodium thiosulfate, and 4 mg of chloroauric acid per mol of silver. Thus, emulsion B was prepared.

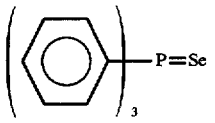

Production of Samples by Coating:

Samples were produced in the same manner as in Example 1-1, except that $2.1\times10^{-4}$ mol of compound (S-3) shown below was used per mol of silver in place of the sensitizing dye for the EM layer, and that emulsion (B) was used as the emulsion for the EM layer.

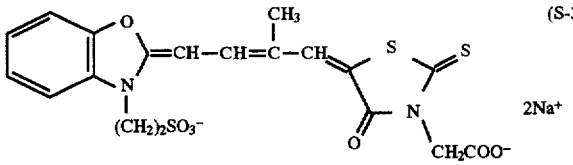

(S-3)

<Evaluation of Photographic Performances>

(1) Exposure and Processing

The samples described above were exposed to xenon flash light for $10^{-6}$ sec through an interference filter having a peak at 633 nm and through a step wedge. The exposed samples were developed with developing solution A, described in Example 1-1, at 35° C. for 30 seconds, and then subjected to fixing (in the same manner as in Example 1-1), washing, and drying.

Image contrast and storage stability were evaluated in the same manner as in Example 1-1.

<Results>

By using the nucleating agents according to the present invention, photographic materials for use with a helium-neon laser scanner could be obtained which had a high gamma and satisfactory storage stability.

EXAMPLE 1-3

<Production of Silver Halide Photographic Materials>

Samples were produced in the same manner as in Example 1-2, except that compound (S-4) shown below was used in place of the sensitizing dye for the EM layer.

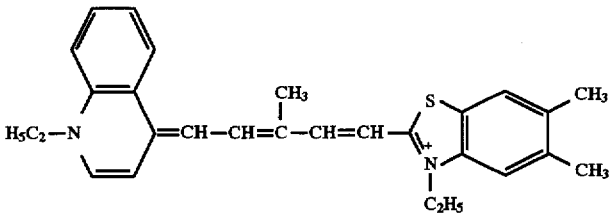

(S-4)

I⁻

<Evaluation of Photographic Performances>

The samples described above were exposed to xenon flash light for $10^{-6}$ sec through an interference filter having a peak at 780 nm and through a step wedge. The exposed samples were developed with developing solution A, described in Example 1-1, at 35° C. for 30 seconds, and then subjected to fixing (in the same manner as in Example 1-1), washing, and drying.

Image contrast and storage stability were evaluated in the same manner as in Example 1-2.

<Results>

By using the nucleating agents according to the present invention, photographic materials for use with a semiconductor laser scanner could be obtained which had a high gamma and satisfactory storage stability.

EXAMPLE 1-4

<Production of Silver Halide Photographic Materials>

Samples were produced in the same manner as in Example 2, except that compound (S-5) shown below was used in place of the sensitizing dye for the EM layer, and that the nucleating agents shown in Table 2 were used.

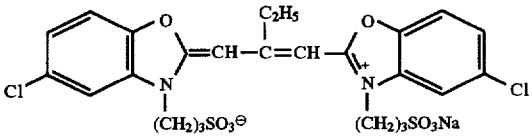

(S-5)

<Evaluation of Photographic Performances>

The samples described above were exposed to 3,200° K. tungsten light through a step wedge. The exposed samples were developed with developing solution A, described in Example 1-1, at 35° C. for 30 seconds, and then subjected to fixing, washing, and drying. The fixing solution used was GR-F1 (manufactured by Fuji Photo Film Co., Ltd.).

Image contrast and storage stability were evaluated in the same manner as in Example 1-2.

TABLE 2

| | | Storage stability | | | |
|---|---|---|---|---|---|
| Run No. | Nucleating agent | Gamma (γ) | Percentage of residual nucleating agent (%) | $\Delta S_{1.5}$ | Remarks |
| 1 | Comparative Compound D | 7.0 | 95 | 0 | Comparison |
| 2 | Comparative Compound E | 19.5 | 47 | −0.08 | " |
| 3 | 1 | 18.6 | 96 | 0 | Invention |
| 4 | 2 | 19.4 | 95 | 0 | " |
| 5 | 4 | 19.0 | 90 | −0.02 | " |
| 6 | 5 | 18.4 | 94 | −0.01 | " |
| 7 | 9 | 18.9 | 95 | 0 | " |

TABLE 2-continued

| Run No. | Nucleating agent | Storage stability: Gamma (γ) | Storage stability: Percentage of residual nucleating agent (%) | $\Delta S_{1.5}$ | Remarks |
|---|---|---|---|---|---|
| 8 | 11 | 19.6 | 96 | 0 | " |
| 9 | 31 | 15.1 | 93 | −0.01 | " |
| 10 | 41 | 12.9 | 92 | −0.02 | " |
| 11 | 42 | 17.0 | 92 | −0.02 | " |

By using the nucleating agents according to the present invention, photographic materials having a high gamma and satisfactory storage stability could be obtained as in example 1-2.

EXAMPLE 1-5

Basically in accordance with the photographic-material constitution given in Example 5 of JP-A-7-43867, a sample containing a hydrazine derivative according to the present invention (Compound Nos. 1, 2, 4, 5, 9, 11, 31, 41 and 42) was produced by coating. This sample was processed and evaluated in the same manner as in Example 1-4.

By using the nucleating agent, a photographic material having a high gamma and satisfactory storage stability could be obtained as in Example 1-4.

EXAMPLE 1-6

<Preparation of Emulsion>

[Emulsion C]

To a 1.5% aqueous gelatin solution which contained sodium chloride and $3\times10^{-5}$ mol of compound (f) shown later per mol of silver and had a pH of 2.0 and the temperature of which was maintained at 40° C. were simultaneously added an aqueous silver nitrate solution and an aqueous sodium chloride solution containing $3.5\times10^{-5}$ mol of $(NH_4)_2Rh(H_2O)Cl_5$ per mol of silver by the double-jet method at a potential of 95 mV over a period of 3 minutes and 30 seconds. Thus, 0.12-μm particles serving as cores were produced. Thereto were added an aqueous silver nitrate solution and an aqueous sodium chloride solution containing $10.5\times10^{-5}$ mol of $(NH_4)_2Rh(H_2O)Cl_5$ per mol of gold in the same manner as the above over a period of 7 minutes. Thus, cubic silver chloride grains having an average grain size of 0.15 μm were produced (coefficient of variation, 12%).

Thereafter, 4-hydroxy-6-methyl-1,3,3a,7-tetrazaindene was added in an amount of $1.5\times10^{-3}$ mol per mol of silver.

The resulting grains were washed with water by the flocculation method, which is well known in the art, to remove soluble salts. Gelatin was then added. To this mixture were added, without chemical ripening, 50 mg of compound (g) shown later as an antiseptic per mol of silver, 50 mg of phenoxyethanol as another antiseptic per mol of silver, and $3\times10^{-3}$ mol of 4-hydroxy-6-methyl-1,3,3a,7-tetrazaindene as a stabilizer per mol of silver (pH=5.7, pAg=7.5, Rh=$6\times10^{-5}$ mol/mol-Ag).

<Preparation of Coating Fluid for Emulsion Layer and Application thereof>

The following compounds were added to emulsion C to prepare a coating fluid, which was applied at a gelatin spread rate of 1.1 g/m² and a silver spread rate of 2.5 g/m² to form a silver halide emulsion layer.

| | |
|---|---|
| 4-Hydroxy-6-methyl-1,3,3a,7-tetrazaindene | 10 mg/m² |
| Sodium salt of N-oleyl-N-methyltaurine | 35 mg/m² |
| Compound (h) | 10 mg/m² |
| Compound (i) | 20 mg/m² |
| n-Butyl acrylate/2-acetoacetoxyethyl methacrylate/acrylic acid copolymer (89/8/3) | 900 mg/m² |
| Compound (j) (hardener) | 150 mg/m² |

Further, 20 mg/m² of nucleation accelerator (k) was added and a nucleating agent was added in the amount shown in Table 3. The amount added of the nucleating agent was the same as that in Example 1-1.

On the emulsion layer described above, emulsion-protective lower and upper layers were formed by coating.

<Preparation of Coating Fluid for Emulsion-protective Lower Layer and Application thereof>

The following compounds were added to an aqueous gelatin solution to prepare a coating fluid, which was applied at a gelatin spread rate of 0.7 g/m².

| | |
|---|---|
| Gelatin ($Ca^{++}$ content, 2,700 ppm) | 0.7 g/m² |
| Sodium p-dodecylbenzenesulfonate | 15 mg/m² |
| Compound (g) | 5 mg/m² |
| Compound (l) | 10 mg/m² |
| Compound (m) | 20 mg/m² |

<Preparation of Coating Fluid for Emulsion-protective Upper Layer and Application thereof>

The following compounds were added to an aqueous gelatin solution to prepare a coating fluid, which was applied at a gelatin spread rate of 0.8 g/m².

| | |
|---|---|
| Gelatin ($Ca^{++}$ content, 2,700 ppm) | 0.8 g/m² |
| Amorphous-silica matting agent (average particle diameter, 3.5 μm; pore diameter, 25 Å; specific surface area, 700 m²/g) | 40 mg/m² |
| Amorphous-silica matting agent (average particle diameter, 2.5 μm; pore diameter, 170 Å; specific surface area, 300 m²/g) | 10 mg/m² |
| Potassium salt of N-perfluorooctanesulfonyl-N-propylglycine | 5 mg/m² |
| Sodium dodecylbenzenesulfonate | 30 mg/m² |
| Compound (g) | 5 mg/m² |
| Solid dispersion dye $G_1$ | 100 mg/m² |
| Solid dispersion dye $G_2$ | 50 mg/m² |

On the back side of the support were then formed the conductive layer and back layer shown below by simultaneous coating.

<Preparation of Coating Fluid for Conductive Layer and Application thereof>

The following compounds were added to an aqueous gelatin solution to prepare a coating fluid, which was applied at a gelatin spread rate of 77 mg/m².

| | |
|---|---|
| $SnO_2$/Sb (9/1 by weight; average particle diameter, 0.25 μm) | 200 mg/m² |
| Gelatin ($Ca^{++}$ content, 3,000 ppm) | 77 mg/m² |
| Sodium dodecylbenzenesulfonate | 10 mg/m² |
| Sodium dihexyl α-sulfosuccinate | 40 mg/m² |
| Sodium polystyrenesulfonate | 9 mg/m² |
| Compound (g) | 7 mg/m² |

<Preparation of Coating Fluid for Back Layer and Application thereof>

The following compounds were added to an aqueous gelatin solution to prepare a coating fluid, which was applied at a gelatin spread rate of 2.92 g/m$^2$.

| | |
|---|---|
| Gelatin ($Ca^{++}$ content, 30 ppm) | 2.92 g/m$^2$ |
| Fine poly(methyl methacrylate) particles (average particle diameter, 3.4 μm) | 54 mg/m$^2$ |
| Compound (h) | 140 mg/m$^2$ |
| Compound (r) | 140 mg/m$^2$ |
| Compound (s) | 40 mg/m$^2$ |
| Sodium dodecylbenzenesulfonate | 75 mg/m$^2$ |
| Sodium dihexyl α-sulfosuccinate | 20 mg/m$^2$ |
| Compound (t) | 5 mg/m$^2$ |
| Potassium salt of N-perfluorooctanesulfonyl-N-propylglycine | 5 mg/m$^2$ |
| Sodium sulfate | 50 mg/m$^2$ |
| Sodium acetate | 85 mg/m$^2$ |

(Support and Undercoat)

A biaxially stretched poly(ethylene terephthalate) support (thickness, 100 μm) was coated on each side with two coating fluids having the following compositions to form a first undercoat layer and a second undercoat layer.

| <First undercoat layer> | |
|---|---|
| Core-shell type vinylidene chloride copolymer (i) | 15 g |
| 2,4-Dichloro-6-hydroxy-s-triazine | 0.25 g |
| Fine polystyrene particles (average particle diameter, 3 μm) | 0.05 g |
| Compound (u) | 0.20 g |
| Colloidal silica (Snowtex ZL, manufactured by Nissan Chemical Industries, Ltd., Japan; particle diameter, 70–100 μm) | 0.12 g |
| Water was added to adjust the total amount to 100 ml | |

Further, 10 wt % KOH solution was added to adjust the pH to 6 to prepare a coating fluid. This coating fluid was applied at a thickness of 0.9 μm on a dry basis, and the coating was dried at 180° C. for 2 minutes.

| <Second undercoat layer> | |
|---|---|
| Gelatin | 1 g |
| Methyl cellulose | 0.05 g |
| Compound (v) | 0.02 g |
| $C_{12}H_{25}O(CH_2CH_2O)_{10}H$ | 0.03 g |
| Compound (g) | $3.5 \times 10^{-3}$ g |
| Acetic acid | 0.2 g |
| Water was added to adjust the total amount to 100 ml | |

This coating fluid was applied at a thickness of 0.1 μm on a dry basis, and the coating was dried at 170° C. for 2 minutes.

(f)

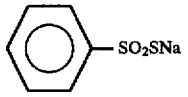

(g)

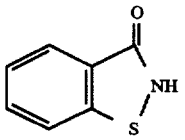

(h)

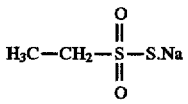

(i)

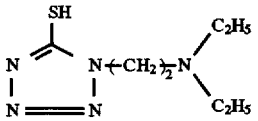

(j)

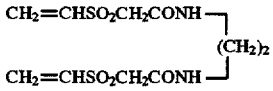

(k)

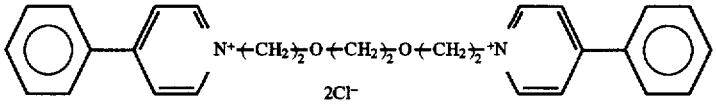

-continued
(l)
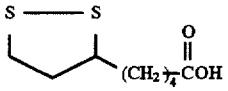
(m)
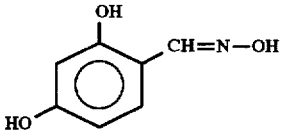
Solid Dispersion Dye $G_1$
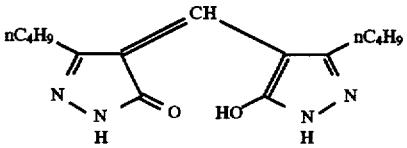
Solid Dispersion Dye $G_2$
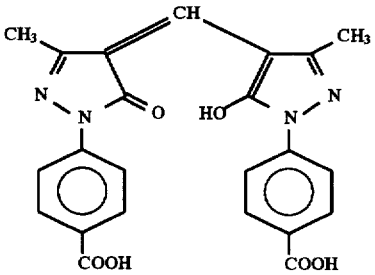
(n)
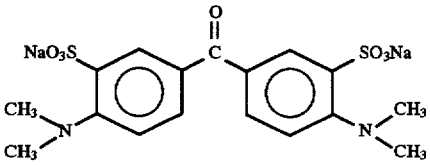
(r)
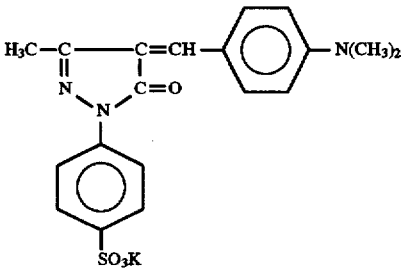
(s)
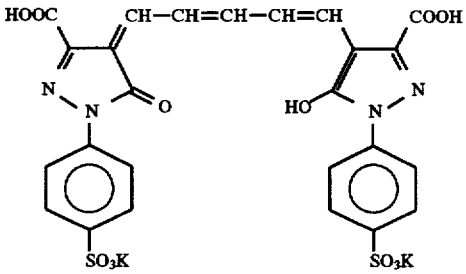
$C_8F_{17}SO_3Li$ (t)

-continued

Core-shell Type vinylidene chloride copolymer (i)

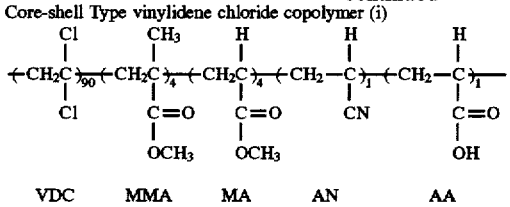

VDC MMA MA AN AA

Core: VDC/MMA/MA (80% by weight)
Shell: VDC/AN/AA (20% by weight)
Average particle size: 70 nm

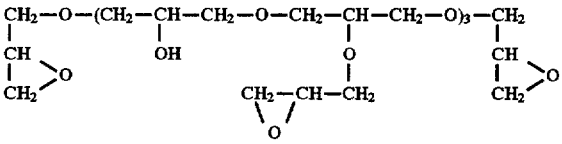

(u)

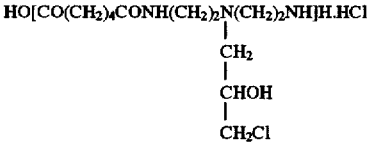

(v)

<Evaluation of Photographic Performances>

(1) Exposure and Processing

The samples thus obtained were exposed with printer P-627FM, manufactured by Dainippon Screen Mfg. Co., Ltd., Japan, through an optical wedge. Using automatic processor FG680AG, manufactured by Fuji Photo Film Co., Ltd., the exposed samples were processed with developing solution A, used in Example 1-1, at 38° C. for 20 seconds, and subjected to fixing, washing, and drying. The fixing solution used was the same as in Example 1-1.

Image contrast and storage stability were evaluated in the same manner as in Example 1-1.

TABLE 3

| Run No. | Nucleating agent | Storage stability: Gamma (γ) | Storage stability: Percentage of residual nucleating agent (%) | Storage stability: $\Delta S_{1.5}$ | Remarks |
|---|---|---|---|---|---|
| 1 | Comparative Compound F | 9.1 | 90 | −0.01 | Comparison |
| 2 | Comparative Compound G | 14.3 | 53 | −0.07 | " |
| 3 | Comparative Compound H | 19.6 | 59 | −0.06 | " |
| 4 | 19 | 15.0 | 94 | 0 | Invention |
| 5 | 20 | 20.2 | 98 | 0 | " |
| 6 | 24 | 16.7 | 91 | −0.02 | " |
| 7 | 28 | 18.3 | 90 | −0.02 | " |
| 8 | 39 | 17.6 | 97 | 0 | " |
| 9 | 43 | 18.5 | 93 | −0.01 | " |
| 10 | 44 | 19.0 | 92 | −0.02 | " |
| 11 | 46 | 19.8 | 98 | 0 | " |
| 12 | 14 | 17.9 | 92 | −0.02 | " |

By using the nucleating agents according to the present invention, light-sensitive materials for dot-to-dot working in illuminated room having a high gamma and satisfactory storage stability could be obtained.

EXAMPLE 1-7

The photographic materials produced in Examples 1-1 to 1-6 were processed under the same conditions as in each Example, except that developing solution B or C described below was used in place of developing solution A.

| Developing solution B: | |
|---|---|
| Potassium hydroxide | 35 g |
| Diethylenetriaminepentaacetic acid | 2 g |
| Potassium carbonate | 100 g |
| Potassium bromide | 3 g |
| 5-Methylbenzotriazole | 0.08 g |
| Sodium 2-mercaptobenzimidazole-5-sulfonate | 0.15 g |
| 2,3,5,6,7,8-Hexahydro-2-thioxo-4-(1H)-guinazolinone | 0.03 g |
| Sodium metabisulfite | 54 g |
| 4-Hydroxymethyl-4-methyl-1-phenyl-3-pyrazolidone | 0.45 g |
| Hydroquinone | 30 g |
| Sodium erythorbate | 3 g |
| Water was added to adjust the total volume to 1 liter, and pH was adjusted to 10.5. | |
| **Developing solution C:** | |
| Sodium hydroxide | 10.0 g |
| Diethylenetriaminepentaacetic acid | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |
| Sodium 2-mercaptobenzimidazole-5-sulfonate | 0.15 g |
| 4-Hydroxymethyl-4-methyl-1-phenyl-3-pyrazolidone | 0.40 g |
| Sodium erythorbate | 30.0 g |
| Potassium hydroxide and water were added to adjust the total volume to 1 liter and the pH to 10.7. | |

Developing solution B was prepared from ingredients which had been stored in a solid state.

These solid developing ingredients had been packed in a bag comprising an aluminum foil coated with a plastic material, by superposing within the bag the developing ingredients into layers in the following order from the top:

| | |
|---|---|
| first layer | hydroquinone |
| second layer | other ingredients |
| third layer | sodium bisulfite |
| fourth layer | potassium carbonate |
| fifth layer | potassium hydroxide pellets, |

and sealing the bag after the gases within the bag were discharged in an ordinary manner.

<Results>

The same results as in Examples 1-1 to 1-6 were obtained even when developing solution B or C was used in the processing in those Examples.

EXAMPLE 1-8

An internal latent image tape direct positive silver bromide emulsion in which the inner parts of the grains had been chemically sensitized with sulfur and gold and the surfaces of the grains had been chemically sensitized with sulfur was produced by the method described in JP-A-60-95533. The emulsion grains were 1.0-μm octahedral grains. To this emulsion was added a compound according to the present invention or the compound J disclosed in U.S. Pat. No. 3,759,901 as a comparative compound. Each coating composition was applied to a cellulose acetate film support at a silver spread rate of 4.4 g/m$^2$ and a gelatin spread rate of 4.9 g/m$^2$, and the resulting emulsion layer was covered with a protective layer (gelatin spread rate, 0.8 g/m$_2$). These samples obtained by coating were exposed to 1,000-lx tungsten light for 1/10 second through a continuous tone wedge. The exposed samples were processed with developing solution X having the following composition (surface-developing solution; pH=13.5). The maximum density ($D_{max}$) and minimum density ($D_{min}$) of the direct reversal image obtained on each sample are shown in Table 4.

| Developing solution X: | |
|---|---|
| Sodium sulfite | 30 g |
| Hydroquinone | 10 g |
| 1-Phenyl-4-methyl-4-hydroxymethyl-3-pyrazolidine | 0.75 g |
| Trisodium phosphate | 40 g |
| Sodium hydroxide | 10.7 g |
| 5-Methylbenzotriazole | 0.02 g |
| Water was added to adjust the total volume to 1 liter | |

TABLE 4

| Nucleating agent | Amount (mmol/mol Ag) | $D_{max}$ | $D_{min}$ | Remarks |
|---|---|---|---|---|
| none | — | 0.07 | 0.07 | Comparison |
| Compound (1) | 0.004 | 1.65 | 0.06 | Invention |
| Compound (20) | 0.004 | 1.91 | 0.08 | Invention |
| Compound (27) | 0.004 | 1.73 | 0.07 | Invention |
| Compound J | 0.4 | 1.24 | 0.07 | Comparison |

TABLE 4-continued

| Nucleating agent | Amount (mmol/mol Ag) | $D_{max}$ | $D_{min}$ | Remarks |
|---|---|---|---|---|

Comparative Compound J

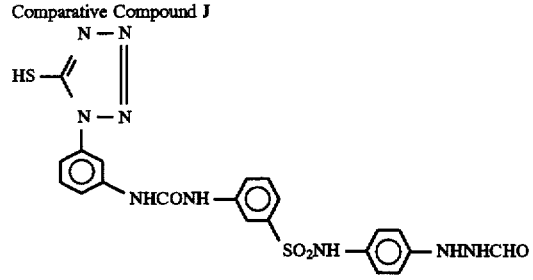

Table 4 shows that the compounds according to the present invention were effective even in a smaller addition amount than the comparative compound and showed a satisfactory reversal effect.

EXAMPLE 1-9

To the same internal latent image type direct positive emulsion as in Example 1-8 was added a compound according to the present invention shown in Table 10 or a comparative compound shown in Table 10. Using these coating compositions, samples similar to those obtained in Example 1-8 were obtained by coating. These samples were image-wise exposed under the same conditions as in Example 1-8. The exposed samples were processed with developing solution Y, having a lower pH than developing solution X and having the following composition (pH=10.7). The maximum density ($D_{max}$) and minimum density ($D_{min}$) of the direct reversal image obtained on each sample are shown in Table 5.

| Developing solution Y: | |
|---|---|
| Sodium sulfite | 30 g |
| Hydroquinone | 10 g |
| 1-Phenyl-4-methyl-4-hydroxmethyl-3-pyrazolidine | 0.75 g |
| Trisodium phosphate | 40 g |
| 5-Methylbenzotriazole | 0.02 g |
| Water was added to adjust the total volume to 1 liter | |

TABLE 5

| Nucleating agent | Amount (mmol/mol Ag) | $D_{max}$ | $D_{min}$ | Remarks |
|---|---|---|---|---|
| none | — | 0.04 | 0.04 | Comparison |
| Compound (19) | 0.095 | 1.91 | 0.05 | Invention |
| Compound (20) | 0.095 | 1.84 | 0.03 | Invention |
| Compound (24) | 0.095 | 2.05 | 0.05 | Invention |
| Compound (26) | 0.095 | 1.96 | 0.03 | Invention |
| Compound J | 1.0 | 1.54 | 0.04 | Comparison |
| Compound K | 1.0 | 1.77 | 0.05 | Comparison |
| Compound L | 1.0 | 1.72 | 0.04 | Comparison |

Comparative Compound K (described in U.S. Pat. No. 3,759,901)

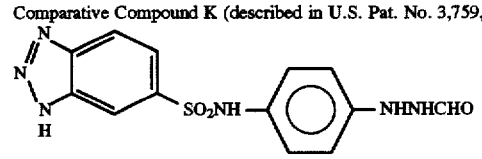

TABLE 5-continued

| Nucleating agent | Amount (mmol/mol Ag) | $D_{max}$ | $D_{min}$ | Remarks |
|---|---|---|---|---|

Comparative Compound L (described in U.S. Pat. No. 3,719,494)

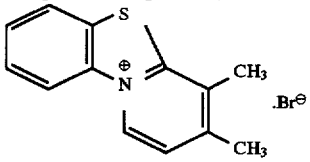

Table 5 shows that the compounds according to the present invention exhibited a satisfactory reversal effect even at a low pH and even when used in a smaller amount than the comparative compounds.

EXAMPLE 1-10

Production of Sample 501:

A paper support (thickness, 100 μm) having a laminated polyethylene layer on each side was coated on the front side with the first to nineth layers shown below and on the back side with the tenth and eleventh layers shown below to produce a color photographic material. The laminated polyethylene layer on the front side contained titanium oxide (4 g/m$^2$) as a white pigment and a slight amount (0.003 g/m$^2$) of ultramarine as a blue dye (the support surface had a chromaticity of 88.0, –0.20, and –0.75 in the L*a*b* color space).

(Light-sensitive Layer Composition)

The ingredients and spread rates thereof (unit, g/m$^2$) for each layer are shown below, provided that the addition amount of each sensitizing dye is shown in terms of mol per mol of silver. With respect to silver halides, the spread rates thereof are given in terms of silver amount. The emulsion used for each emulsion layer was produced according to the "Production of Emulsion EM-1" given later; grain size regulation was accomplished by changing temperature. With respect to the emulsion for the nineth layer, a Lippmann emulsion which had not undergone surface chemical sensitization was used.

| | |
|---|---|
| **First layer (antihalation layer):** | |
| Black colloidal silver | 0.10 |
| Color mixing inhibitor (Cpd-7) | 0.05 |
| Color mixing inhibitor solvents (Solv-4, 5 in the same amount) | 0.12 |
| Gelatin | 0.70 |
| **Second layer (intermediate layer):** | |
| Gelatin | 1.40 |
| Dye (Cpd-32) | 0.005 |
| **Third layer (red-sensitive layer):** | |
| Silver bromide (average grain size, 0.40 μm; grain size distribution, 10%; octahedral grains) spectrally sensitized with red-sensitizing dyes (ExS-1, 2, 3) in the same amount, with the total amount being 5.4 × 10$^{-4}$) | 0.25 |
| Gelatin | 0.70 |
| Cyan couplers (ExC-1, 2, 3 in a ratio of 1:1:0.2) | 0.30 |
| Fading inhibitors (Cpd-1, 2, 3, 4, 30 in the same amount) | 0.18 |
| Anti-stain agent (Cpd-5, 15 in the same amount) | 0.003 |
| Coupler-dispersing medium (Cpd-6) | 0.30 |
| Coupler solvents (Solv-1, 3, 5 in the same amount) | 0.30 |
| **Fourth layer (intermediate layer):** | |
| Gelatin | 1.00 |
| Color mixing inhibitor (Cpd-7) | 0.08 |
| Color mixing inhibitor solvents (Solv-4, 5 in the same amount) | 0.16 |
| Polymer latex (Cpd-8) | 0.10 |
| Dye (Cpd-33) | 0.25 |
| **Fifth layer (green-sensitive layer):** | |
| Silver bromide (average grain size, 0.40 μm; grain size distribution, 10%; octahedral grains) spectrally sensitized with a green-sensitizing dye (ExS-4, 2.6 × 10$^{-4}$) | 0.20 |
| Gelatin | 1.00 |
| Magenta couplers (ExM-1, 2 in the same amount) | 0.30 |
| Yellow coupler (ExY-1) | 0.06 |
| Fading inhibitors (Cpd-9, 26, 30, 31 in the same amount) | 0.15 |
| Anti-stain agents (Cpd-10, 11, 12, 13 in a ratio of 10:7:7:1) | 0.025 |
| Coupler-dispersing medium (Cpd-6) | 0.05 |
| Coupler solvents (Solv-4, 6 in the same amount) | 0.60 |
| **Sixth layer (yellow filter layer):** | |
| Gelatin | 1.00 |
| Dye (Cpd-34) | 0.10 |
| Color mixing inhibitor (Cpd-7) | 0.08 |
| Color mixing inhibitor solvents (Solv-4, 5 in the same amount) | 0.16 |
| **Seventh layer (blue-sensitive layer):** | |
| Silver bromide (average grain size, 0.60 μm; grain size distribution, 11%; octahedral grains) spectrally sensitized with blue-sensitizing dyes (ExS-5, 6 in the same amount, with the total amount being 3.5 × 10$^{-4}$) | 0.32 |
| Gelatin | 0.80 |
| Yellow couplers (ExY-2, 3 in the same amount) | 0.60 |
| Fading inhibitor (Cpd-14) | 0.10 |
| Fading inhibitor (Cpd-30) | 0.05 |
| Anti-stain agents (Cpd-5, 15 in a ratio of 1:5) | 0.007 |
| Coupler-dispersing medium (Cpd-6) | 0.05 |
| Coupler solvent (Solv-2) | 0.29 |
| **Eighth layer (layer containing ultraviolet absorbers):** | |
| Gelatin | 0.60 |
| Ultraviolet absorbers (Cpd-2, 4, 16 in the same amount) | 0.40 |
| Color mixing inhibitors (Cpd-7, 17 in the same amount) | 0.03 |
| Dispersing medium (Cpd-6) | 0.02 |
| Ultraviolet absorber solvents (Solv-2, 7 in the same amount) | 0.08 |
| Anti-irradiation dyes (Cpd-18, 19, 20, 21, 27 in a ratio of 10:10:13:15:20) | 0.05 |
| **Ninth layer (protective layer):** | |
| Fine silver iodobromide grains (silver bromide, 99 mol %; average grain size, 0.05 μm) | 0.05 |
| Acrylic-modified poly(vinyl alcohol) copolymer (molecular weight, 50,000) | 0.01 |
| Poly(methyl methacrylate) particles (average particle size, 2,4 μm) and silicon oxide (average particle size, 5 μm) in the same amount | 0.05 |
| Gelatin | 0.05 |
| Gelatin hardeners (H-1, H-2 in the same amount) | 0.18 |

-continued

| Tenth layer (back layer): | |
|---|---|
| Gelatin | 2.50 |
| Ultraviolet absorbers (Cpd-2, 4, 16 in the same amount) | 0.50 |
| Dyes (Cpd-18, 19, 20, 21, 27 in the same amount) | 0.06 |
| **Eleventh layer (back layer-protective layer):** | |
| Poly(methyl methacrylate) particles (average particle size, 2,4 μm) and silicon oxide (average particle size, 5 μm) in the same amount | 0.05 |
| Gelatin | 2.00 |
| Gelatin hardeners (H-1, H-2 in the same amount) | 0.14 |

Production of Emulsion EM-1:

An aqueous potassium bromide solution and an aqueous silver nitrate solution were simultaneously added to an aqueous gelatin solution with vigorous agitation at 65° C. over a period of 15 minutes to obtain octahedral silver bromide grains having an average grain diameter of 0.23 μm. During this reaction, 0.3 g of 3,4-dimethyl-1,3-thiazoline-2-thione was added per mol of silver. To this emulsion were added 6 mg of sodium thiosulfate per mol of silver and then 7 mg of chloroauric acid (tetrahydrate) per mol of silver. This mixture was heated at 75° C. for 80 minutes to conduct chemical sensitization. The grains thus obtained were used as cores and allowed to grow in the same precipitated state as in the first reaction. Thus, a monodisperse octahedral core/shell silver bromide emulsion having an average grain diameter of 0.4 μm was finally obtained. The coefficient of variation of the grain size was about 10%. To this emulsion were added 1.5 mg of sodium thiosulfate and 1.5 mg of chloroauric acid (tetrahydrate) per mol of silver. The resulting mixture was heated at 60° C. for 60 minutes to conduct chemical sensitization, thereby giving an internal latent image type silver halide emulsion.

For each light-sensitive layer, ExZK-1 was used as a nucleating agent. The addition amounts thereof are shown in Table 14. As nucleation accelerators were used Cpd-22, 28, and 29 in amounts of $3.2\times10^{-4}$ mmol/m$^2$ (red-sensitive layer), $2.9\times10^{-4}$ mmol/m$^2$ (green-sensitive layer), and $2.6\times10^{-4}$ mmol/m$^2$ (blue-sensitive layer), respectively. For each layer were further used Alkanol XC (manufactured by E. I. du Pont de Nemours and Co.) and a sodium alkylbenzenesulfonate as dispersion aids and a succinic ester and Magefac F-120 (manufactured by Dainippon Ink & Chemicals, Inc., Japan) as coating aids. For the layers containing either a silver halide or colloidal silver, a combination of Cpd-23, 24, and 25 in the same amount was used as a stabilizer. This sample is referred to as Sample No. 501. Compounds used in this Example are shown below.

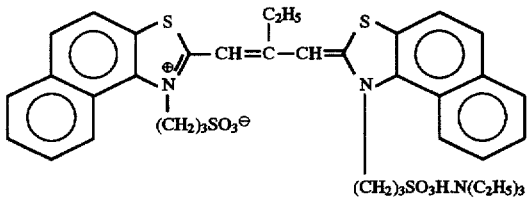

ExS-1

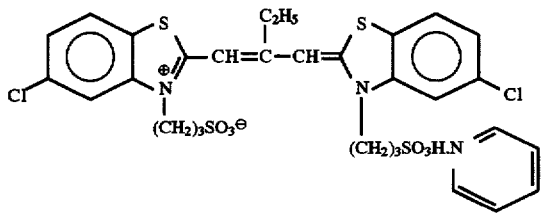

ExS-2

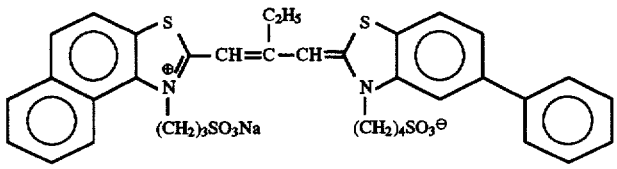

ExS-3

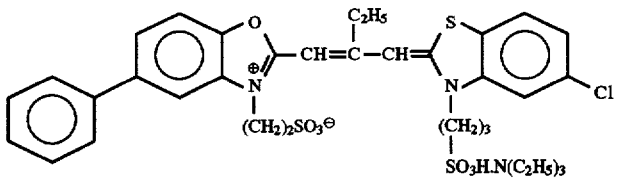

ExS-4

-continued
ExS-5
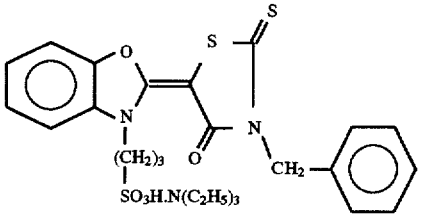
ExS-6
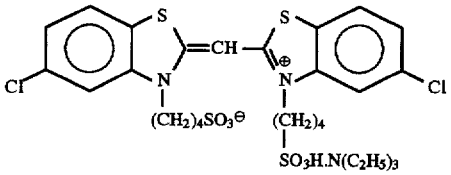
Cpd-1
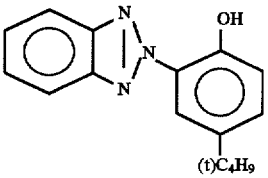
Cpd-2
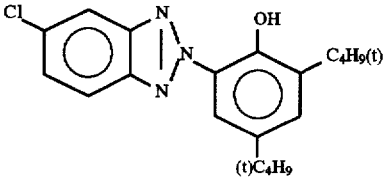
Cpd-3
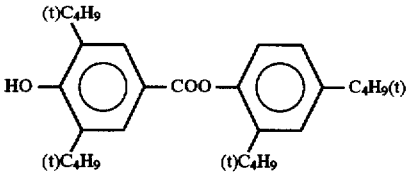
Cpd-4
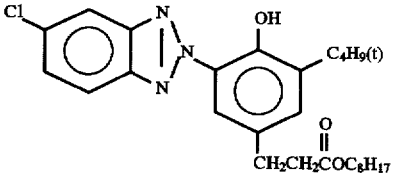
Cpd-5
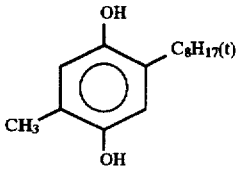
Cpd-6
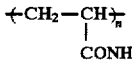
(n = 100~1000)
Cpd-7
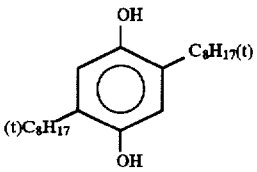

-continued
Cpd-8
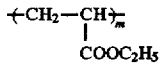
Cpd-9
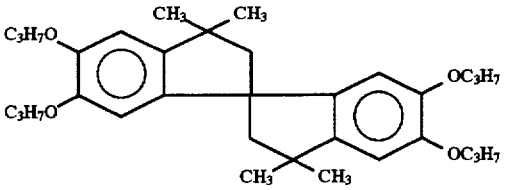
Cpd-10
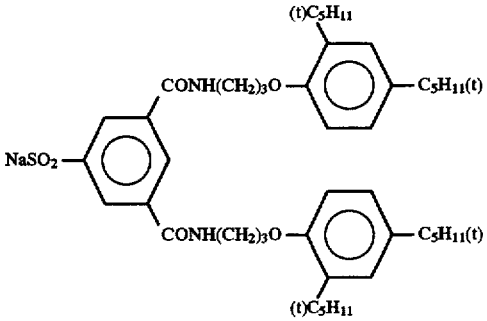
Cpd-11
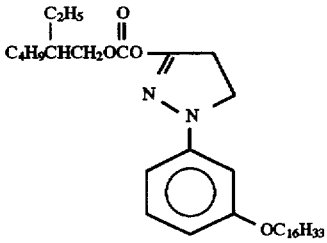
Cpd-12
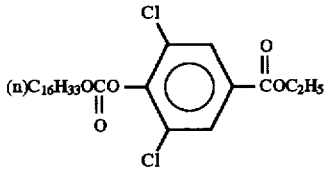
Cpd-13
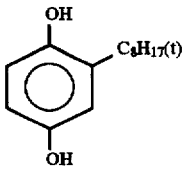
Cpd-14
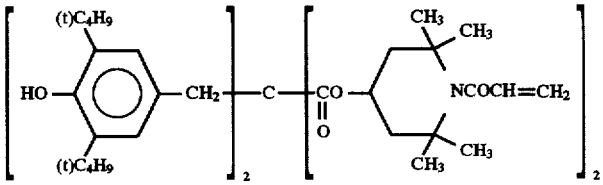
Cpd-15
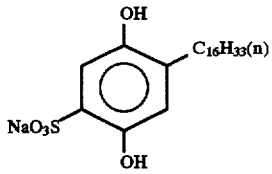

-continued
Cpd-15
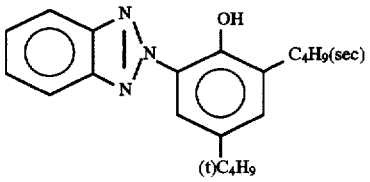
Cpd-17
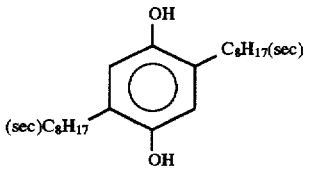
Cpd-18
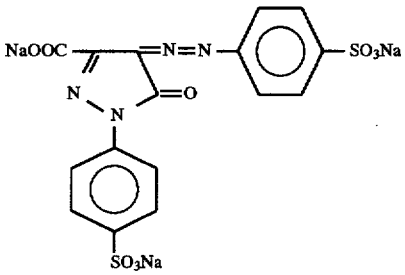
Cpd-19
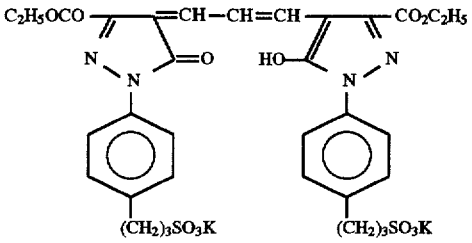
Cpd-20
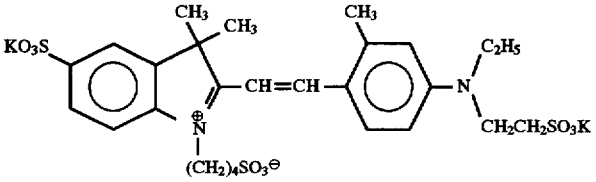
Cpd-21
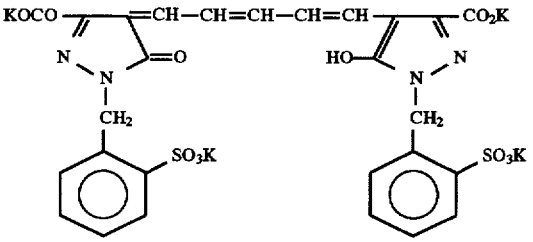
Cpd-22
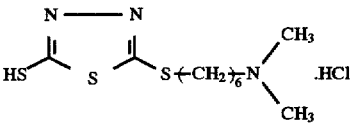
Cpd-23
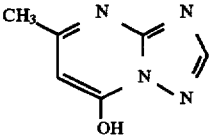

-continued
Cpd-24
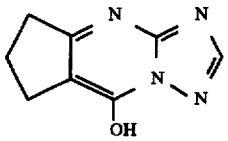
Cpd-25
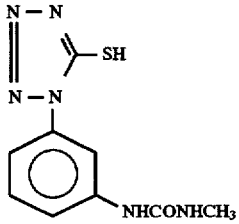
Cpd-26
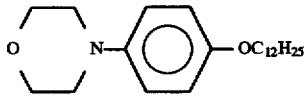
Cpd-27
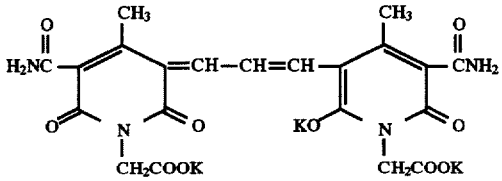
Cpd-28
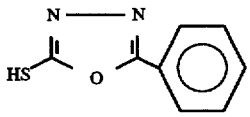
Cpd-29
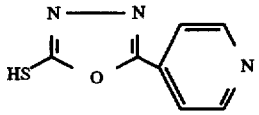
Cpd-30
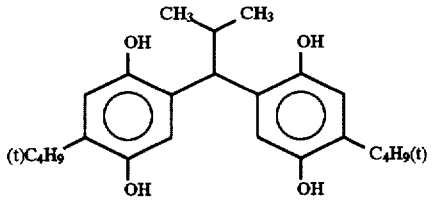
Cpd-31
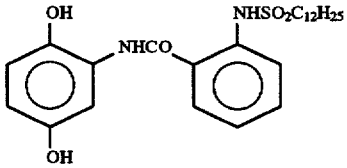
Cpd-32
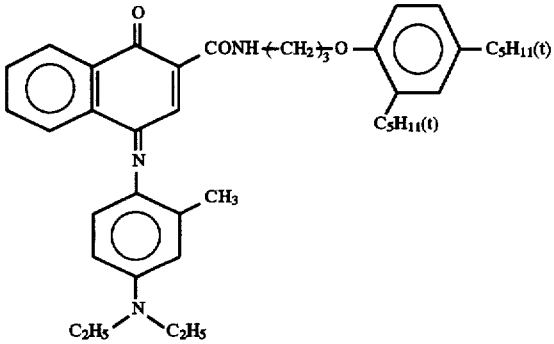

-continued
Cpd-33
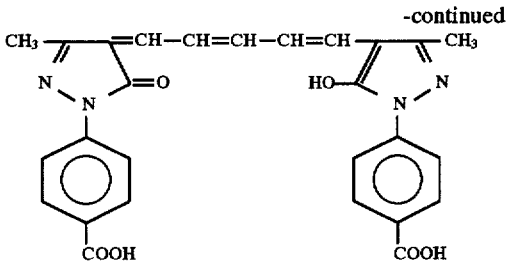
Cpd-34
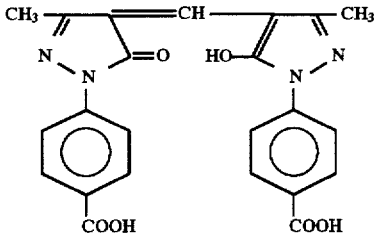
ExC-1
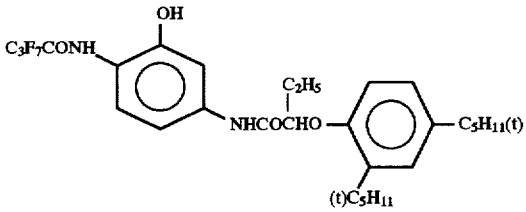
ExC-2
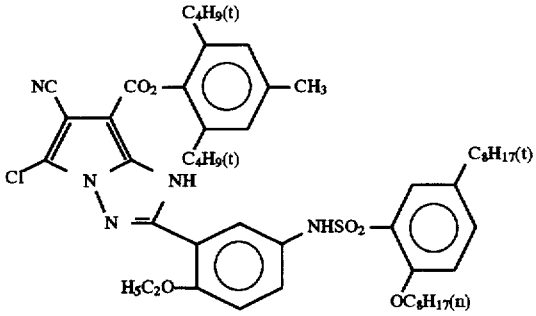
ExC-3
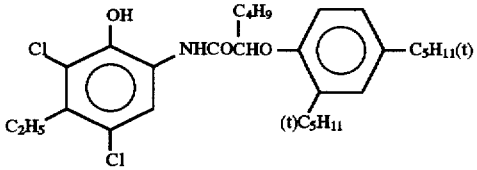
ExM-1
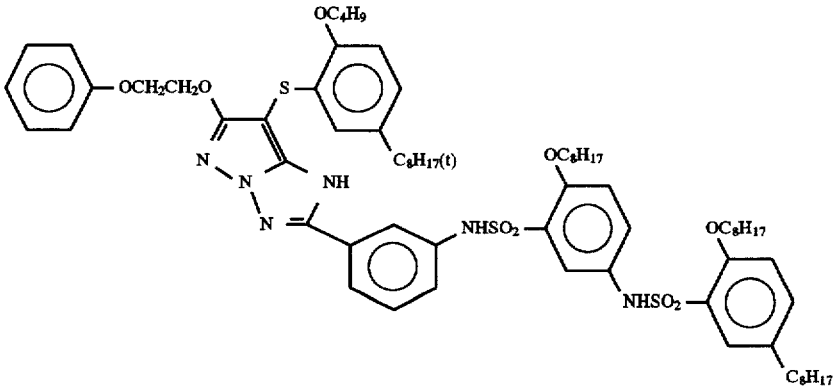

-continued

ExM-2

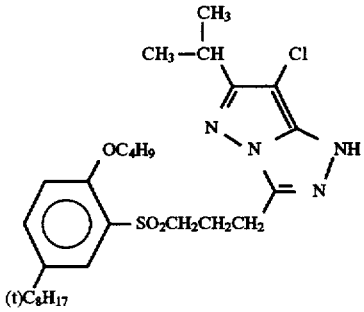

ExY-1

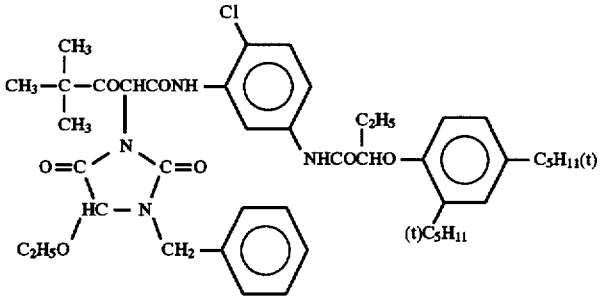

ExY-2

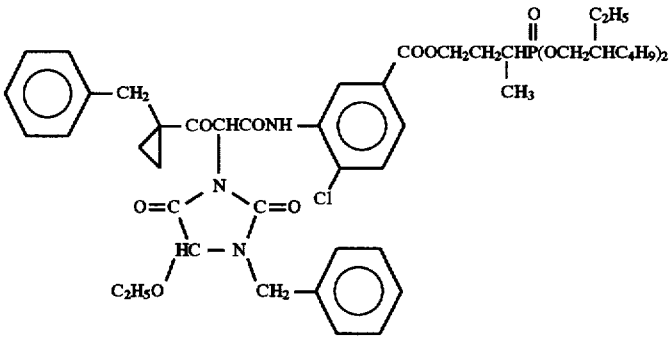

ExY-3

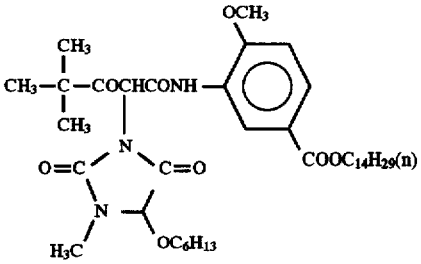

Solv-1: di(2-ethylhexyl) sebacate
Solv-2: trinonyl phosphate
Solv-3: di(3-methylhexyl) phthalate
Solv-4: tricresyl phosphate
Solv-5: dibutyl phthalate
Solv-6: trioctyl phosphate
Solv-7: di(2-ethylhexyl) phthalate
H-1: 1,2-bis(vinylsulfonylacetamido)ethane
H-2: sodium salt of 4,6-dichloro-2-hydroxy-1,3,5-triazine
ExZK-1: 7-(3-ethoxythiocarbonylaminobenzamido)-9-methyl-10-propargyl-1,2,3,4-tetrahydroacridinium trifluoromethanesulfonate Photographic material samples, Samples Nos. 502 to 505, were also produced in the same manner as the above, except that the nucleating agent was replaced with ExZK-2 or a nucleating agent according to the present invention as shown in Table 6.

Using Fine Checker 850H, manufactured by Fuji Photo Film Co., Ltd., the silver halide color photographic materials thus produced were image-wise exposed and then subjected to continuous processing until the total amount of each replenishing solution supplied under the following conditions reached three times the capacity of the tank.

| Processing Step | Time | Temperature | Tank Capacity | Replenishing Rate |
|---|---|---|---|---|
| Color development | 135 sec | 38° C. | 28 liters | 240 ml/m$^2$ |
| Bleach-fixing | 40 sec | 35° C. | 11 liters | 320 ml/m$^2$ |
| washing (1) | 40 sec | 35° C. | 7 liters | — |
| Washing (2) | 40 sec | 35° C. | 7 liters | 320 ml/m$^2$ |
| Drying | 30 sec | 80° C. | | |

The replenishment of washing water was conducted by the so-called counter-current replenishing method, in which replenishing water is fed to the washing bath (2) and the overflow from the bath (2) is introduced into the washing bath (1). During this processing, the amount of each processing solution taken out by the photographic materials was 35 ml/m$^2$.

The composition of each processing solution was as follows.

| [Color-developing solution] | [Tank solution] | [Replenishing solution] |
|---|---|---|
| D-Sorbitol | 0.15 g | 0.20 g |
| Sodium naphthalenesulfonate/formalin condensate | 0.15 g | 0.20 g |
| Pentasodium nitrilotris (methylenephosphonate) | 1.8 g | 1.8 g |
| Diethylenetriaminepentaacetic acid | 0.5 g | 0.5 g |
| 1-Hydroxyethylidene-1,1-diphosphonic acid | 0.15 g | 0.15 g |
| Diethylene glycol | 12.0 ml | 16.0 ml |
| Benzyl alcohol | 14.0 ml | 18.5 ml |
| Potassium bromide | 0.70 g | — |
| Benzotriazole | 0.005 g | 0.007 g |
| Sodium sulfite | 5.6 g | 7.4 g |
| Hydroxylamine ½ sulfate | 4.5 g | 6.0 g |
| Triethanolamine | 6.0 g | 8.0 g |
| 4-[N-Ethyl-N-(β-hydroxyethyl) amino]aniline sulfate ½ hydrate | 4.2 g | 5.6 g |
| Potassium carbonate | 30.0 g | 25.0 g |
| Brightening agent (diaminostilbene compound) | 1.3 g | 1.7 g |
| Water was added to adjust the total volume to | 1000 ml | 1000 ml |
| pH (25° C.; adjusted with KOH or sulfuric acid) | 10.25 | 10.75 |

-continued

| | [Tank and Replenishing solution] |
|---|---|
| [Bleach-fixing solution] | |
| Disodium ethylenediaminetetraacetate dihydrate | 4.0 g |
| Iron(III) ammonium ethylenediamine-tetraacetate dihydrate | 55.0 g |
| Ammonium thiosulfate (750 g/l) | 168 ml |
| Sodium p-toluenesulfinate | 30.0 g |
| Ammonium sulfite | 35.0 g |
| 3-Mercapto-1,2,4-triazole | 0.5 g |
| Ammonium nitrate | 10.0 g |
| Water was added to adjust the total volume to | 1000 ml |
| pH (25° C.; adjusted with ammonia water or acetic acid) | 6.20 |
| [Washing water] | |
| Chlorinated sodium isocyanurate | 0.02 g |
| Deionized water (conductivity, 5 μs/cm or lower) | 1000 ml |
| pH | 6.5 |

The results obtained are shown in Table 6.

TABLE 6

| Photographic material | Nucleating agent | Layer | Amount (mmol/m$^2$) | $D_{max}$ | $D_{min}$ | Remarks |
|---|---|---|---|---|---|---|
| 501 | ExZK-1 | red-sensitive layer | $1.3 \times 10^{-6}$ | 1.75 | 0.30 | Comparison |
| | | green-sensitive layer | $1.3 \times 10^{-6}$ | 1.91 | 0.20 | " |
| | | blue-sensitive layer | $0.72 \times 10^{-6}$ | 1.52 | 0.25 | " |
| 502 | ExZK-2 | red-sensitive layer | $1.5 \times 10^{-5}$ | 1.85 | 0.24 | Comparison |
| | | green-sensitive layer | $1.5 \times 10^{-5}$ | 2.01 | 0.22 | " |
| | | blue-sensitive layer | $1.0 \times 10^{-5}$ | 1.75 | 0.24 | " |
| 503 | Compound (19) | red-sensitive layer | $1.2 \times 10^{-6}$ | 2.12 | 0.20 | Invention |
| | | green-sensitive layer | $1.2 \times 10^{-6}$ | 2.43 | 0.15 | " |
| | | blue-sensitive layer | $0.72 \times 10^{-6}$ | 2.12 | 0.17 | " |
| 504 | Compound (20) | red-sensitive layer | $1.1 \times 10^{-6}$ | 2.49 | 0.23 | Invention |
| | | green-sensitive layer | $1.1 \times 10^{-6}$ | 2.74 | 0.16 | " |
| | | blue-sensitive layer | $0.60 \times 10^{-6}$ | 2.30 | 0.19 | " |
| 505 | Compound (24) | red-sensitive layer | $1.2 \times 10^{-6}$ | 2.05 | 0.20 | Invention |
| | | green-sensitive layer | $1.3 \times 10^{-6}$ | 2.24 | 0.14 | " |
| | | blue-sensitive layer | $0.70 \times 10^{-6}$ | 2.00 | 0.16 | " |

Table 6 shows that the nucleating agents according to the present invention exhibited a satisfactory reversal effect also in direct positive type multilayered color photographic materials even when used in a small amount.

EXAMPLE 2-1

1) Production of Samples by Coating

An aqueous silver nitrate solution and an aqueous sodium chloride solution were simultaneously mixed with a 40° C. aqueous gelatin solution in the presence of $5.0 \times 10^{-6}$ mol of $NH_4RhCl_6$ per mol of silver. Thereafter, soluble salts were removed by the method well known in the art, and gelatin was then added. To this mixture was added, without chemical sensitization, 2-methyl-4-hydroxy-1,3,3a,7-tetrazaindene as a stabilizer. The emulsion thus obtained was a monodisperse emulsion comprising cubic grains having an average grain size of 0.2 μm.

To this emulsion was added a hydrazine compound represented by general formula (1) or a comparative compound both shown in Table 7.

Comparative Compound M (Compound 13 described in JP-A-2-37)

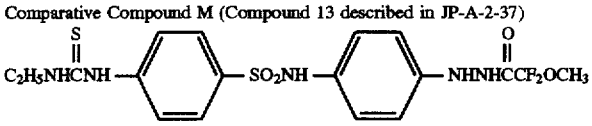

Comparative Compound N (Compound 45 described in JP-A-2-37)

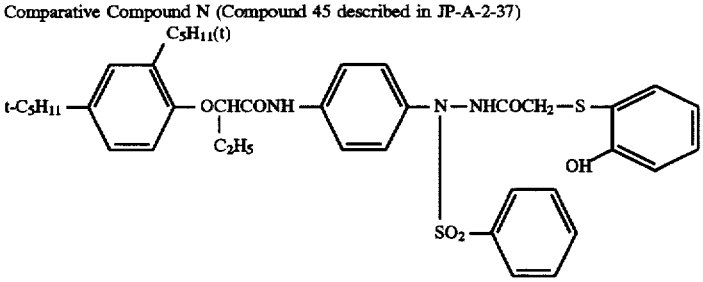

Comparative Compound O (Compound 8 described in JP-A-2-285342)

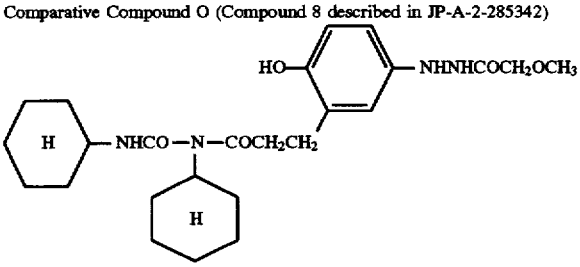

Comparative Compound P

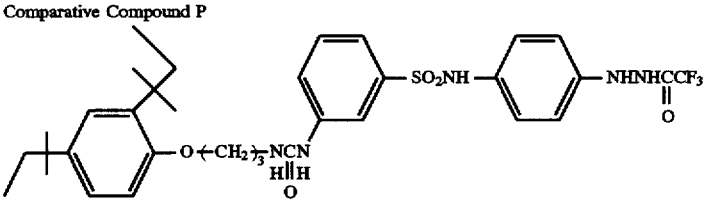

The following nucleation accelerator was further added in an amount of 15 mg/m$^2$.

A-214

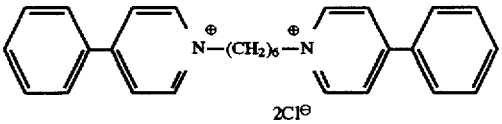

Thereafter, a poly(ethyl acrylate) latex was added to the mixture in a solid amount of 30 wt % based on the amount of gelatin, and 1,3-divinylsulfonyl-2-propanol was further added as a hardener. The thus-obtained coating fluid was applied to a polyester support at an Ag spread rate of 3.8 g/m$^2$. The spread rate of gelatin was 1.8 g/m$^2$. This emulsion layer was coated with a protective layer comprising 1.5 g/m$^2$ of gelatin and 0.3 g/m$^2$ of poly(methyl methacrylate) particles having a particle diameter of 2.5 μm.

The support used in this Example had a back layer and a back-protective layer respectively having the following compositions. (The back side of the support had a degree of swelling of 110%.)

| (Back layer) | |
|---|---|
| Gelatin | 170 mg/m$^2$ |
| Sodium dodecylbenzylsulfonate | 32 mg/m$^2$ |

-continued

| | |
|---|---|
| Sodium dihexyl α-sulfonate | 35 mg/m$^2$ |
| $SnO_2$/Sb (9/1 by weight; average particle diameter 0.25 μm) | 318 mg/m$^2$ |
| (Back-protective layer) | |
| Gelatin | 2.7 g |
| Silicon dioxide matting agent (average particle diameter, 3.5 μm) | 26 mg/m$^2$ |
| Sodium dihexyl α-sulfosuccinate | 20 mg/m$^2$ |
| Sodium dodecylbenzylsulfonate | 67 mg/m$^2$ |
| $C_8F_{17}SO_2N(C_3H_7)-(CH_2CH_2O)_n-(CH_2)_4-SO_3Li$ | 5 mg/m$^2$ |
| Dye A: | 190 mg/m$^2$ |

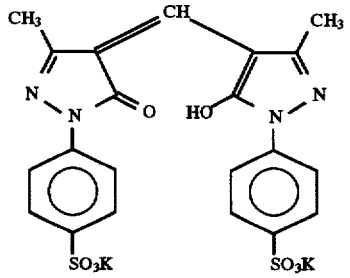

| | |
|---|---|
| Dye B: | 32 mg/m$^2$ |

-continued

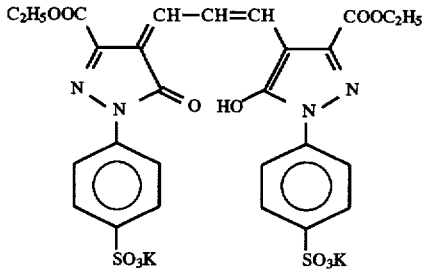

Dye C: 59 mg/m²

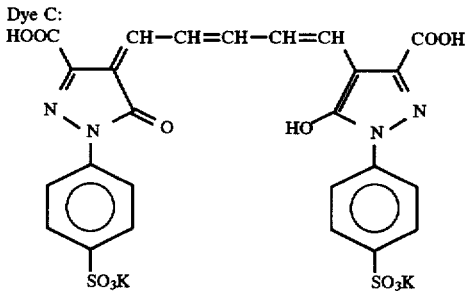

| | |
|---|---|
| Ethyl acrylate latex (average particle diameter, 0.05 μm) | 260 mg/m² |
| 1,3-Divinylsulfonyl-2-propanol | 149 mg/m² |

2) Evaluation of Photographic Performances

The samples obtained by coating were image-wise exposed with roomlight printer P-627FM, manufactured by Dainippon Screen Mfg. Co., Ltd., through the original illustrated in FIG. 1 of JP-A-2-293736. Using automatic processor FG10NH, manufactured by Fuji Photo Film Co., Ltd., the exposed samples were developed with developing solution A at 34° C. for 20 seconds, and then subjected to fixing with fixing solution GR-F1, manufactured by Fuji Photo Film Co., Ltd., and to washing and drying.

Each sample was evaluated for letter image quality and $D_{max}$, and the results obtained are shown in Table 7. A letter image quality of 5 means such an image quality that characters having a line width of 30 μm are reproduced when the sample is correctly exposed through the original illustrated in that FIG. 1 so that use of an original having a dot percent of 50% gives an image having a dot percent of 50% on the reversal photographic material; this rating indicates exceedingly high letter image quality. On the other hand, a white-character quality of 1 means such an image quality that only characters having a line with of 150 μm or larger are reproduced through the same correct exposure; this rating indicates poor letter image quality. Between 5 and 1, there are three ranks, 4, 3, and 2, which are determined by sensuous evaluation. The letter image qualities suitable for practical use are 3 and higher.

$D_{max}$ is the maximum density of an image formed through the same exposure conducted so that use of an original having a dot percent of 50% gives an image having a dot percent of 50% on the photographic material.

The samples according to the present invention had a high $D_{max}$ and an excellent letter image quality even with a small amount of a nucleating agent.

TABLE 7

| | Sample | Compound | Amount (mol/Ag mol) | $D_{max}$ | Letter image quality | Remarks |
|---|---|---|---|---|---|---|
| 1 | 1-a | Comparative Compound M | $5.0 \times 10^{-4}$ | 3.7 | 3 | Comparison |
| 2 | 1-b | Comparative Compound N | $2.0 \times 10^{-3}$ | 3.4 | 2 | " |
| 3 | 1-c | Comparative Compound O | $1.5 \times 10^{-3}$ | 2.6 | 3 | " |
| 4 | 1-d | Comparative Compound P | $5.0 \times 10^{-4}$ | 3.4 | 2 | " |
| 5 | 1-1 | 103 | $5.0 \times 10^{-4}$ | 4.9 | 5 | Invention |
| 6 | 1-2 | 105 | $5.0 \times 10^{-4}$ | 4.8 | 4 | " |
| 7 | 1-3 | 109 | $5.0 \times 10^{-4}$ | 5.0 | 5 | " |
| 8 | 1-4 | 110 | $5.0 \times 10^{-4}$ | 4.7 | 4 | " |
| 9 | 1-5 | 115 | $2.0 \times 10^{-4}$ | 5.1 | 5 | " |
| 10 | 1-6 | 116 | $2.0 \times 10^{-4}$ | 5.2 | 5 | " |
| 11 | 1-7 | 117 | $2.0 \times 10^{-4}$ | 5.0 | 5 | " |
| 12 | 1-8 | 118 | $2.0 \times 10^{-4}$ | 5.2 | 5 | " |
| 13 | 1-9 | 122 | $2.0 \times 10^{-4}$ | 5.0 | 5 | " |
| 14 | 1-10 | 123 | $2.0 \times 10^{-4}$ | 4.9 | 4 | " |
| 15 | 1-11 | 126 | $5.0 \times 10^{-4}$ | 4.8 | 4 | " |

3) Photographic Performances after Processing with Aerially Exhausted Developing Solution The developing tank of automatic processor FG710NH, manufactured by Fuji Photo Film Co., Ltd., was filled with developing solution A, used in Example 1-1, and this processor was operated at 38° C. for 8 hours per day over a period of 5 days without passing a film therethrough. Thereafter, each photographic material sample was processed with this processor. The performances of each sample are shown in Table 2.

In the Table, $\Delta D_{max}$ is the difference between the value of $D_{max}$ in Table 1 and that in Table 2. The samples according to the present invention underwent little change in $D_{max}$.

TABLE 8

| | Sample | $D_{max}$ | $\Delta D_{max}$ | Letter image quality | Remarks |
|---|---|---|---|---|---|
| 1 | 1-a | 3.3 | −0.4 | 2 | Comparison |
| 2 | 1-b | 2.7 | −0.7 | 2 | " |
| 3 | 1-c | 2.2 | −0.4 | 2 | " |
| 4 | 1-d | 3.1 | −0.3 | 2 | " |
| 5 | 1-1 | 4.8 | −0.1 | 5 | Invention |
| 6 | 1-2 | 4.6 | −0.2 | 4 | " |
| 7 | 1-3 | 4.9 | −0.1 | 5 | " |
| 8 | 1-4 | 4.6 | −0.1 | 4 | " |
| 9 | 1-5 | 5.0 | −0.1 | 5 | " |
| 10 | 1-6 | 5.1 | −0.1 | 5 | " |
| 11 | 1-7 | 4.9 | −0.1 | 5 | " |
| 12 | 1-8 | 5.1 | −0.1 | 5 | " |
| 13 | 1-9 | 4.9 | −0.1 | 4 | " |
| 14 | 1-10 | 4.7 | −0.2 | 5 | " |
| 15 | 1-11 | 4.6 | −0.2 | 4 | " |

EXAMPLE 2-2

(Preparation of Light-sensitive Emulsion)

To a 50° C. aqueous gelatin solution was added $4\times10^{-7}$ mol of potassium iridium(III) hexachloride per mol of silver. An aqueous silver nitrate solution and an aqueous solution of potassium iodide and potassium bromide were simultaneously added to the 50° C. gelatin solution in the presence of ammonia over a period of 60 minutes, during which the pAg was kept at 7.8. Thus, a monodisperse emulsion comprising cubic grains was produced which had an average grain size of 0.28 μm and an average silver iodide content of 0.3 mol %. This emulsion was desalted by the flocculation method. Thereto was added 40 g of inert gelatin per mol of silver. While the temperature of this mixture was kept at 50° C., 5,5'-dichloro-9-ethyl-3,3-bis(3-sulfopropyl) oxacarbocyanine as a sensitizing dye and a solution of $10^{-3}$ mol of KI per mol of silver were added thereto. Fifteen minutes after the addition, the mixture was cooled.

(Formation of Light-sensitive Emulsion Layer)

This emulsion was redissolved, and a compound according to the present invention or a comparative compound both shown in Table 3 was added to the solution at 40° C. Thereto were added 5-methylbenztriazole, 4-hydroxy-1,3,3a,7-tetrazaindene, compound (a) shown below, poly(ethyl acrylate) in an amount of 30 wt % based on the amount of gelatin, and compound (b) shown below as a gelatin hardener. The thus-prepared coating fluid was applied at a silver spread rate of 3.8 g/m² to a poly(ethylene terephthalate) film (150 μm) having an undercoat (0.5 μm) comprising a vinylidene chloride copolymer.

Compound (a) 3.5 mg/m²

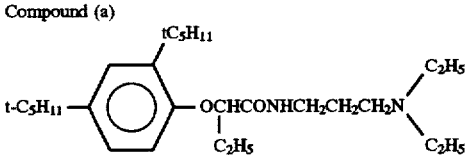

Compound (b)

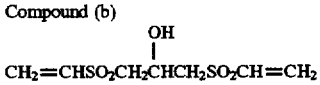

2.0 wt % per gelatin (Formation of Protective Layer)

Using the surfactants shown below, the emulsion layer was coated with a protective layer containing 1.5 g/m² of gelatin, 0.3 g/m² of fine poly(methyl methacrylate) particles (average particle diameter, 2.5 μm), and 0.3 g/m², in terms of Ag amount, of fine AgCl grains (0.08 μm).

Surfactants

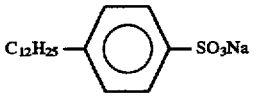

37 mg/m²

$CH_2COOC_6H_{13}$
|
$CHCOOC_6H_{13}$
|
$SO_3Na$ 37 mg/m²

$C_8F_{17}SO_2NCH_2COOK$
|
$C_3H_7$ 2.5 mg/m²

A back layer and a back-protective layer respectively having the following compositions were further formed by coating.

[Back layer]

| | |
|---|---|
| Gelatin | 3 g/m² |
| Poly(ethyl acrylate) latex | 2 g/m² |
| Surfactant, sodium p-dodecylbenzenesulfonate | 40 mg/m² |

-continued

| | |
|---|---|
| $CH_2=CHSO_2CH_2CONH$ ┐ $(CH_2)_2$ $CH_2=CHSO_2CH_2CONH$ ┘ | 110 mg/m² |
| $SnO_2/Sb$ (90/10 by weight; average particle diameter 0.20 μm) | 200 mg/m² |

Dye mixture

Dye [a₂] 50 mg/m²

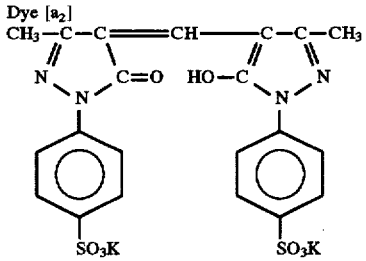

Dye [b₂] 100 mg/m²

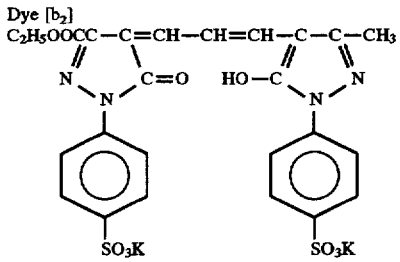

Dye [c₂] 50 mg/m²

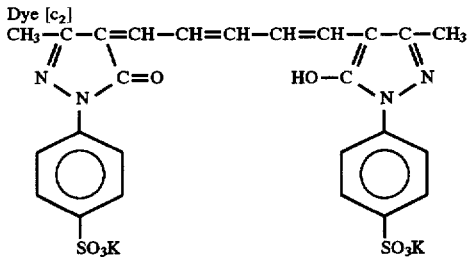

[Back-protective layer]

| | |
|---|---|
| Gelatin | 0.8 mg/m² |
| Fine poly(methyl methacrylate) particles (average particle diameter, 4.5 μm) | 30 mg/m² |
| Sodium dihexyl α-sulfosuccinate | 15 mg/m² |
| Sodium p-dodecylbenzenesulfonate | 15 mg/m² |
| Sodium acetate | 40 mg/m² |

Developing solution D:

| | |
|---|---|
| Potassium hydroxide | 10.0 g |
| Disodium ethylenetriaminepentaacetate | 1.5 g |
| Potassium carbonate | 15.0 g |
| Potassium bromide | 3.0 g |
| 5-Methylbenzotriazole | 0.10 g |
| 1-Phenyl-5-mercaptotetrazole | 0.02 g |
| Potassium sulfite | 10.0 g |
| Sodium 2-mercaptobenzimidazole-5-sulfonate | 0.15 g |
| 4-Hydroxymethyl-4-methyl-1-phenyl-3-pyrazolidone | 0.40 g |
| Ascorbic acid | 30.0 g |

Potassium hydroxide and water were added to adjust the total volume to 1 liter and the pH to 10.7.

(Evaluation of Performances)

These samples were exposed to 3,200° K. tungsten light through an optical wedge and a contact screen (manufactured by Fuji Photo Film Co., Ltd.; 150-L chain dot type). The exposed samples were developed with developing solution D at 34° C. for 30 seconds, and then subjected to fixing, washing, and drying.

The resulting images were examined for halftone quality and $D_{max}$. The results obtained are shown in Table 9.

TABLE 9

| | Sample | Compound | Amount (mol/Ag mol) | $D_{max}$ | Halftone quality | Remarks |
|---|---|---|---|---|---|---|
| 1 | 2-a | Comparative Compound M | $1.0 \times 10^{-4}$ | 3.5 | 3 | Comparison |
| 2 | 2-b | Comparative Compound N | $3.0 \times 10^{-4}$ | 3.1 | 2 | " |
| 3 | 2-c | Comparative Compound O | $0.7 \times 10^{-3}$ | 2.6 | 2 | " |
| 4 | 2-d | Comparative Compound P | $1.0 \times 10^{-4}$ | 3.1 | 2 | " |
| 5 | 2-1 | 101 | $1.0 \times 10^{-4}$ | 5.0 | 4 | Invention |
| 6 | 2-2 | 102 | $1.0 \times 10^{-4}$ | 4.9 | 5 | " |
| 7 | 2-3 | 103 | $1.0 \times 10^{-4}$ | 5.2 | 5 | " |
| 8 | 2-4 | 105 | $1.0 \times 10^{-4}$ | 5.0 | 5 | " |
| 9 | 2-5 | 106 | $1.0 \times 10^{-4}$ | 5.0 | 5 | " |
| 10 | 2-6 | 109 | $1.0 \times 10^{-4}$ | 5.2 | 5 | " |
| 11 | 2-7 | 110 | $1.0 \times 10^{-4}$ | 5.0 | 4 | " |
| 12 | 2-8 | 116 | $2.0 \times 10^{-5}$ | 4.7 | 5 | " |
| 13 | 2-9 | 118 | $2.0 \times 10^{-5}$ | 4.9 | 4 | " |
| 14 | 2-10 | 122 | $2.0 \times 10^{-5}$ | 4.8 | 4 | " |
| 15 | 2-11 | 126 | $1.0 \times 10^{-4}$ | 5.1 | 5 | " |

Halftone quality was visually evaluated in five grades; rating "5" indicates the best quality and rating "1" indicates the worst quality. Images rated as "5" or "4" are applicable to practical use as a halftone original for platemaking, images rated as "3" are on the lowermost level applicable to practical use, and images rated as "2" or "1" are inapplicable to practical use.

$D_{max}$ for a sample which had been exposed through an optical wedge in the same manner and processed was the optical density ($D_{max}$) as measured at the point which had an exposure (0.5+logE3) larger by 0.5 than the exposure (logE3) giving an optical density of 1.5.

The results show that as compared with the comparative compounds, the compounds according to the present invention were more effective in imparting high halftone quality while maintaining a high $D_{max}$.

EXAMPLE 2-3

(Preparation of Emulsion for Image-forming Layer)

A 0.37M aqueous silver nitrate solution and an aqueous halogen salt solution containing $1\times10^{-7}$ mol of $K_2Rh(H_2O)Cl_5$ and $2\times10^{-7}$ mol of $K_2IrCl_6$ per mol of silver and containing 0.16M of potassium bromide and 0.22M of sodium chloride were added to a 2% aqueous gelatin solution containing 0.08M of sodium chloride and 1,3-dimethyl-2-imidazolthione with stirring at 38° C. by the double-jet method over a period of 12 minutes to obtain silver chlorobromide grains having an average grain size of 0.20 μm and a silver chloride content of 55 mol %. Thus, nuclei were formed. Subsequently, a 0.63M aqueous silver nitrate solution and an aqueous halogen salt solution containing 0.23M of potassium bromide and 0.43M of sodium chloride were added by the double-jet method in the same manner over a period of 20 minutes. Thereto was then added a solution of $1\times10^{-3}$ mol of KI per mol of silver to preform conversion. Washing with water was conducted by the ordinary flocculation method. Thereafter, 40 g of gelatin was added per mol of silver and the pH and pAg were adjusted to 6.0 and 7.3, respectively. To this mixture were added 7 mg of sodium benzenethiosulfonate, 2 mg of benzenesulfinic acid, 8 mg of chloroauric acid, and 5 mg of sodium thiosulfate per mol of silver. The resulting mixture was heated at 60° C. for 45 minutes to conduct chemical sensitization. Thereto were then added 150 mg of 4-hydroxy-6-methyl-1,3,3a,7-tetrazaindene as a stabilizer and Proxcel as an antiseptic. The grains thus obtained were cubic silver chlorobromide grains having an average grain diameter of 0.27 μm and a silver chloride content of 60 mol % (coefficient of variation, 10%).

To the thus-obtained emulsion were added, as sensitizing dyes, $7\times10^{-14}$ mol of 5-[3-(4-sulfobutyl)-5-chloro-2-benzoxazolidylidene]ethylidene-1-hydroxyethoxyethyl-3-(2-pyridyl)-2-thiohydantoin potassium salt per mol of silver and any of $4\times10^{-4}$ mol of the short-wave cyanine dye represented by structural formula (A) given below per mol of silver, $3\times10^{-4}$ mol of 1-phenyl-5-mercaptotetrazole per mol of silver, $4\times10^{-4}$ mol of the mercapto compound represented by structural formula (B) given below per mol of silver, $3\times10^{-4}$ mol of the mercapto compound represented by structural formula (C) given below per mol of silver, $4\times10^{-4}$ mol of the triazine compound represented by structural formula (D) given below per mol of silver, $2\times10^{-3}$ mol of 5-chloro-8-hydroxyquinoline per mol of silver, a compound according to the present invention, as shown in Table 4. The sodium salt of N-oleyl-N-methyltaurine was further added in an amount of 30 mg/m$^2$ in terms of spread rate thereof. To this mixture were added a dispersion of poly (ethyl acrylate) (500 mg/m$^2$) and 1,2-bis (vinylsulfonylacetamido)ethane as a hardener in an amount of 30 mg/m$^2$. Thus, a coating fluid for forming an image-forming layer was prepared.

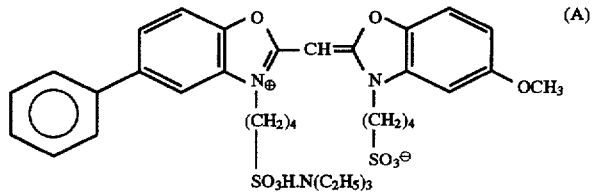

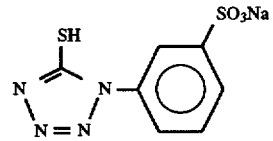

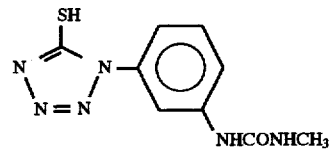

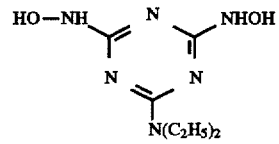

TABLE 10

| | Sample | Compound | Amount (mol/Ag mol) | Remarks |
|---|---|---|---|---|
| 1 | 3-a | Compartive Compound M | $3.0 \times 10^{-4}$ | Comparison |
| 2 | 3-b | Comparative Compound N | $8.0 \times 10^{-4}$ | " |
| 3 | 3-c | Comparative Compound O | $1.0 \times 10^{-3}$ | " |
| 4 | 3-d | Comparative Compound P | $3.0 \times 10^{-4}$ | " |
| 5 | 3-1 | 103 | $3.0 \times 10^{-4}$ | Invention |
| 6 | 3-2 | 105 | $3.0 \times 10^{-4}$ | " |
| 7 | 3-3 | 109 | $3.0 \times 10^{-4}$ | " |

TABLE 10-continued

| | Sample | Compound | Amount (mol/Ag mol) | Remarks |
|---|---|---|---|---|
| 8 | 3-4 | 110 | $3.0 \times 10^{-4}$ | " |
| 9 | 3-5 | 115 | $1.0 \times 10^{-4}$ | " |
| 10 | 3-6 | 116 | $1.0 \times 10^{-4}$ | " |
| 11 | 3-7 | 117 | $1.0 \times 10^{-4}$ | " |
| 12 | 3-8 | 118 | $1.0 \times 10^{-4}$ | " |
| 13 | 3-9 | 122 | $1.0 \times 10^{-4}$ | " |
| 14 | 3-10 | 123 | $1.0 \times 10^{-4}$ | " |
| 15 | 3-11 | 126 | $3.0 \times 10^{-4}$ | " |

(Preparation of Emulsion Containing Redox Compound)

A 1.0M aqueous silver nitrate solution and an aqueous halogen salt solution containing $3\times10^{-7}$ mol of $(NH_4)_3RhCl_6$ per mol of silver and containing 0.3M of potassium bromide and 0.74M of sodium chloride were added to a 2% aqueous gelatin solution containing 0.08M of sodium chloride and 1,3-dimethyl-2-imidazolinethione with stirring at 45° C. by the double-jet method over a period of 30 minutes to obtain silver chlorobromide grains having an average grain size of 0.30 μm and a silver chloride content of 70 mol %. Thereto was then added a solution of $1\times10^{-3}$ mol of KI per mol of silver to preform conversion. Washing with water was conducted by the ordinary flocculation method. Thereafter, 40 g of gelatin was added per mol of silver and the pH and pAg were adjusted to 6.0 and 7.6, respectively. To this mixture were added 7 mg of sodium benzenethiosulfonate, 2 mg of benzenesulfinic acid, 8 mg of chloroauric acid, and 5 mg of sodium thiosulfate per mol of silver. The resulting mixture was heated at 60° C. for 60 minutes to conduct chemical sensitization. Thereto were then added 350 mg of 4-hydroxy-6-methyl-1,3,3a,7-tetrazaindene as a stabilizer and Proxcel as an antiseptic. The grains thus obtained were cubic silver chlorobromide grains having an average grain diameter of 0.30 μm and a silver chloride content of 70 mol % (coefficient of variation, 9%).

To the thus-obtained emulsion were added, as sensitizing dyes, $5\times10^{-4}$ mol of 5-[3-(4-sulfobutyl)-5-chloro-2-benzoxazolidylidene]ethylidene-1-hydroxyethoxyethyl-3-(2-pyridyl)-2-thiohydantoin potassium salt per mol of silver, the dye represented by structural formula (J) given below in an amount of 10 mg/m$^2$, a dispersion of poly(ethyl acrylate) (250 mg/m$^2$), and redox compound (R) in an amount of 90 mg/m$^2$ in terms of spread rate thereof.

(Preparation of Coating Fluid for Interlayer)

To a gelatin solution were added a hydrazine compound according to the present invention in the amount shown in Table 1, 5 mg/m$^2$ of sodium ethanethiosulfonate, 100 mg/m$^2$ of the dye represented by formula (K), 100 mg/m$^2$ of hydroquinone, 50 mg/m$^2$ of the triol compound represented by formula (L), and 350 mg/m$^2$ of a dispersion of poly(ethyl acrylate). Thus, a coating fluid for interlayer formation was prepared.

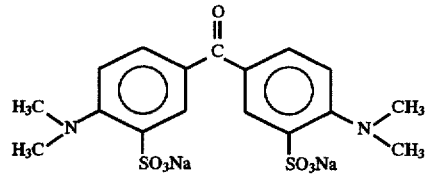

(K)

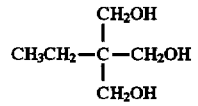

(L)

On a poly(ethylene terephthalate) film undercoated with gelatin were formed, by coating, a layer comprising 0.2 g/m$^2$ of gelatin and 40 mg/m$^2$ of bis(vinylsulfonyl)ethane as the lowermost layer, a hydrazine-containing layer (Ag, 3.4 g/m$_2$; gelatin, 1.6 g/m$_2$), an interlayer (gelatin, 0.8 g/m$_2$), and a layer containing a redox compound (Ag, 0.2 g/m$_2$; gelatin 0.2 g/m$^2$) in this order. On the layer containing a redox compound was formed a protective layer comprising 0.3 g/m$^2$ of gelatin, 60 mg/m$^2$ of an amorphous-$SiO_2$ matting agent having an average particle size of about 3.5 μm, 0.1 g/m$^2$ of methanol silica, 50 mg/m$^2$ of liquid paraffin, and a combination of 5 mg/m$^2$ of the fluorine-compound surfactant represented by structural formula (F) given below and 20 mg/m$^2$ of sodium dodecylbenzenesulfonate as a coating aid.

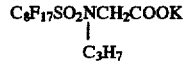

(F)

Further, a back layer having the following composition was formed by coating.

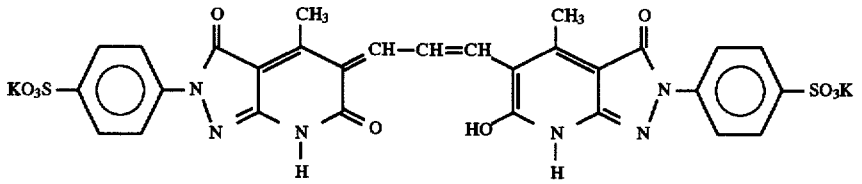

(J)

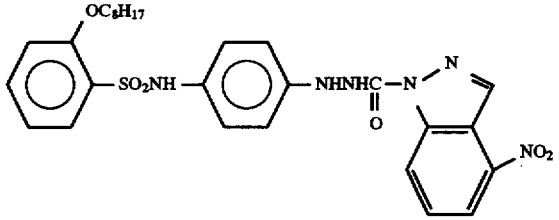

(R)

| | |
|---|---|
| (Back layer) | |
| Gelatin | 3.2 g/m$^2$ |
| $SnO_2$/Sb (9/1 by weight; average particle diameter 0.2 μm) | 200 mg/m$^2$ |
| Surfactant, sodium p-dodecylbenzylsulfonate | 40 mg/m$^2$ |
| Sodium dihexyl α-sulfosuccinate | 40 mg/m$^2$ |
| Gelatin hardener, 1,3-divinylsulfonyl-2-propanol | 200 mg/m$^2$ |
| Dye mixture | |
| Dye (M) | 20 mg/m$^2$ |
| Dye (H) | 50 mg/m$^2$ |
| Dye (I) | 20 mg/m$^2$ |
| Dye (J) | 30 mg/m$^2$ |
| (Back-protective layer) | |
| Gelatin | 1.3 mg/m$^2$ |
| Fine poly(methyl methacrylate) particles (average particle diameter, 2.5 μm) | 20 mg/m$^2$ |
| Sodium p-dodecylbenzenesulfonate | 15 mg/m$^2$ |
| Sodium dihexyl α-sulfosuccinate | 15 mg/m$^2$ |
| Sodium acetate | 60 mg/m$^2$ |
| Developing solution E: | |
| Potassium hydroxide | 90.0 g |
| Sodium hydroxide | 8.0 g |
| Disodium ethylenediaminetetraacetate | 1.0 g |
| Boric acid | 24.0 g |
| Sodium metabisulfite | 65.0 g |
| Potassium bromide | 10.0 g |
| Hydroquinone | 55.0 g |
| 5-Methylbenzotriazole | 0.40 g |
| N-Methyl-p-aminophenol | 0.50 g |
| Sodium 2-mercaptobenzimidazole-6-sulfonate | 0.30 g |
| Sodium 3-(5-mercaptotetrazol)benzenesulfonate | 0.20 g |
| N-n-Butyldiethanolamine | 14.0 g |
| N,N-Dimethylamino-6-hexanol | 0.20 g |
| Sodium toluenesulfonate | 8.0 g |
| 5-Sulfosalicylic acid | 23.0 g |

Potassium hydroxide and water were added to adjust the total volume to 1 liter and the pH to 11.9.

Dye (M)

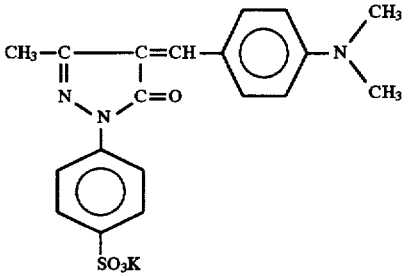

Dye (H)

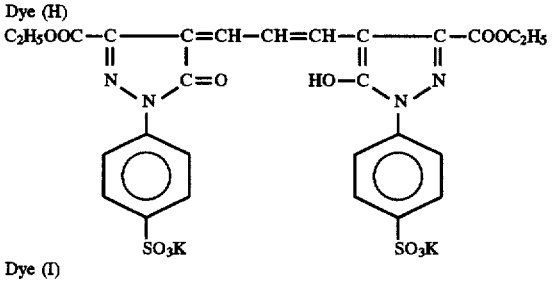

Dye (I)

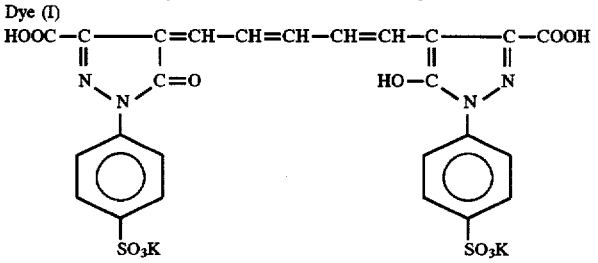

-continued

Dye (J)

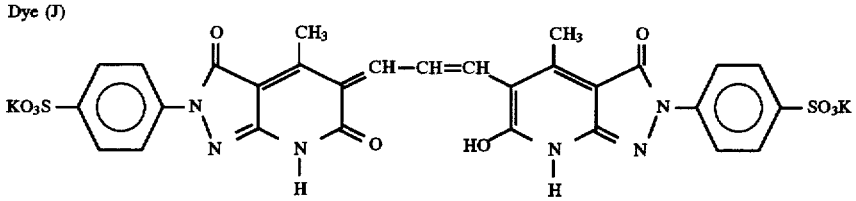

(Evaluation)

These samples were exposed to 3,200° K. tungsten light through an optical wedge and a contact screen (manufactured by Fuji Photo Film Co., Ltd.; 150-L chain dot type). The exposed samples were processed with developing solution E by means of automatic processor FG-660F (manufactured by Fuji Photo Film Co., Ltd.) at 34° C. for 30 seconds.

The fixing solution used was GR-F1 (manufactured by Fuji Photo Film Co., Ltd.).

Lith Ortho Film GA-100 of full size (50.8 cm×61 cm) with a developing solution having the composition described above, and to the same test using a developing solution exhausted by aerial oxidation obtained by allowing a developing solution having the above-described composition to stand for 3 days in the automatic processor kept unoperated. The results obtained are shown in Table 11.

TABLE 11

| | | Sensitivity | | | Gamma (γ) | | | | |
|---|---|---|---|---|---|---|---|---|---|
| | Sample | Fresh solution | Solution exhausted by processing | Solution exhausted by aerial oxidation | Fresh solution | Solution exhausted by processing | Solution exhausted by aerial oxidation | Dot gradation, fresh solution | Remarks |
| 1 | 3-a | 100 | 85 | 89 | 13.1 | 10.7 | 10.1 | 1.37 | Comparison |
| 2 | 3-b | 97 | 81 | 85 | 12.7 | 9.1 | 8.2 | 1.35 | " |
| 3 | 3-c | 97 | 82 | 85 | 12.6 | 8.7 | 7.8 | 1.36 | " |
| 4 | 3-d | 102 | 84 | 87 | 13.2 | 10.1 | 10.0 | 1.40 | " |
| 5 | 3-1 | 103 | 93 | 96 | 13.4 | 12.2 | 11.9 | 1.41 | Invention |
| 6 | 3-2 | 102 | 94 | 98 | 13.4 | 12.7 | 12.5 | 1.40 | " |
| 7 | 3-3 | 103 | 95 | 98 | 13.5 | 12.6 | 12.3 | 1.41 | " |
| 8 | 3-4 | 102 | 93 | 97 | 13.5 | 12.8 | 12.3 | 1.42 | " |
| 9 | 3-5 | 102 | 95 | 98 | 13.4 | 12.5 | 11.9 | 1.40 | " |
| 10 | 3-6 | 103 | 96 | 99 | 13.4 | 12.3 | 12.0 | 1.42 | " |
| 11 | 3-7 | 103 | 93 | 97 | 13.5 | 12.4 | 11.8 | 1.41 | " |
| 12 | 3-8 | 103 | 92 | 96 | 13.5 | 12.7 | 12.2 | 1.41 | " |
| 13 | 3-9 | 102 | 94 | 98 | 13.5 | 12.4 | 12.1 | 1.40 | " |
| 14 | 3-10 | 103 | 92 | 97 | 13.4 | 12.8 | 12.4 | 1.42 | " |
| 15 | 3-11 | 102 | 93 | 95 | 13.5 | 12.7 | 12.2 | 1.40 | " |

Sensitivity herein is a relative value of the inverse of the exposure which gives a density of 1.5 through development at 34° C. for 30 seconds, with that inverse for Sample 3-a being taken as 100. Gamma is expressed by the following equation.

γ=(3.0−0.3)/[log (exposure giving an optical density of 3.0)−log (exposure giving an optical density of 0.3)]

Dot gradation is expressed by the following equation.

*Dot gradation=[exposure giving a dot percent of 95% (log E95%)]−[exposure giving a dot percent of 5% (log E5%)]

The samples were also subjected to the same tests using a developing solution exhausted by processing obtained after the processing of 150 sheets of 100%-blackened Fuji The hydrazine derivatives according to the present invention, even when used in a small amount, were capable of giving a photographic material having a high contrast, a wide dot gradation, and a small dependence on processing-solution composition.

EXAMPLE 2-4

Samples were prepared in the same manner as in Example 1-10, except that the nucleating agent shown in Table 12 was added according to Table 12.

The $D_{max}$ and $D_{min}$ of each light-sensitive layer are summarized in Table 12. Table 12 shows that the compounds according to the present invention were effective in attaining a high $D_{max}$ value and reducing fogging, even when used in a small amount.

TABLE 12

| Photographic material | Nucleating agent | Layer | Amount (mmol/m²) | $D_{max}$ | $D_{min}$ | Remarks |
|---|---|---|---|---|---|---|
| 4-1 | Comparative Compound M | red-sensitive layer | $2.0 \times 10^{-5}$ | 1.83 | 0.30 | Comparison |
| | | green-sensitive layer | $2.5 \times 10^{-5}$ | 1.87 | 0.25 | " |
| | | blue-sensitive layer | $3.0 \times 10^{-5}$ | 1.75 | 0.20 | " |
| 4-2 | 116 | red-sensitive layer | $2.0 \times 10^{-5}$ | 2.41 | 0.22 | Invention |
| | | green-sensitive layer | $2.5 \times 10^{-5}$ | 2.40 | 0.20 | " |
| | | blue-sensitive layer | $3.0 \times 10^{-5}$ | 2.37 | 0.18 | " |
| 4-3 | 117 | red-sensitive layer | $2.0 \times 10^{-5}$ | 2.52 | 0.21 | Invention |
| | | green-sensitive layer | $2.5 \times 10^{-5}$ | 2.61 | 0.19 | " |
| | | blue-sensitive layer | $3.0 \times 10^{-5}$ | 2.48 | 0.18 | " |
| 4-4 | 118 | red-sensitive layer | $2.0 \times 10^{-5}$ | 2.50 | 0.22 | Invention |
| | | green-sensitive layer | $2.5 \times 10^{-5}$ | 2.57 | 0.20 | " |
| | | blue-sensitive iayer | $3.0 \times 10^{-5}$ | 2.45 | 0.19 | " |

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a hydrazine compound, wherein the hydrazine compound is selected from (a) a hydrazide compound having an acyl group which is separately substituted (a1) with an anionic group and (a2) with an electron-attracting group having a Hammett's $\sigma_m$ value of 0.2 or higher, and (b) a hydrazide compound having an acyl group which is separately substituted (b1) with an electron-attracting group having a Hammett's $\sigma_m$ value of 0.2 or higher and (b2) with a nonionic group which forms an intramolecular hydrogen bond with a hydrogen atom in the hydrazide compound.

2. The silver halide photographic material as claimed in claim 1, which comprises a support having thereon at least one light-sensitive silver halide emulsion layer, wherein the hydrazide compound is contained in at least either the silver halide emulsion layer or a non-light-sensitive layer adjacent thereto.

3. The silver halide photographic material as claimed in claim 1, wherein the hydrazide compound is represented by the following formula (1):

$$\mathrm{Ar{-}NHNH{-}\overset{\overset{\displaystyle O}{\|}}{C}{-}L_1{-}X} \quad (1)$$

wherein Ar represents an aromatic group; $L_1$ represents a divalent connecting group having an electron-attracting group; and X represents an anionic group or a nonionic group which forms an intramolecular bond with a hydrogen atom in the hydrazide compounds.

4. The silver halide photographic material as claimed in claim 3, wherein X is an anionic group.

5. The silver halide photographic material as claimed in claim 3, wherein X is a nonionic group which forms an intramolecular bond with a hydrogen atom in the hydrazide compound.

6. The silver halide photographic material as claimed in claim 1, wherein the hydrazide compound is represented by the following formula (2-a) or (2-b):

$$\mathrm{Ar{-}NHNH{-}\overset{\overset{\displaystyle O}{\|}}{C}{-}L_2{-}COOH} \quad (2\text{-a})$$

$$\mathrm{(Ar{-}NHNH{-}\overset{\overset{\displaystyle O}{\|}}{C}{-}L_2{-}COO^-)_m M^{m+}} \quad (2\text{-b})$$

wherein Ar represents an aromatic group; $L_2$ represents a divalent alkylene or phenylene group substituted with one or more fluorine atoms; M represents a counter cation; and m is an integer of 1 to 3.

7. A silver halide photographic material as claimed in claim 1, wherein the electron-attracting group has a Hammett's $\sigma_m$ value of 0.3 or higher.

* * * * *